US005835113A

United States Patent [19]

Hirahara et al.

[11] Patent Number: 5,835,113

[45] Date of Patent: Nov. 10, 1998

[54] INK JET PRINTING APPARATUS WITH CONTROLLED COMPRESSION AND EJECTION OF COLORANTS IN LIQUID INK

[75] Inventors: Shuzo Hirahara, Kanagawa; Yasuo Hosaka; Hitoshi Nagato, both of Tokyo; Koichi Ishii, Kanagawa-ken; Yuko Nomura, Kanagawa-ken; Hideyuki Nakao, Kanagawa-ken; Teruo Murakami, Kanagawa-ken, all of Japan

[73] Assignee: Kabushiki Kaisha Toshiba, Kawasaki, Japan

[21] Appl. No.: 532,360

[22] Filed: Sep. 22, 1995

[30] Foreign Application Priority Data

| | | | |
|---|---|---|---|
| Sep. 22, 1994 | [JP] | Japan | 6-228176 |
| Nov. 29, 1994 | [JP] | Japan | 6-295246 |
| Mar. 14, 1995 | [JP] | Japan | 7-053894 |
| Jun. 30, 1995 | [JP] | Japan | 7-166622 |

[51] Int. Cl.[6] ..... B41J 2/06

[52] U.S. Cl. ..... 347/55

[58] Field of Search ..... 347/54, 55

[56] References Cited

U.S. PATENT DOCUMENTS

| | | | |
|---|---|---|---|
| 4,404,573 | 9/1983 | Kocot et al. | 347/55 |
| 4,717,926 | 1/1988 | Hotomi | 347/55 |
| 4,751,531 | 6/1988 | Saito et al. | 347/55 |
| 5,477,249 | 12/1995 | Hotome | 347/55 |
| 5,600,356 | 2/1997 | Sekiya et al. | 347/62 |

FOREIGN PATENT DOCUMENTS

| | | |
|---|---|---|
| 49-62024 | 6/1974 | Japan . |
| 56-4467 | 1/1981 | Japan . |
| 62-225361 | 10/1987 | Japan . |
| 93/11866 | 6/1993 | WIPO . |

OTHER PUBLICATIONS

Melcher et al., "Electrohydrodynamics of A Current–Carrying Semi–insulating Jet", *J. Fluid Mech.,* vol. 47:127–143, (1971).

Taylor, "Distintegration of Water Drops In An Electric Field", *Proc. Roy. Soc.,* vol. 280, A., pp. 383–397, (1964).

Patent Abstracts of Japan, Pub. No. JP2178055, Pub. Date. Nov. (1990), vol. 14, No. 447.

Patent Abstracts of Japan, Pub. No. JP2160557, Pub. Date. Jun. (1990), vol. 14, No. 416.

Abstract, JP 1–90759, Apr. (1989), vol. 13, No. 299.

Abstract, JP 60–240459, Nov. (1985).

Abstract, JP 1–110964, Apr. (1989), vol. 13, No. 334.

Abstract, JP 56–40562, Apr. (1981), vol. 5, No. 93.

Abstract, JP 56–44669, Apr. (1981), vol. 5, No. 101.

*Primary Examiner*—Stuart N. Hecker

*Attorney, Agent, or Firm*—Foley & Lardner

[57] ABSTRACT

An ink jet printing apparatus, in which the ink having colorants distributed in a solvent is supplied over the electrode array on the surface of the head substrate such that the electrode array is completely covered by the ink, while voltages are applied to the electrode array to produce an electric field for exerting an electrostatic force on the colorants in the ink such that the colorants are compressed and ejected toward a recording medium. Each individual electrode constituting the electrode array can have a tip end portion projecting from the surface of the head substrate. The apparatus also has an element for compressing colorants distributed in a solvent of an ink and an element for ejecting the compressed colorants toward a recording medium which are provided separately. In addition, the apparatus can incorporate an element for conveying colorants in the ink through the ink supply passage toward the colorant ejection point on the electrode array.

80 Claims, 47 Drawing Sheets

INK JET PRINTING APPARATUS WITH CONTROLLED COMPRESSION AND EJECTION OF COLORANTS IN LIQUID INK

BACKGROUND OF THE INVENTION

1. Field Of The Invention

The present invention relates to an ink jet printing apparatus which uses a liquid ink formed by distributing colorants in a solvent, and carries out a printing by compressing colorants in the liquid ink and ejecting the compressed colorants onto a recording medium.

2. Description Of The Background Art

The ink jet printer is a printing apparatus already available for practical use which realizes a printing of an image using recording dots formed by ejecting the liquid ink in forms of small droplets called ink drops onto a recording medium. This ink jet printer has advantages in that it produces less noise compared with the other recording methods and it requires no developing or fixing process, so that it is attracting much attention as a prospective plain paper recording technique.

Among numerous propositions for the ink jet printing schemes that have been made so far, the representative schemes include: (a) a scheme for ejecting the ink drops by means of a vapor pressure produced by the heat of a heat generation member, as disclosed in Japanese Patent Publication No. 56-9429 (1981) and Japanese Patent Publication No. 61-59911 (1986) for example, and (b) a multi-nozzle type scheme for printing a plurality of dots in parallel, such as a scheme for ejecting the ink drops by means of mechanical pressure pulses generated by the piezoelectric elements, as disclosed in Japanese Patent Publication No. 53-12138 (1978) for example.

As a printing head used in the ink jet printer, a serial scanning head to be mounted on a carriage which carries out a printing while moving in a direction (main scanning direction) perpendicular to a plain paper conveying direction (sub scanning direction) has been available for practical use. This serial scanning head carries out a printing while being moved mechanically, so that it is difficult to increase the printing speed. For this reason, there has been a proposition of the so called line scanning head in which an elongated printing head having the same size as a width of the plain papers is used to reduce a mechanically moved part, in order to increase the printing speed. However, it has been rather difficult to realize such a line scanning head in practice, for the following reasons.

Namely, the ink jet printing scheme is inherently prone to cause a local ink compression due to an evaporation or a volatilization of the solvent, and this local ink compression in turn causes a clogging in a very thin individual nozzle corresponding to a resolution level. Moreover, in a scheme using a vapor pressure for the formation of the ink jets, an attachment of insoluble objects due to the thermal or chemical reaction with the ink, etc. makes it even easier to induce the clogging, while in a scheme using a pressure produced by the piezoelectric element for the formation of the ink jets, a complicated structure in an ink passage, etc., makes it even easier to induce the clogging. In the serial scanning head which uses as many as several tens to one hundred and several tens of nozzles, there is a mechanism for suppressing a frequency of the clogging, but in the line scanning head which uses as many as several thousands of nozzles, the clogging is very likely to occur at rather high frequency, so that there is a problem in view of the reliability.

In addition, there is also a problem that the conventional ink jet printer is not very well suited for an improvement of the resolution level. Namely, in a scheme using a vapor pressure, it is difficult to generate the ink drops with a drop diameter below 20 $\mu$m (which corresponds to a recording dot with about 50 $\mu$m diameter on the recording paper), while in a scheme using a pressure produced by the piezoelectric element, the printing head has a very complicated structure so that it is difficult to manufacture the printing head with a high resolution level due to the problems in manufacturing techniques.

In order to resolve these problems, there have been propositions for the ink jet printing scheme in which the ink or the colorants in the ink are ejected from an ink liquid surface by means of an electrostatic force produced by applying voltages to a thin film electrode array. More specifically, a scheme for ejecting the ink by means of an electrostatic attractive force has been proposed in Japanese Patent Application Laid Open No. 49-62024 (1974) and Japanese Patent Application Laid Open No. 56-4467 (1981) for example, and a scheme for ejecting the colorants in high concentration by using an ink containing charged colorant particles has been proposed in WO93/11866 (PCT/AU92/00665).

In these schemes, the printing head configuration is either a slit type nozzle configuration as shown in FIG. 1 which requires no nozzle for individual dot, or a nozzle-less configuration as shown in FIG. 2 which requires no ink passage partition wall for individual dot, so that these schemes provide effective measures for the prevention of and the recovery from the clogging which has been a major obstacle in realizing the line scanning head. In addition, the latter configuration in particular is suited for the improvement of the resolution level as it is possible to generate and eject the ink drops with a very small diameter stably.

In such an ink jet printing scheme for ejecting colorants by the electrostatic force, the printing head has usually been the so called edge shooter type head having a configuration as shown in FIG. 1 in which tip ends 93*a* of an array of electrodes 93 are arranged at an edge portion of a head substrate 92 and the ink is supplied from a supply passage 95 and withdrawn into a removal channel 97. However, this printing head configuration has the electrodes exposed to the air, so that the electrode array is prone to damage due to an electric discharging caused by the strong electric field, and such damage makes the ink flow unstable, so that there arises a problem of a large fluctuation in the operation characteristic. Here, it may seem possible to contemplate a measure for covering a surface of the electrode by an insulative film, but such an insulative film must be formed extremely thin, so that there is a high probability for the damage or the insulation breakdown due to contacts and there remains a problem of the reliability.

In addition, such a printing head which uses the edge portions of the electrodes requires a very high precision manufacturing of the edge for which a yield is quite low, so that there are problems in terms of the ease of manufacturing, the uniformity of the operation characteristic, and the level of the printing quality. In particular, in a case of the line scanning head which is required to print as many as several thousands of dots in parallel, a rate of successful overall production is about a rate of successful production for individual dot multiplied by itself as many times as a number of dots, so that unless a considerably high reliability is realizable, the manufacturing yield and the printing quality are going to be severely affected.

Moreover, in the conventional printing head described above, electrodes for generating the electric field to compress the colorants in the ink and electrodes for ejecting the ink with the compressed colorants are the same, so that it is impossible to control the compression of the colorants and the ejection of the ink separately, and it has been necessary to make a delicate adjustment of the ink flow rate and the applied voltage in order to compress the colorants to a high concentration and to eject the ink with the compressed colorants.

Furthermore, in a case of forming the multi-nozzle head such as the line scanning printing head, there is a need to prevent an electric field interference between adjacent electrodes by lowering the applied voltage, but if the voltage required for ejecting the colorants is reduced by shortening the distance between the printing head and the recording medium, the electric field for compressing the colorants inside the nozzle would also be reduced. As a result, although the voltage required for compressing the colorants is normally lower than the voltage required for ejecting the ink, this relationship can be reversed when the voltage required for ejecting the ink is reduced, such that there arises a problem that it becomes impossible to eject the ink with the compressed colorants. In addition, when the printing head and the recording medium are set close, it becomes easier to cause fogging and therefore it becomes difficult to realize a stable image dot formation.

Also, the conventional ink jet printing heads as shown in FIGS. 1 and 2 have the following drawback. Namely, in these conventional ink jet printing heads, a pressure is applied to the widely spread ink supplied over the head substrate from a backward direction of the ink flow by means of a pressuring mechanism such as a pump for pressuring concentratedly from a relatively narrow region. Consequently, due to the friction between the ink and a narrow ink flow passage wall, the ink flow becomes inhomogeneous depending on locations and the concentration of the colorants to be ejected to the recording medium also becomes inhomogeneous, so as to cause the irregularity in the recorded concentration. In addition, the irregularity in the recorded concentration due to a difference in the colorant supply can also be caused by a difference in the colorant utilization frequency among the dots on the recording medium.

Moreover, a nozzle having a slit shaped opening without a wall for partitioning each dot is associated with a problem that it is easier to cause the leakage of the ink in a case of receiving a physical impact, compared with a scheme using nozzles separated in correspondence to dots, Furthermore, in the ink jet printing head of FIG. 1, the ink with about several % of colorant components is usually used, so that there is a need to supply the solvent as much as about 20 to 100 times an amount of the colorants even in a case of the all mark recording corresponding to the continuously black image, and for more practical printing rate, i.e., about 5% for a rate of black area, it is necessary to supply the solvent as much as about 2000 times an amount of the colorants. Consequently, the ink utilization efficiency is low compared with the usual ink jet printing scheme for ejecting the ink itself, and there is a need to provide a mechanism for collecting the ink.

In addition, when the ink is repeatedly used in circulation in order to utilize the collected ink efficiently, the ink passing through an uncovered region at a head tip end leaves ink stains to cause a change or deterioration in characteristics of the head, so that there rises problems regarding a durability of the material used or the head and a need for the maintenance of the head.

SUMMARY OF THE INVENTION

It is therefore an object of the present invention to provide an ink jet printing apparatus using a scheme for printing by compressing colorants in the ink by means of an electrostatic force and ejecting the colorants to a recording medium, which is capable of realizing a stable printing by effectively preventing an electric discharge at electrodes for applying the electrostatic force to the colorants.

It is another object of the present invention to provide an ink jet printing apparatus with superior ease of manufacturing, uniformity of the operation characteristic, and level of printing quality, by enabling the ejection of the colorants in the ink with an initial velocity component in a direction perpendicular to a head substrate surface, while preventing an electric discharge at electrodes for applying the electrostatic force to the colorants.

It is another object of the present invention to provide an ink jet printing apparatus capable of separately controlling the compression of the colorants in the ink and the ejection of the colorants to the recording medium.

It is another object of the present invention to provide an ink jet printing apparatus capable of printing in uniform concentration, and preventing the ink leakage from the head due to a physical impact on the head.

It is another object of the present invention to provide an ink jet printing apparatus capable of at least reducing an amount of ink to be collected after passing through the head, and possibly even effectively eliminating any need to collect the ink at all.

According to one aspect of the present invention there is provided an ink jet printing apparatus, comprising: a head substrate; an electrode array formed on a surface of the head substrate; ink supply means for supplying ink in which colorants are distributed in a solvent, over the electrode array on the surface of the head substrate; voltage application means for applying voltages to the electrode array to produce an electric field for exerting an electrostatic force on the colorants in the ink supplied over the electrode array by the ink supply means such that the colorants are compressed and ejected toward a recording medium.

According to another aspect of the present invention there is provided an ink jet printing apparatus, comprising: compression means for compressing colorants distributed in a solvent of an ink; and ejection means, separately provided from the compression means, for ejecting the colorants compressed by the compression means toward a recording medium.

According to another aspect of the present invention there is provided an ink jet printing apparatus, comprising: a head substrate having an electrode array formed on a surface of the head substrate over which ink having colorants distributed in a solvent is supplied; voltage application means for applying voltages to the electrode array to produce an electric field for exerting an electrostatic force on the colorants in the ink supplied over the electrode array such that the colorants are compressed and ejected from a colorant ejection point on the electrode array toward a recording medium; an auxiliary substrate provided over the head substrate defining an ink supply passage through which the ink is supplied over the electrode array; and colorant convey means, provided on a surface of the auxiliary substrate facing toward the electrode array, for conveying colorants in the ink through the ink supply passage toward the colorant ejection point on the electrode array.

Other features and advantages of the present invention will become apparent from the following description taken in conjunction with the accompanying drawings.

DETAILED DESCRIPTION OF THE PREFERRED EMBODIMENTS

Figure 3:
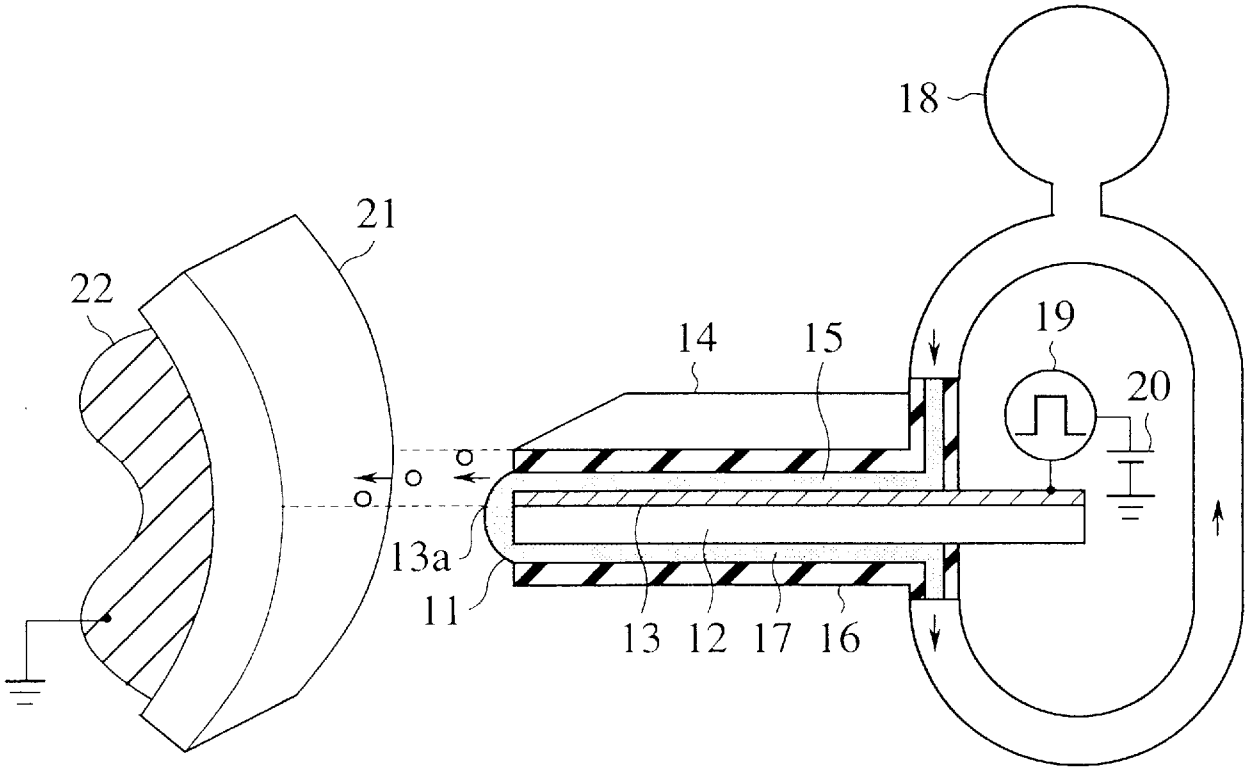
FIG. 3 is a schematic diagram of an ink jet printing apparatus in the first embodiment according to the present invention.

Referring now to FIG. 3, the first embodiment of an ink jet printing apparatus according to the present invention will be described in detail.

FIG. 3 shows a schematic configuration of the ink jet printing apparatus in this first embodiment. Here, an ink 11 is formed by a solvent with over $10^{-8}$ ωcm of insulativeness in which positively charged colorants are colloidally distributed and floating along with charge control agents and binders. This ink 11 is supplied by means of a positive pressure applied from an ink circulation mechanism 18, through an ink supply passage 15 formed between a head substrate 12 and an upper cover 14 provided above the head substrate 12 by means of spacers with about 300 μm thickness. On the head substrate 12, individual electrodes 13 corresponding to recording dots and constituting a stripe shaped electrode array are mounted such that the ink 11 flows over the individual electrodes 13 along the ink supply passage 15 toward a colorant ejection point 13*a* at a tip end of each electrode 13.

The ink 11 which reached to the colorant ejection point 13*a* passes through a portion at which the individual electrode 13 and the upper cover 14 are ending to a tip end edge portion of the head substrate 12 and flows around to a back side of the head substrate 12. Then, the ink 11 flows through an ink collection passage 17 formed between a back side of the head substrate 12 and a lower cover 16 provided below the head substrate 12 by means of spacers similarly as the ink supply passage 15, and then the ink 11 is collected into the ink circulation mechanism 18 by means of a negative pressure, i.e., a suction force, applied by the ink circulation mechanism 18. The ink circulation mechanism 18 comprises a pump and pipes connected with the ink supply passage 15 and the ink collection passage 17, such that the ink 11 is circulated through the ink supply passage 15 and the ink collection passage 17 by means of the operation of the pump.

Here, a bias voltage of DC 1.5 kV, for example, is constantly applied from a bias voltage source 20 to each individual electrode 13, and at a time of printing, a pulsed voltage of 500 V for an ON state, for example, is superposed thereon as a signal voltage by a driving circuit 19 at selected individual electrodes 13 according to an image signal. On the other hand, a facing electrode 22 provided behind a recording medium 21 (such as a recording paper) located at a prescribed distance away from the colorant ejection point 13*a* is set at the ground voltage, i.e., 0 V. Now, when the individual electrode 13 is set in an ON state (a state in which 500 V of the signal voltage is applied) such that a total voltage of 2 kV due to the bias DC voltage of 1.5 kV and the signal voltage of 500 V is applied, the colorants compressed in the ink 11 are ejected from the colorant ejection point 13*a* of that electrode 13, attracted through the air toward the facing electrode 22 which also functions as a platen behind the recording medium 21, and impinged upon the recording medium 21.

Figure 1:
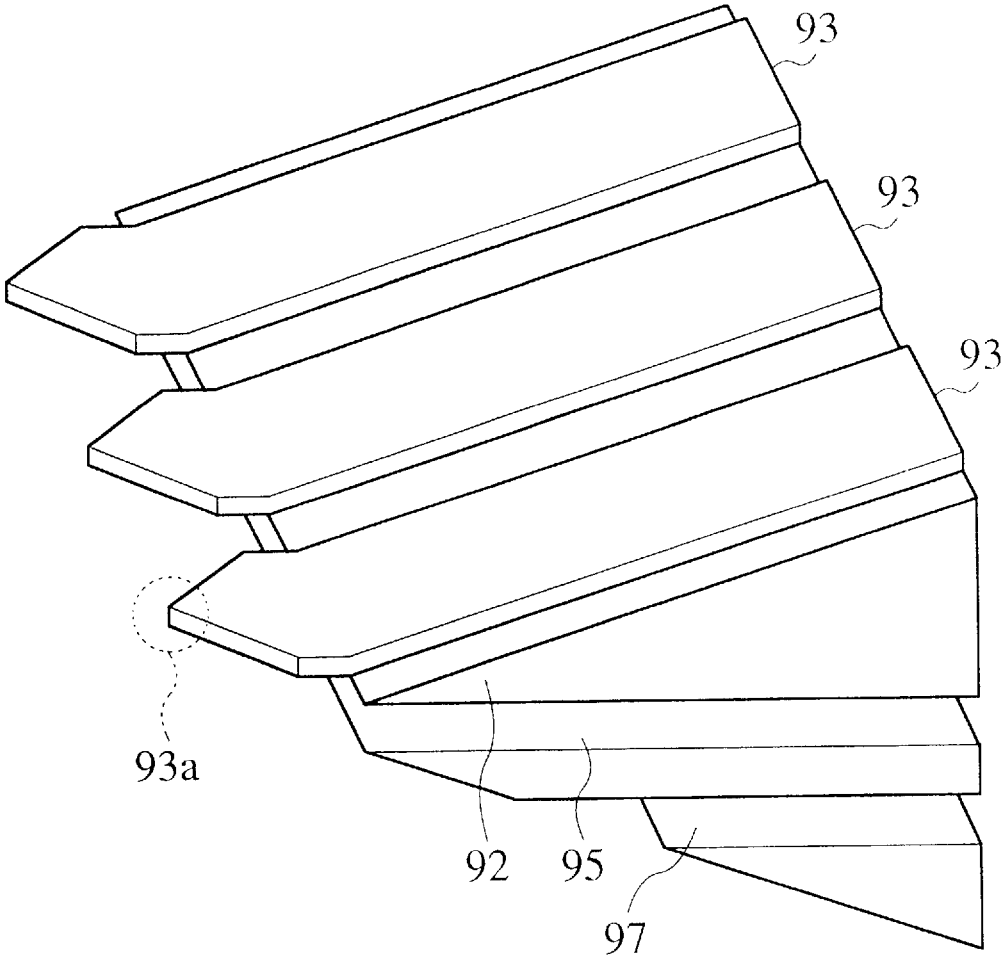
FIG. 1 PRIOR ART
FIG. 1 is an illustration of a tip end portion of a printing head section in one type of a conventional ink jet printing apparatus.
Figure 2:
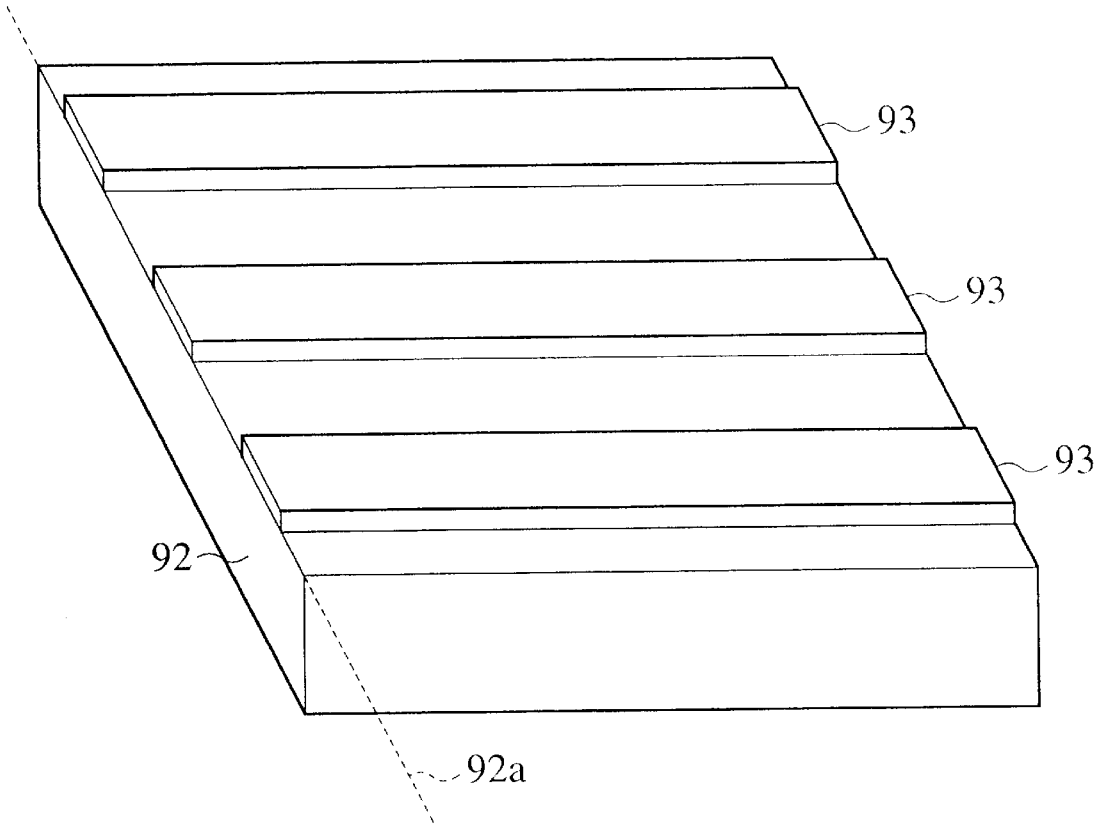
FIG. 2 PRIOR ART
FIG. 2 is an illustration of a tip end portion of a printing head section in another type of a conventional ink jet printing apparatus.

This first embodiment of the ink jet printing apparatus is characterized by the fact that the individual electrodes 13 are not at all exposed to the air as the ink 11 covers the tip ends of the individual electrodes 13. Namely, in the conventional configuration as shown in FIG. 1 in which the electrodes are exposed to the air, the tip ends of the electrodes are damaged by the electric discharge in the air when the similar voltages are applied to the electrodes, but in the configuration of FIG. 3, such an electric discharge in the air can be prevented.

Here, it is to be noted that the colorants in the ink 11 may be charged negatively if desired, In such a case, it suffices to reverse the polarity of all the voltages applied to the electrodes.

Thus, according to this first embodiment, the ink is supplied at least over the individual electrodes on the head substrate such that the electrodes are covered by the ink and not exposed to the air while the intense electric field is applied for the printing purpose, so that the damaging of the electrode tip end due to the intense electric discharge in the air that can be caused easily in the conventional ink jet printing apparatus can be prevented by using the ink with the solvent made of a material capable of preventing the electric discharge, and therefore it becomes possible to realize the stable printing. In addition, it is possible to obtain the stable strong electric field required for ejecting the colorants in the ink without causing the electric discharge, so that the colorants can be ejected in forms of small drops, and therefore it becomes possible to realize the ink jet printing apparatus using a slit shaped nozzle and an electrostatic force which is suitable for the line scanning printing.

Figure 4:
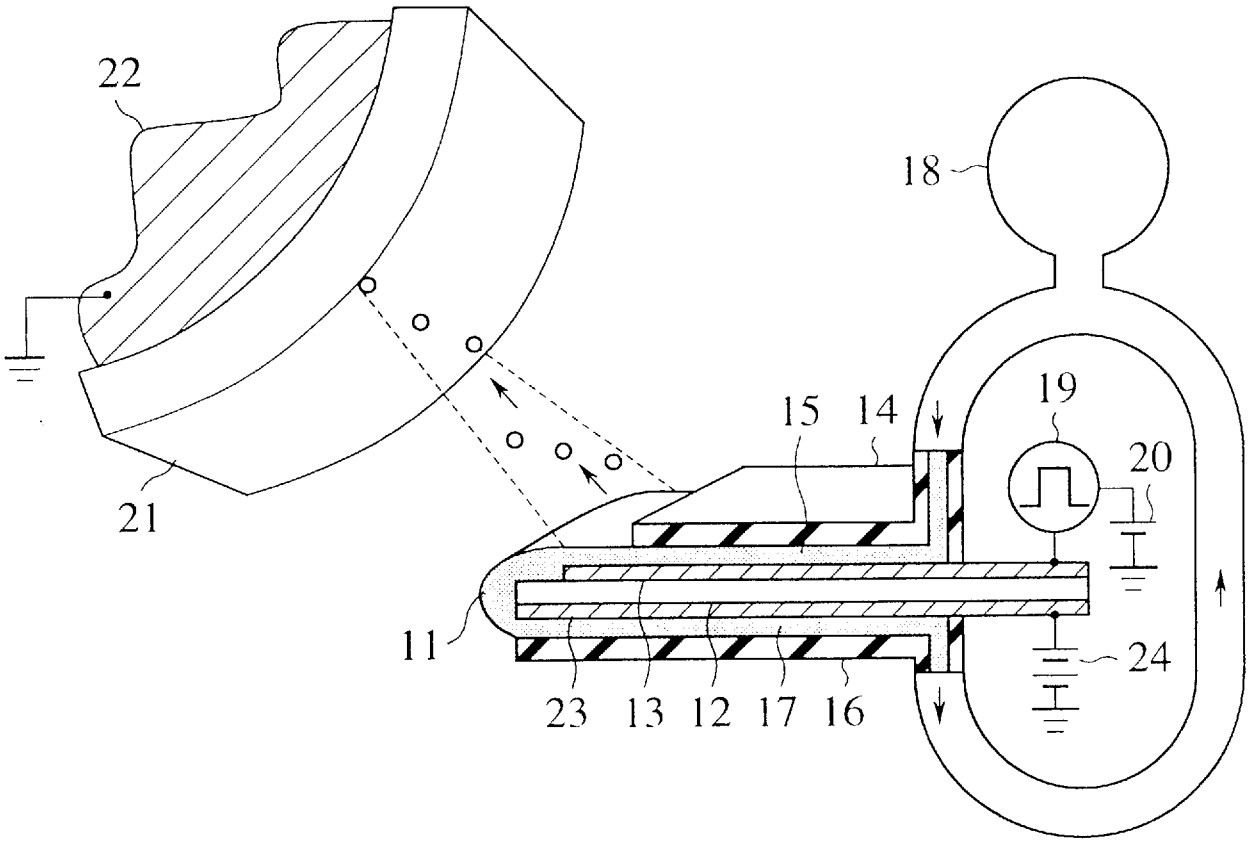
FIG. 4 is a schematic diagram of an ink jet printing apparatus in the second embodiment according to the present invention.

Referring now to FIG. 4, the second embodiment of an ink jet printing apparatus according to the present invention will be described in detail.

FIG. 4 shows a schematic configuration of the ink jet printing apparatus in this second embodiment, where the elements common to the first embodiment of FIG. 3 are given the same reference numerals in the figure and their detailed explanation will not be repeated in the following.

This second embodiment differs from the first embodiment described above in that a tip end portion of the upper cover 14 is terminated at a position retreated from a tip end portion of the head substrate 12, looking from the recording medium 21 side, such that an opening region not covered by the upper cover 14 is provided on the individual electrodes 13. Then, the ink 11 flows through this opening region over the individual electrodes 13 as a layer with about 50 μm thickness flowing toward the colorant ejection point at a tip end of each electrode 13. Thereafter the flow of the ink 11 is substantially similar as in the first embodiment described above. Namely, the ink 11 passes through a portion at which the individual electrode 13 is ending to a tip end edge portion of the head substrate 12, flows around to the back side of the head substrate 12, and then flows through the ink collection passage 17 formed between the back side of the head substrate 12 and the lower cover 16. Then the ink 11 is collected into the ink circulation mechanism 18.

In this second embodiment, the opening region without the upper cover 14 is formed at the tip end side of the printing head section, so that the colorants compressed in the ink 11 and ejected from the colorant ejection points of the individual electrodes 13 in response to the application of the bias voltage and the signal voltage to the individual electrodes 13 will be ejected with initial velocity components in a direction perpendicular to the surface of the head substrate 12. For this reason, in this second embodiment, the recording medium 21 and the facing electrode 22 are provided obliquely above the printing head section, at an angle leaning toward the printing head section as shown in FIG. 4.

Also, in this second embodiment, in addition to the individual electrodes 13 formed on an upper surface of the head substrate 12, a common electrode 23 is formed on a lower surface of the head substrate 12. This common electrode 23 is for generating the electrostatic repulsive force against the colorants from the back side of the head substrate 12, and applied with a bias voltage of DC 2.0 kV, for example, by a bias voltage source 24, in correspondence to a total voltage to be applied to the individual electrodes 13.

With this configuration of FIG. 4, the side shooting type ink jet printing apparatus can be realized in this second embodiment.

Figure 5:
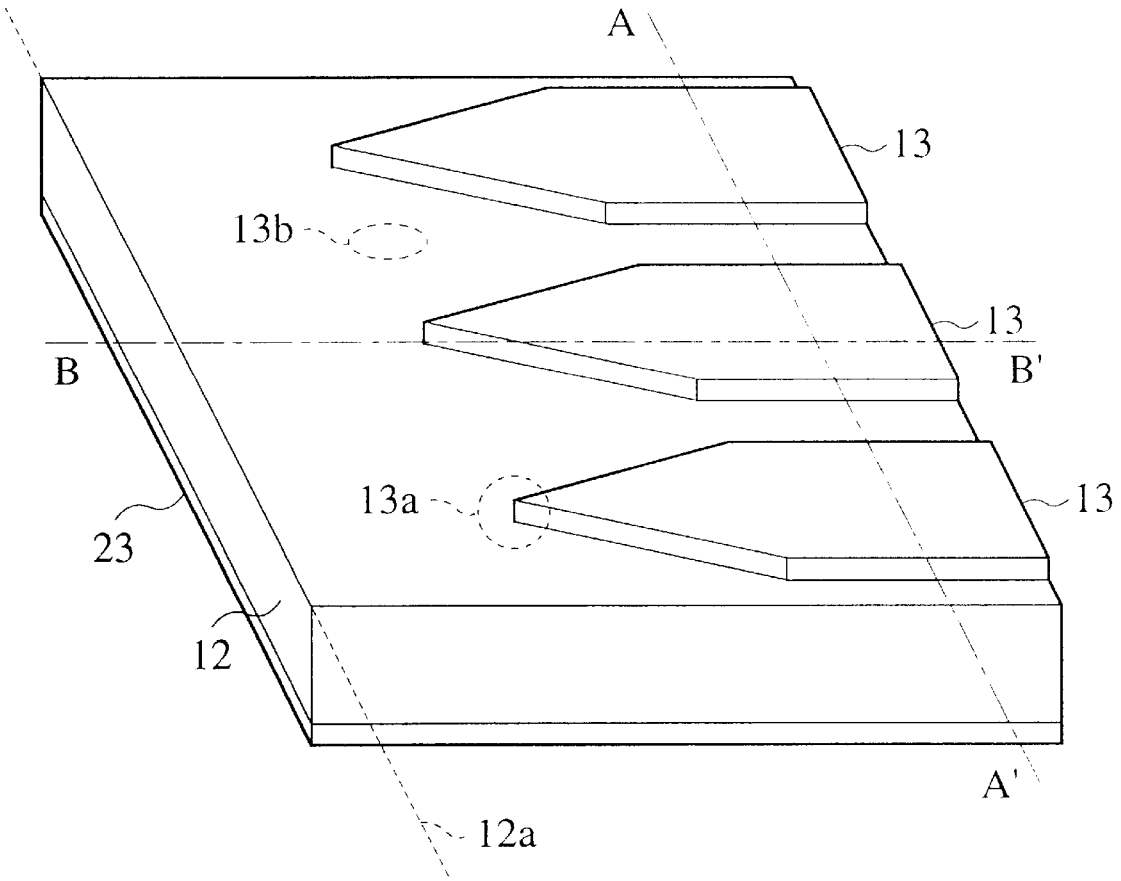
FIG. 5 is an illustration of a tip end portion of a printing head section in the ink jet printing apparatus of FIG. 4.

In further detail, the printing head section in this second embodiment has a configuration as shown in FIG. 5. The head substrate 12 is made of a glass as it is a material with a low dielectric constant and it is easy to obtain a smooth and flat surface. The thickness of the head substrate 12 is set to about 0.5 to 1.0 mm. On an upper surface of of the head substrate 12, an array of the individual electrodes 13 corresponding to the individual recording dot positions is formed, and on a lower surface of the head substrate 12, the common electrode 23 is formed over an entire surface. In FIG. 5, only three individual electrodes 13 are depicted, but in the actual printing head, the individual electrodes for about 4800 elements are to be linearly arranged in an exemplary case of a line scanning head with a size of an A4 paper length at the resolution level of 400 dpi.

Figure 6:
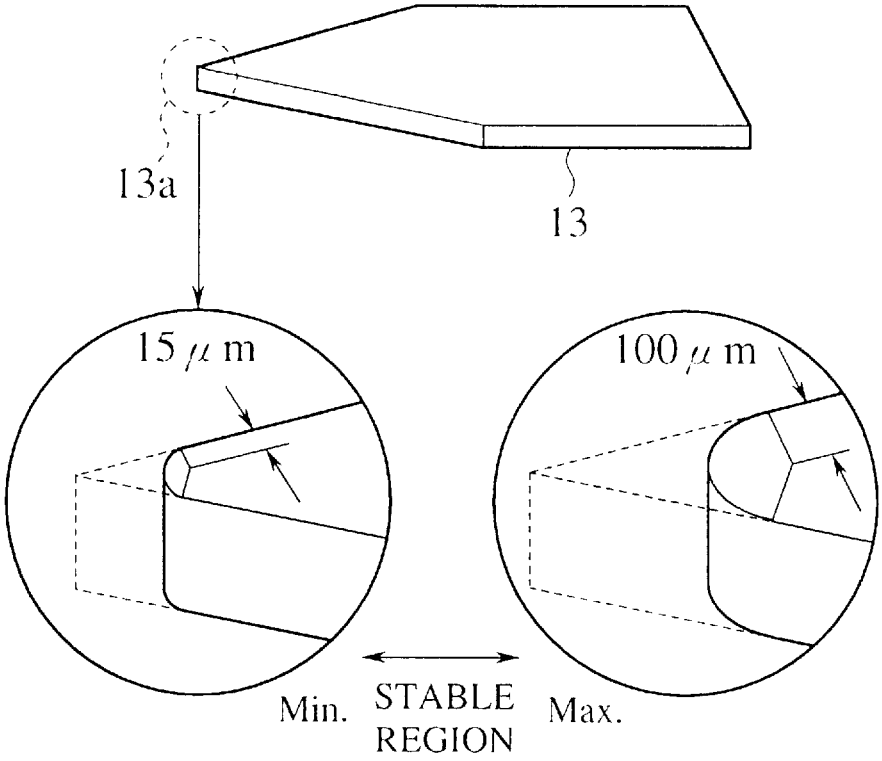
FIG. 6 is an enlarged illustration of a tip end portion of an individual electrode used in the ink jet printing apparatus of FIG. 4.

The important feature of this printing head of FIG. 5 is a direction of the electric field at the colorant ejection point 13*a* realized by a tip end portion of each individual electrode 13 which has a circular edge with a small radius as shown in FIG. 6 in order to generate a strong electric field. To set the maximum electric field vector at this colorant ejection point 13*a* into a direction pointing away from the surface of the head substrate 12 toward outside, an appropriate bias voltage such as 2 kV, for example, is applied to the common electrode 23 on the back side of the head substrate 12. Here, it should be noted that the bias voltage to be applied to the common electrode 23 is not necessarily limited to 2 kV and can be any value in a range of 1.0 to 2.7 kV. Also, as indicated in FIG. 6, a radius of a circular edge at the tip end portion of each individual electrode 13 is not necessarily limited to a specific value and can be any value in a range of 15 to 100 μm.

Now, the operation in this printing head of FIG. 5 will be described.

Figure 7A:
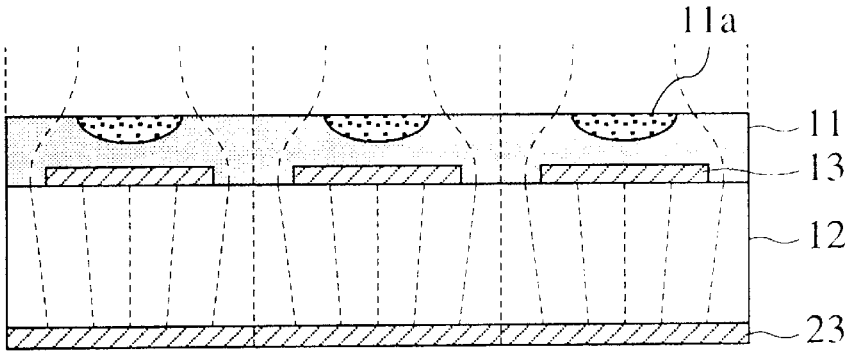
FIGS. 7A, 7B, and 7C are cross sectional views of the tip end portion of the printing head section shown in FIG. 5 for explaining the operation in the ink jet printing apparatus of FIG. 4.

FIG. 7A shows a cross sectional view along a line A—A' in FIG. 5 to indicate the strength of the electric field at the printing head section in terms of the density of lines of electric force, in a state in which no signal voltage is applied. In this state, the bias voltages of DC 1.5 kV and DC 2.0 kV are applied to the individual electrode 13 and the common electrode 23, respectively, so that the electric field due to the common electrode 23 is leaking from an area between arrayed individual electrodes 13. By means of this leaking electric field, a force for pushing the positively changed colorants 11*a* in the ink 11 toward the surface of the individual electrode 13 will be applied. In a scheme using a common ink passage not partitioned for each dot, there is a possibility for the arrayed electrodes to have the electric fields in variety of combinations, so that there is a possibility for the colorants to move away from the electrodes depending on the electric fields, but in this second embodiment, by utilizing the leaking electric field from an array of the stripe shaped individual electrodes 13, it is possible to prevent the colorants from moving away in this manner. Namely, the leaking electric field effectively functions as a partition wall of an ink passage for an individual nozzle.

Figure 7B:
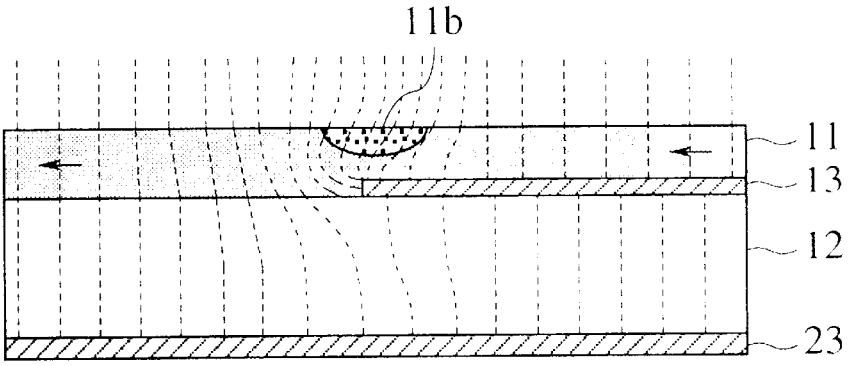

FIG. 7B shows a cross sectional view along a line B—B' in FIG. 5 in the same state in which no signal voltage is applied. As shown in FIG. 7B, when the flow of the ink 11 passes through the colorant ejection point, a force for interrupting the flow is exerted only on the positively charged colorants lib by the electric field from the back side of the head substrate 12 such that the ink with a relatively higher concentration is held at this portion. If this interrupting force is set excessively strong, there appears an adverse effect that only colorants are precipitated and dried to cause the clogging of the ink flow, so that it is preferable to release the leaking electric field periodically by lowering the applied voltage of the common electrode 23 in a prescribed printing period.

Figure 7C:
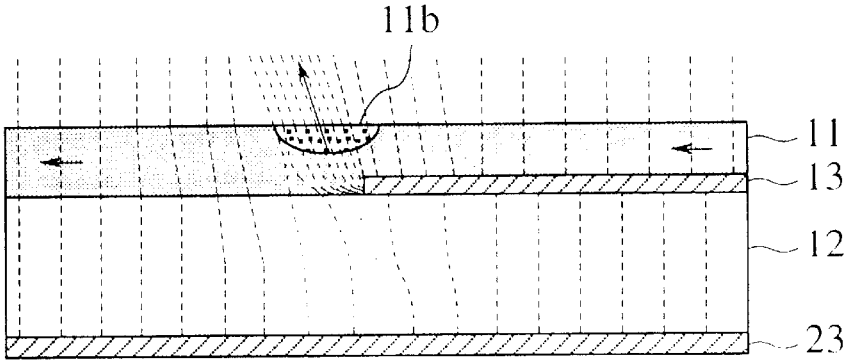

FIG. 7C shows a cross sectional view along a line B—B' in FIG. 5 in a state in which the signal voltage is applied. As shown in FIG. 7C, when the pulsed voltage of 500 V is applied as the signal voltage, a very strong electric field is generated at the colorant ejection point at a tip end of the individual electrode 13. As a result, the colorants 11*b* that had been interrupted by the potential wall located at a portion slightly ahead of the colorant ejection point receive the repulsive force from this strong electric field and are ejected in a direction of the maximum electric field vector, i.e., a direction obliquely forward with respect to the surface of the head substrate 12 from the tip end of the electrode 13.

Figure 8A:
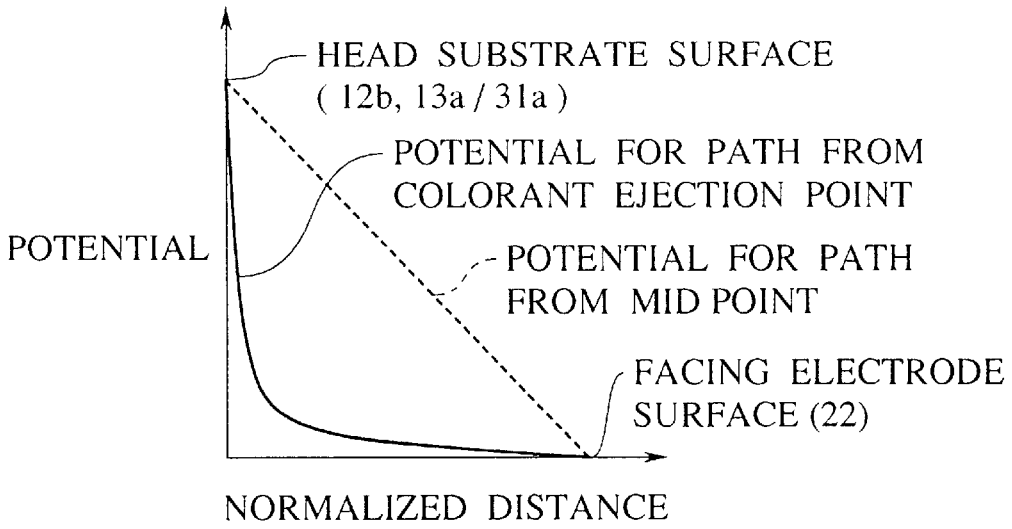
FIGS. 8A and 8B are graphs of a potential and an electric field as functions of a distance for the tip end portion of the printing head section shown in FIG. 5.
Figure 8B:
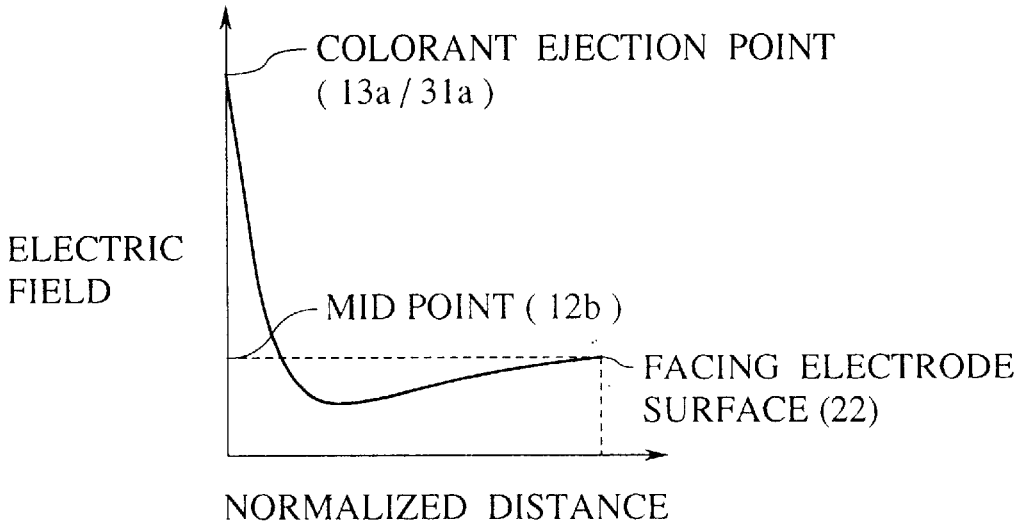

FIGS. 8A and 8B respectively show the potential and the electric field along the line of electric force reaching to the facing electrode 22, starting from two points of the colorant ejection point 13*a* and a mid point 13*b* between adjacent colorant ejection points on the head substrate 12 as shown in FIG. 5, as a function of a distance normalized by the total path length.

As can be seen in FIGS. 8A and 8B, the electric field strength representing a slope of the potential spreads three dimensionally from the colorant ejection point 13*a*, so that it rapidly decreases in counter proportion to a square of a distance.

On the other hand, for a path from a location distanced from the colorant ejection point such as a mid point, there is no sharp edged electrode tip end portion, so that the electric field strength is not so intense and it is substantially constant toward the facing electrode 22 and it becomes the same as the electric field strength for a path from the other point at the facing electrode 22. Consequently, after passing the strong electric field region, the colorants are going to travel through the trough shaped potential distribution with a series of local minima of the potential along the colorant travelling path, so that it is possible to stabilize the travelling direction of the colorants.

It is to be noted that, in a case a tip end of the individual electrode 13 on a surface of the head substrate 12 has a sharply pointed shape as in the colorant ejection point 13*a*, it is possible to form the trough shaped electric field as described above, not only in a case in which a high voltage above the applied voltage of the individual electrode 13 is applied to the common electrode 23 on a back side of the head substrate 12, but also in a case in which a somewhat lower voltage is applied to the common electrode 23.

As described, by giving an initial velocity in a direction away from a surface of the head substrate to the ejected colorants, it is possible to set the colorant ejection point at a position retreated inward from the edge of the head substrate 12. As a result, it is possible to resolve the conventional problems regarding the ease of manufacturing and the uniformity of the operation characteristic. Namely, without the patterning of the substrate edge portion which was required in a case of ejecting the colorants in a direction extending the substrate surface from the edge portion of the head substrate 12, it becomes possible to manufacture the printing head section by using only the patterning on the substrate surface which can be done at higher precision and reliability.

It is noted here that, in order to realize a multi-head configuration for the ink jet printing scheme in which the printing is made by compressing and ejecting the colorants in the liquid ink by means of the electrostatic force, there has only been a proposition for the edge shooter type printing head so far mainly because of the following reasons: (1) even when an electrode with a sharp tip end is formed within a substrate plane by means of the print wiring technique, a direction in which the generated electric field strength is the strongest is in the same plane as the pattern formed plane or in a direction extending from that, so that the strong electric field comes out only at the edge portion at which the substrate is cut out; and (2) when the substrate on which the electrode array is formed and another substrate to be paired with that substrate are piled up in parallel with spacers inserted therebetween, it is possible to form an ink flow passage having a slit shaped opening at the edge portion of the substrate easily, and in addition it is possible to form the edge portion at which a portion for generating the strongest electric field coincides with the colorant ejection point.

However, if the electric field as strong as that at the electrode tip end in the edge shooter type printing head can be generated toward a direction perpendicular to the head substrate surface, it becomes possible to eject the colorants from a plane portion retreated from the edge of the head substrate toward the substrate surface, and the patterning at the edge portion becomes unnecessary, so that it becomes possible to manufacture the ink jet printing head using the electrostatic force at high reliability and precision by using the usual planar manufacturing process such as the photolithography used in manufacturing the IC. Consequently, it becomes possible to realize the side shooting type ink jet printing apparatus for the ink jet printing scheme utilizing the electrostatic force.

According to this second embodiment, the colorants ejected toward the recording medium are given an initial velocity component in a direction perpendicular to the surface of the head substrate, and the head substrate is positioned relative to the recording medium such that the colorant receiving points are positioned above the plane extending from the surface of the head substrate and an angle between that place extending from the surface of the head substrate and a plane tangent to the recording medium at the colorant receiving points becomes less than or equal to 90°. Thus, by retreating the colorant ejection point inward on the head substrate plane and pointing the colorant ejection direction toward the upper side of the head substrate surface, it becomes possible to realize the side shooting type ink jet printing apparatus for the ink jet printing scheme utilizing the electrostatic force, and the ease of manufacturing, the uniformity and the stability of the operation characteristic, and the improvement of the printing quality can be achieved.

In particular, in this second embodiment, using a configuration for generating the strong electric field component in a direction perpendicular to the plane of the substrate surface by means of the shape of the electrode tip end located at the colorant ejection point or the electrodes surrounding the colorant ejection point, it is possible to realize the ejection of the colorants in the ink while giving the initial velocity component in the perpendicular direction.

More specifically, by arranging the common electrode over an entire back side surface of the head substrate which has the electrode array formed by the individual electrodes on its front surface, and applying the bias voltage to this common electrode, it becomes possible to generate the strong electric field pointing to a direction perpendicular to the substrate surface. Although the direction of the strongest electric field generated at the individual electrode tip end on the substrate surface is in a horizontal direction, by adding the electric field in the vertical direction from the common electrode on the substrate back side, it is bent toward a direction pointing outside from the substrate, and it is possible to generate the strongest electric field vector having a vertical component.

In addition, by positioning the head substrate relative to the recording medium such that the colorant receiving points are positioned above the plane extending from the surface of the head substrate and an angle between that place extending from the surface of the head substrate and a plane tangent to the recording medium at the colorant receiving points becomes less than or equal to 90°, it is possible to receive the ejected colorants having a velocity component in the vertical direction stably.

The phenomenon that the compressed colorants that were colloidally distributed and floating in the liquid link can be ejected into the air while leaving the solvent behind, on which the ink jet printing scheme utilized in the present invention is based, has not been utilized very much industrially in the past and not much research results on it have been published so far, so that there are some aspects which are not yet fully clear theoretically. However, the present inventors have conducted a number of experiments and confirmed the following facts concerning this phenomenon.

First, in order to give a velocity vector component in a vertical direction to the ejected colorants, a range of the voltage to be applied to the common electrode to be provided on a lower surface of the head substrate or the second electrode to be provided on an upper surface of the head substrate has been ascertained as follows. According to the experiments conducted by the present inventors, normally, 1 to 2 kV of the bias voltage and 100 to 700 V of the pulsed voltage as the signal voltage are applied in superposition to the individual electrodes, and it has been confirmed that the common electrode or the second electrode operates stably in a range from the bias voltage applied to the individual electrodes to a total voltage in which the signal voltage is superposed onto the bias voltage. In other words, it is possible to apply a voltage in a range of 1.0 to 2.7 kV, for example, to the common electrode or the second electrode.

Secondly, regarding the tip end shape of the individual electrode constituting the electrode array, according to the experiments conducted by the present inventors, it has been confirmed that the ejection of the colorants becomes unstable when the tip end of the electrode is too sharp, and becomes stable for a circular tip end with a radius in a range of 15 to 100 $\mu$m. In other words, for the individual electrode constituting the electrode array formed on the substrate surface to which the voltage according to the image signal is to be applied, by shaping its tip end into a circular shape with a radius in a range of 15 to 100 $\mu$m, it is possible to stabilize the ejection of the colorants.

Thus, according to this second embodiment, the strong electric field vector with a perpendicular direction component different from a component in a direction of a plane formed by the head substrate surface is formed, so that the ejected colorants can be given an initial velocity having some angle with respect to the substrate plane. Therefore, it becomes possible to eject the colorants from a position retreated from the edge of the substrate, or more generally it becomes possible to eject the colorants from any interior position within the substrate plane, so that the side shooting type ink jet printing head which does not use the edge portion can be realized. Consequently, it becomes possible to realize the practical line scanning type ink jet printing head by using only the planar patterning process for which the manufacturing process reliability is high and by which the uniform operation characteristic can be obtained.

In addition, it is possible to use a structure for generating the electric field which repulses the colorants at a gap in the wiring pattern of the individual electrodes. In this case, it is possible achieve various effects including that the colorants can be efficiently compressed while the ink is flowing, that the colorants can be stored at the colorant ejection point, and that the ejection direction can be stabilized by forming the trough shaped potential with a series of local minima of the potential along a spatial travelling path of the ejected colorants.

Figure 9:
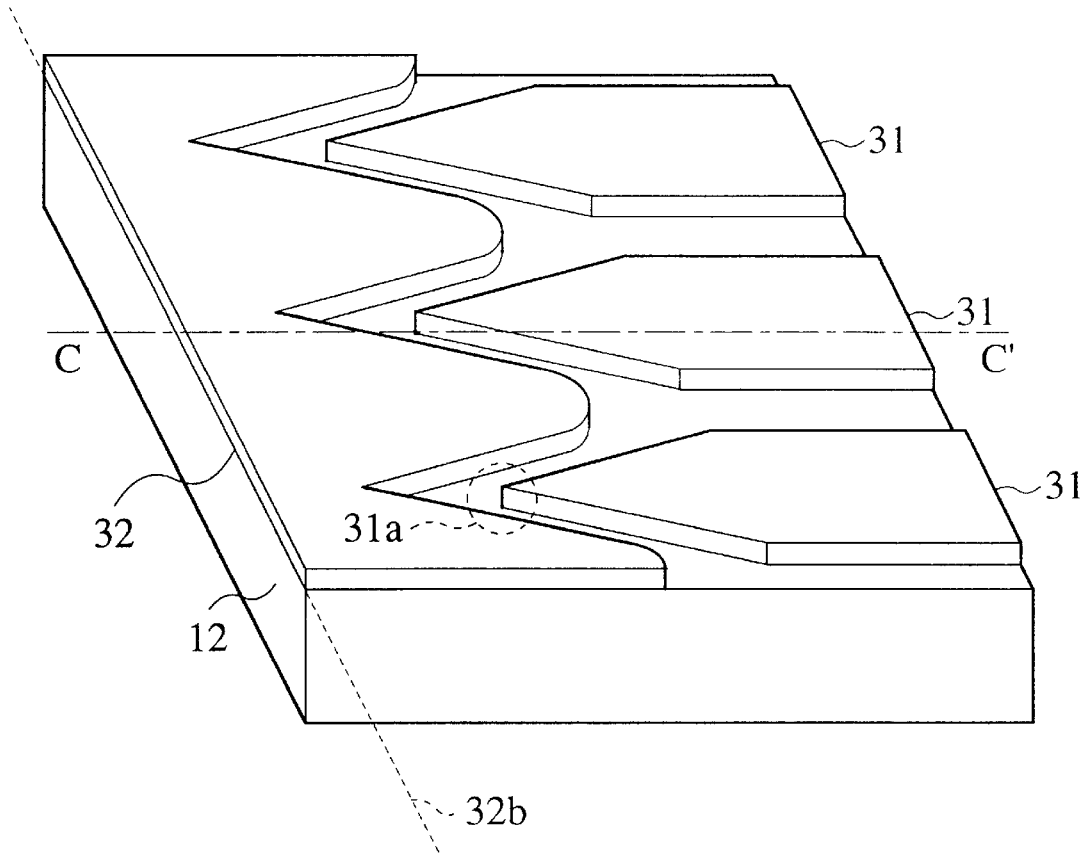
FIG. 9 is an illustration of a tip end portion of a printing head section in the third embodiment of an ink jet printing apparatus according to the present invention.

Referring now to FIG. 9, the third embodiment of an ink jet printing apparatus according to the present invention will be described in detail.

FIG. 9 shows a schematic configuration of a printing head section of the ink jet printing apparatus in this third embodiment, which differs from that of FIG. 5 for the second embodiment described above in an arrangement and shapes of the electrodes on the head substrate 12. Namely, in the second embodiment, the individual electrodes 13 are arranged on an upper surface of the head substrate 12 while the common electrode 23 is arranged on a lower surface of the head substrate 12, but in this third embodiment the first electrodes (individual electrodes) 31 and a second electrode (common electrode) 32 are formed on an upper surface of the head substrate 12. Here, both the first electrodes 31 and the second electrode are saw tooth shaped, and arranged in a form of being engaged with each other without making a contact with each other. Each tip end portion of the second electrode 32 has a circular shape with a larger radius, compared with the colorant ejection point 31*a* at a tip end portion of each first electrode 31 at which the strongest electric field is generated, such that the colorant will not be ejected from the tip end portions of the second electrode 32.

In this third embodiment, just as in the second embodiment described above, the important feature of this printing head of FIG. 9 is a direction of the electric field at the colorant ejection point 31*a* realized by a tip end portion of each first electrode 31. To set the maximum electric field vector at this colorant ejection point 31*a* into a direction pointing away from the surface of the head substrate 12 toward outside, an appropriate bias voltage such as 2 kV, for example, is applied to the second electrode 32 on the back side of the head substrate 12. Namely, the first electrodes 31 function as individual electrodes corresponding to the recording dots just like the individual electrodes 13 of the second embodiment, so that to the first electrodes 31, the bias voltage of DC 1.5 kV, for example, is constantly applied, and at a time of the ON state, the pulsed voltage of 500 V, for example, is superposed as a signal voltage according to the image signal. On the other hand, the second electrode 32 functions as a common electrode shared by all the recording dots just like the common electrode 23 of the second embodiment, so that to the second electrode 32, the bias voltage of 2.0 kV equal to a total voltage applied to the first electrodes 31 is applied.

Now, the operation in this printing head of FIG. 9 will be described.

Figure 10A:
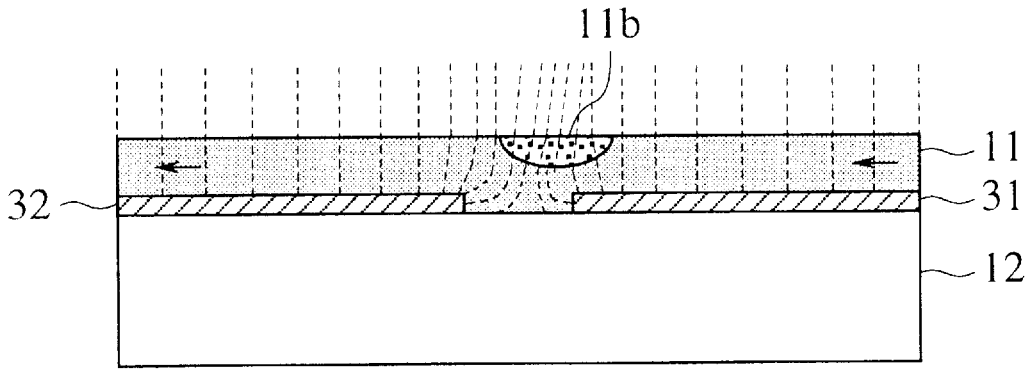
FIGS. 10A and 10B are cross sectional views of the tip end portion of the printing head section shown in FIG. 9 for explaining the operation in the ink jet printing apparatus of the third embodiment.
Figure 10B:
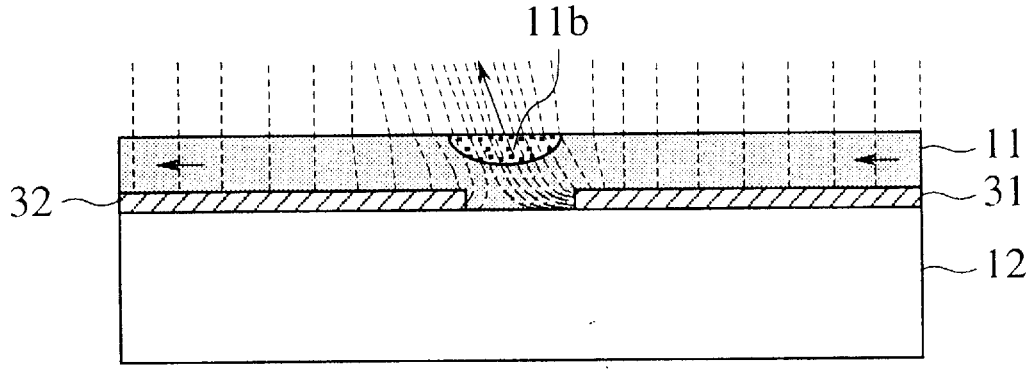

FIG. 10B shows a cross sectional view along a line C—C' in FIG. 9 in a state in which no signal voltage is applied. As shown in FIG. 10B, when the flow of the ink 11 passes through the colorant ejection point, a force for interrupting the flow is exerted only on the positively charged colorants 11*b* by the electric field from the second electrode 32 such that the ink with a relatively higher concentration is held at this portion. If this interrupting force is set excessively strong, there appears an adverse effect that only colorants are precipitated and dried to cause the clogging of the ink flow, so that it is preferable to release the leaking electric field periodically by lowering the applied voltage of the second electrode 32 in a prescribed printing period, just as in the second embodiment described above.

FIG. 10B shows a cross sectional view along a line C—C' in FIG. 9 in a state in which the signal voltage is applied. As shown in FIG. 10B, when the pulsed voltage of 500 V is applied as the signal voltage, a very strong electric field is generated at the colorant ejection point at a tip end of the first electrode 31. As a result, the colorants 11*b* that had been interrupted by the potential wall due to the second electrode 32 receive the repulsive force from this strong electric field and are ejected in a direction of the maximum electric field vector, i.e., a direction obliquely forward with respect to the surface of the head substrate 12 from the tip end of the first electrode 31.

With respect to the colorants which had passed the strong electric field region, the electric field generated by the second electrode 32 forms the trough shaped potential distribution with a series of local minima of the potential along the colorant travelling path, so that it is possible to stabilize the travelling direction of the colorants, just as in the second embodiment described above.

As described, by giving an initial velocity in a direction away from a surface of the head substrate to the ejected colorants, it is also possible in this third embodiment to set the colorant ejection point at a position retreated inward from the edge of the head substrate 12. As a result, it is possible to resolve the conventional problems regarding the ease of manufacturing and the uniformity of the operation characteristic. Namely, without the patterning of the substrate edge portion which was required in a case of ejecting the colorants in a direction extending the substrate surface from the edge portion of the head substrate 12, it becomes possible to manufacture the printing head section by using only the patterning on the substrate surface which can be done at higher precision and reliability.

In particular, in this third embodiment, using a configuration for generating the strong electric field component in a direction perpendicular to the plane of the substrate surface by means of the shape of the electrode tip end located at the colorant ejection point or the electrodes surrounding the colorant ejection point, it is possible to realize the ejection of the colorants in the ink while giving the initial velocity component in the perpendicular direction, just as in the second embodiment described above.

More specifically, by arranging the second electrode (which can be either common or individual) in proximity to the tip end portions of the individual electrodes on the head substrate surface, and applying the bias voltage to this second electrode in the same polarity as the voltage applied to the individual electrodes, the lines of electric force are bent in a form of repulsing from each other and the electric field having a perpendicular component is formed. Thus, it becomes possible to generate the strong electric field pointing to a direction perpendicular to the substrate surface, and it is possible to set the strongest electric field vector generated by the individual electrode tip end to be pointing outside from the substrate.

Figure 11:
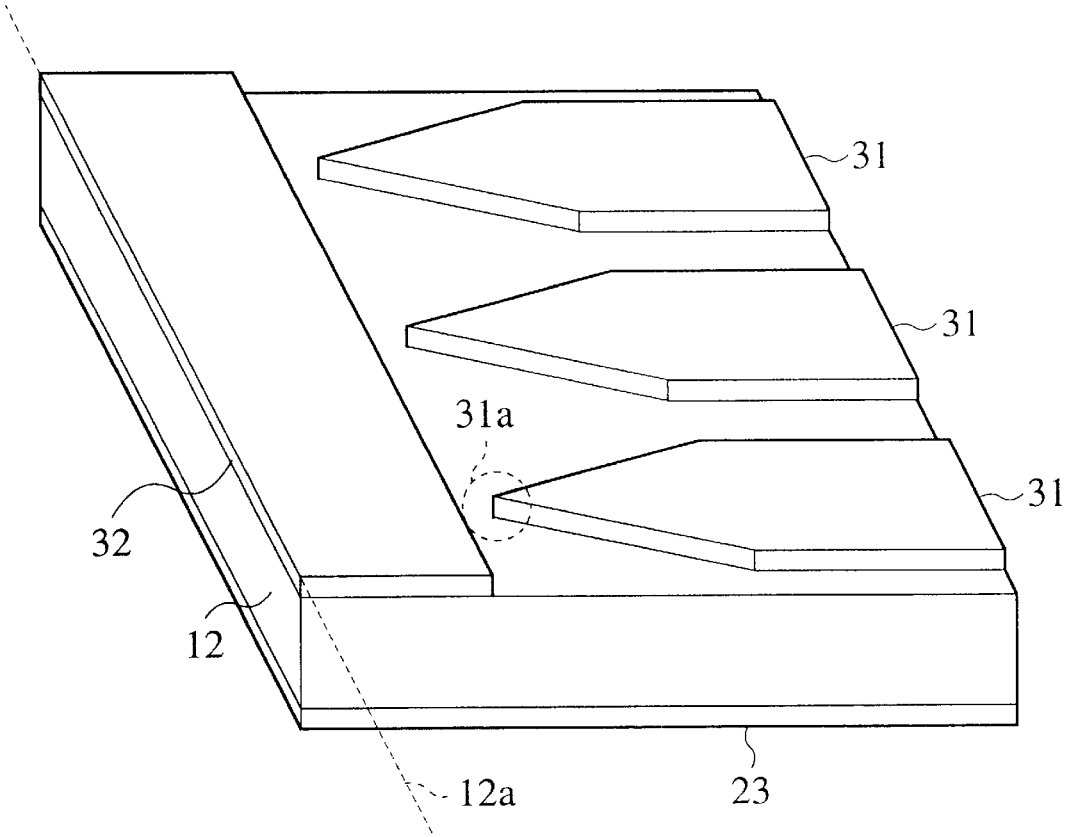
FIG. 11 is an illustration of a tip end portion of a printing head section in the fourth embodiment of an ink jet printing apparatus according to the present invention.

Referring now to FIG. 11, the fourth embodiment of an ink jet printing apparatus according to the present invention will be described in detail.

FIG. 11 shows a schematic configuration of a printing head section of the ink jet printing apparatus in this fourth embodiment, which combines the common electrode 23 on a lower surface of the head substrate 12 as in the second embodiment described above with the first and second electrodes 31 and 32 on an upper surface of the head substrate 12 as in the third embodiment described above. With this configuration of 11, it becomes possible to eliminate an inconvenience otherwise caused by the fact that the dielectric constant of the head substrate 12 is slightly higher than that of the air such that a number of lines of electric force that go around to the back side of the head substrate 12 would be greater. Namely, by raising the potential on the back side of the head substrate 12, it becomes possible to push out the lines of electric force to the upper surface side, such that the reduction of the operation voltage and the improvement of the operation efficiency can be realized.

Also, in the third embodiment described above, the second electrode 32 has been shaped in a form which engages with the first electrodes 31, but as shown in FIG. 11, the second electrode 31 may be shaped in a simple straight bar shape extending in the main scanning direction. This shape is simpler so that the reliability in the manufacturing process can also be improved.

Figure 12:
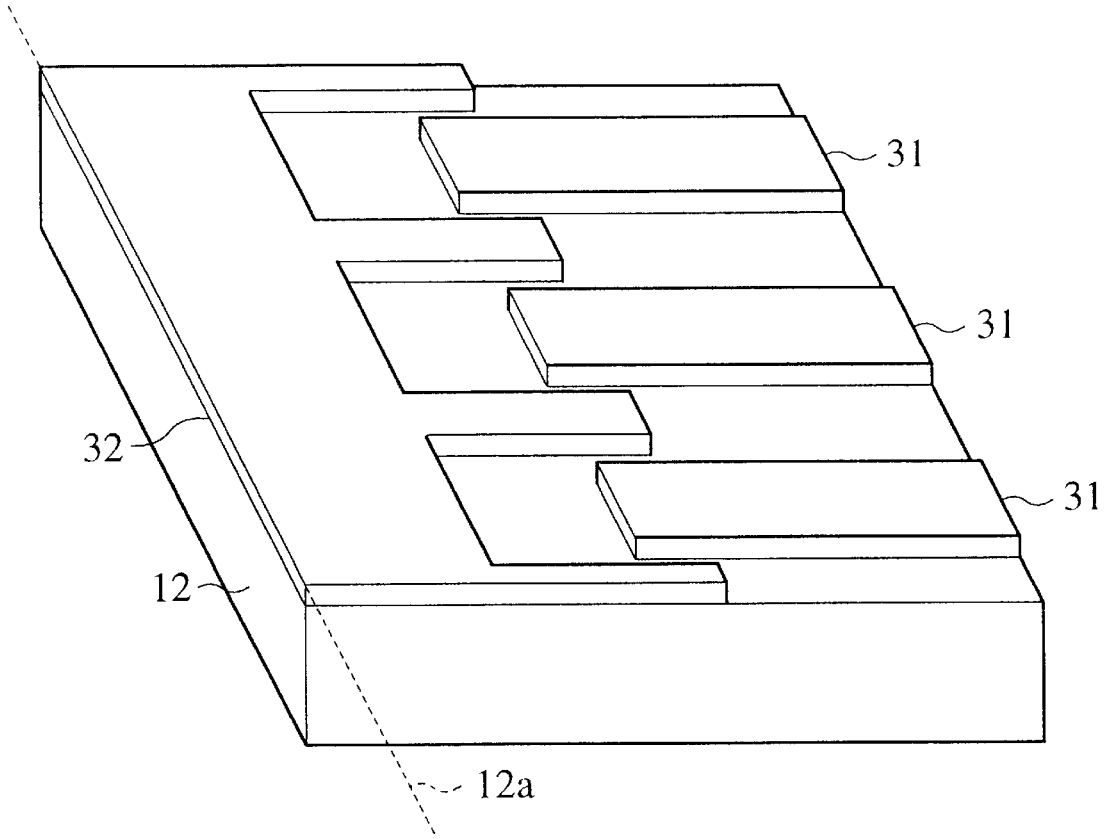
FIG. 12 is an illustration of a tip end portion of a printing head section in the fifth embodiment of an ink jet printing apparatus according to the present invention.

Referring now to FIG. 12, the fifth embodiment of an ink jet printing apparatus according to the present invention will be described in detail.

FIG. 12 shows a schematic configuration of a printing head section of the ink jet printing apparatus in this fifth embodiment, which differs from the third embodiment described above in that the shapes of the tip ends of the first and second electrodes 31 and 32 are modified from the sharp triangular shape for the first electrodes 31 and the obtuse triangular shape for the second electrode 32 used in the third embodiment described above to the rectangular shape for both the first and second electrodes 31 and 32 which are engaged with each other as shown in FIG. 12.

It it also noted here that the various embodiments described above may be further modified as follows. First, the common electrode 23 which has been made to cover the entire lower surface of the head substrate 12 in the second to fourth embodiments may be provided only at an area directly below the colorant ejection point, or may be shaped in separated comb tooth shapes in correspondence to the individual (first) electrodes on the upper surface of the head substrate 12. Also, the roles of the first electrodes 31 as individual electrodes and the second electrode 32 as a common electrode in the third to fifth embodiments may be reversed such that a single common first electrode and a plurality of individual second electrodes are to be provided instead.

Moreover, the ink flow over an upper surface of the head substrate 12 may be realized without using a cover such that the ink directly contacts with the air, or by using a plate covering an upper surface of the head substrate 12 and having a slit shaped window along a direction in which the electrodes are arrayed which is located only above the colorant ejection points. In the latter case, the plate itself can be utilized as the thin and wide ink flow passage, and in such a case, the ink can be applied with a positive pressure before the slit shaped window and a negative pressure after the slit shaped window.

Figure 13:
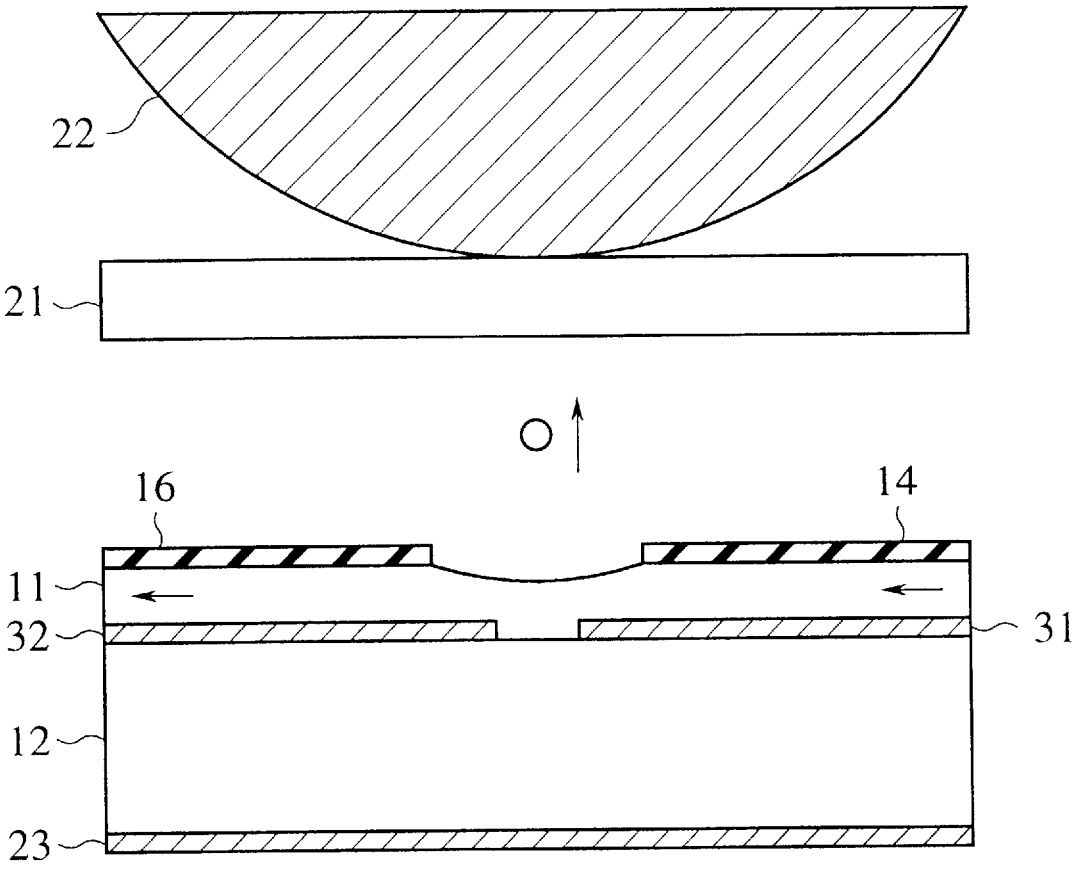
FIG. 13 is a schematic diagram of an ink jet printing apparatus in the sixth embodiment according to the present invention.

Referring now to FIG. 13, the sixth embodiment of an ink jet printing apparatus according to the present invention will be described in detail.

FIG. 13 shows a schematic configuration of the ink jet printing apparatus in this sixth embodiment. Unlike the first to fifth embodiments described above in which the ink supply passage 15 and the ink collection passage 17 are formed on an upper surface and a lower surface of the head substrate 12, respectively, this sixth embodiment of FIG. 13 involves no ink flow around the edge of the head substrate 12, and instead, there is provided an ink flow passage in a single direction over the upper surface of the head substrate 12 from the first electrode 31 side to the second electrode 32 side, to form a planar printing head in which the colorants are ejected into a direction perpendicular to the surface of the head substrate 12 and impinged onto the recording medium 21 provided directly above the printing head section in parallel to the head substrate 12.

In the following, further embodiments for this type of planar printing head will be described.

Figure 14:
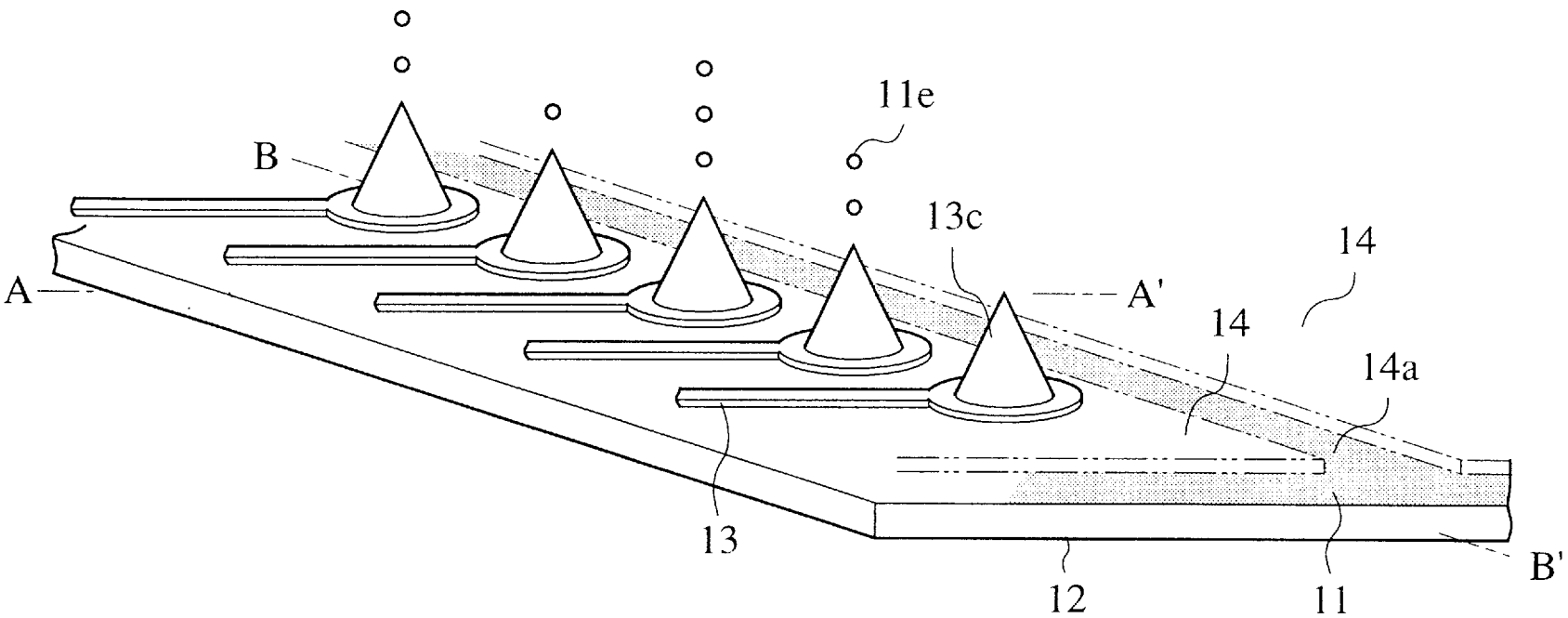
FIG. 14 is an illustration of a part of a printing head section in the seventh embodiment of an ink jet printing apparatus according to the present invention.
Figure 15A:
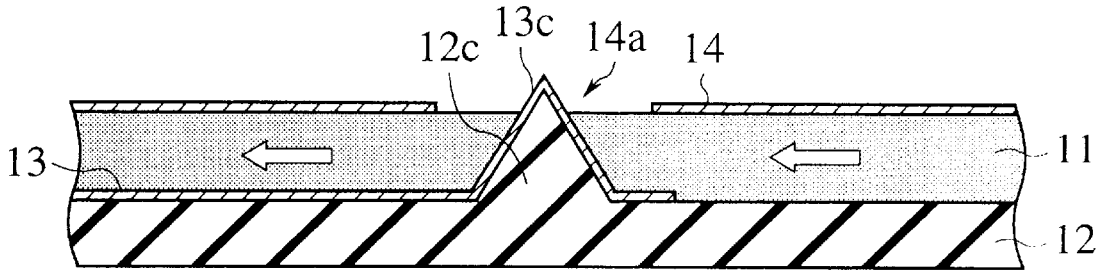
FIGS. 15A and 15B are cross sectional views of the printing head section shown in FIG. 14.
Figure 15B:
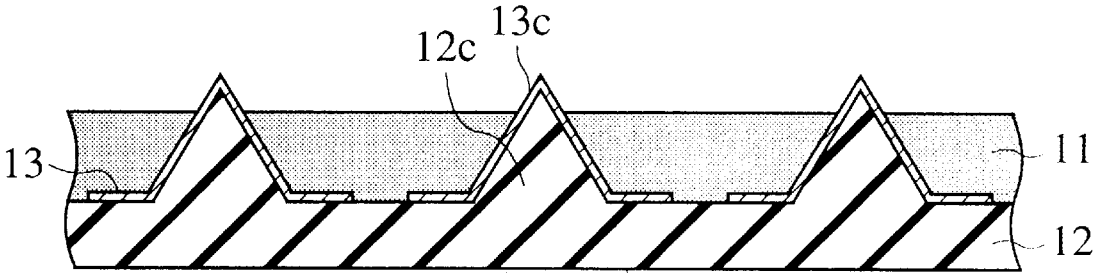
Figure 16:
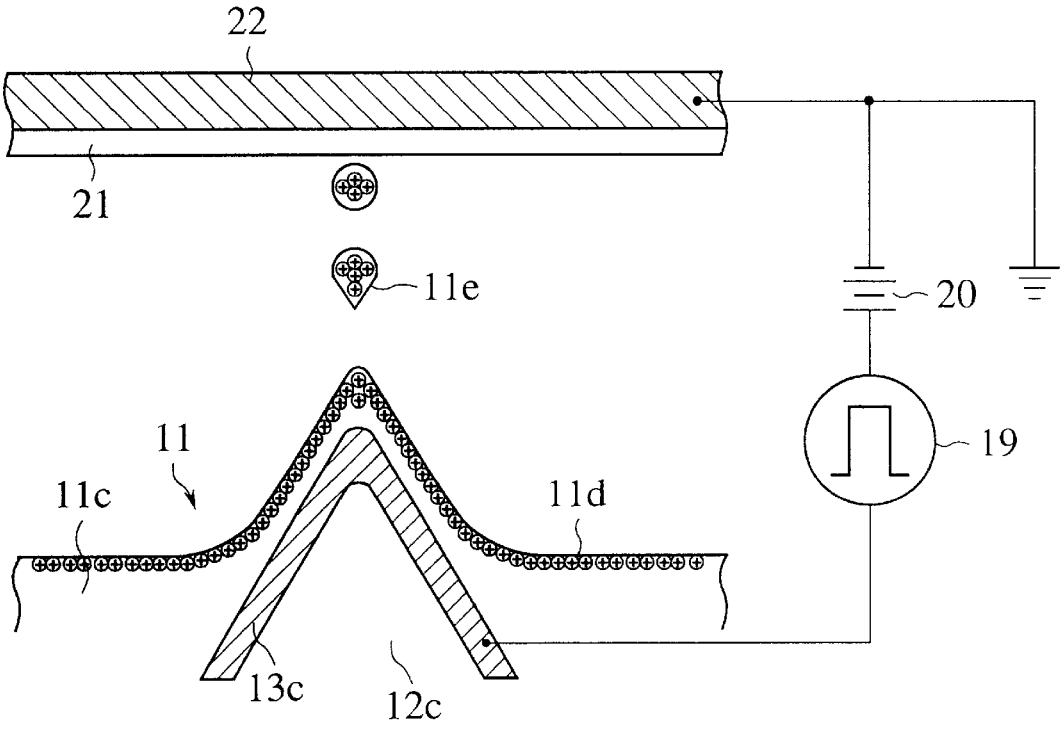
FIG. 16 is a schematic diagram of the ink jet printing apparatus in the seventh embodiment for explaining its operation.

Referring now to FIG. 14 to FIG. 16, the seventh embodiment of an ink jet printing apparatus according to the present invention will be described in detail.

FIG. 14 shows an enlarged perspective view of a part of a printing head section of the ink jet printing apparatus in this seventh embodiment, while FIGS. 15A and 15B show cross sectional views along A—A' line and B—B' line shown in FIG. 14, respectively. In this seventh embodiment, the head substrate 12 has a number of conical projections 12*c* with tapering upper ends formed on an upper surface, and each conical projection 12*c* is covered by a projecting electrode 13*c* made of a conductive material and connected with an individual electrode 13. In other words, the tip end portion of the individual electrode 13 is formed as the projecting electrode 13*c* covering the conical projection 12*c* projecting on the upper surface of the head substrate 12. The individual electrodes 13 are connected to a driving IC (not shown) such that an appropriate driving voltage can be applied to each projecting electrode 13*c*.

In addition, over the head substrate 12, an upper cover 14 having a slit 14*a* is attached in parallel to the upper surface of the head substrate 12 with spacers (not shown) inserted in between. The conical projections 12*c* are located along the slit 14*a* of the upper cover 14 such that the tip ends of the projecting electrodes 13*c* are sticking out from the slit 14*a* of the upper cover 14. The ink 11 is supplied to an ink flow passage formed between the head substrate 12 and the upper cover 14. Thus, the tip ends of the projecting electrodes 13*c* are slightly projecting from a liquid surface of the ink 11.

In this configuration, when the signal voltages according to the image to be printed are applied to the individual electrodes 13, ink drops 11*e* are ejected from the tip ends of the projecting electrodes 13*c* in a direction perpendicular to the upper surface of the head substrate 12, toward a recording medium (not shown) provided above the printing head section, so as to print the image on the recording medium. The ink 11 is flowing in a direction indicated by an arrow in FIG. 15A for example, by means of a pressure difference, a pump, or an electrostatic force, such that the new ink 11 is constantly supplied to this printing head section.

Here, one characteristic feature of the printing head section of this seventh embodiment is that the three dimensional structures in forms of the conical projections 12*c* are formed on the head substrate 12 and the ink drops 11*e* are ejected from the tip ends of these conical projections 12*c*.

Now, with reference to FIG. 16, the printing operation printing head section of FIG. 14 will be described in further detail.

FIG. 16 shows a vicinity of the tip end of one conical projection 12*c* in enlargement. The conical projection 12*c* has a height of about several to 100 μm, and its tip end is projecting from the liquid surface of the ink 11 for about several to several tens μm. However, at the tip end of the conical projection 12*c*, due to the capillary phenomenon, the ink 11 forms a thin layer over the projecting electrode 13*c* such that the surface of the projecting electrode 13*c* is always kept wet. In other words, the ink 11 is supplied in such a manner to cover the projecting electrode 13*c* of the individual electrode 13.

The ink 11 itself is similar to that used in the previous embodiments, in which the colorants 11*d* formed by pigments, etc. are distributed in an insulative solvent 11*c*. Here, as indicated in FIG. 16, it is preferable for the colorants 11*d* to be positively charged. For this ink 11, it is possible to use the usual liquid developing toner used in the electrostatic recording or electrophotographic recording. In the ink jet printing apparatus of this seventh embodiment, the ink 11 with the colorants lid in variety of sizes ranging from sub-micron to several μm can be used.

The individual electrode 13 connected to the projecting electrode 13*c* is applied with a positive DC bias voltage from a bias voltage source 20 with respect to a facing electrode 22 which also functions as a platen (recording drum). This DC bias voltage also has an effect to push the ink 11 on the projecting electrode 13*c* upward in the tip end direction. In addition, by the application of this DC bias voltage, the electric field is formed between the facing electrode 22 and the projecting electrode 13*c* while the recording medium 21 is located on a side the facing electrode 22 facing toward the projecting electrode 13*c*. This electric field also exerts a force to attract the ink 11 toward the tip end direction of the projecting electrode 13*c*. As a result, the surface of the projecting electrode 13*c* is kept constantly wet by the ink 11. By keeping the surface of the projecting electrode 13*c* constantly wet by the ink 11 in this manner, it is possible to carry out the supply of the ink 11 smoothly, eject the ink drops lie stably, and prevent an occurrence of the electric discharge even when a strong electric field is applied between the individual electrode 13 and the facing electrode 22.

Moreover, in this seventh embodiment, the charged colorants 11*d* are used in the ink 11 while the positive DC bias voltage is applied to the projecting electrode 13*c*, so that the colorants 11*d* are gathered and compressed at the surface of the ink 11. Now, the concentration of the colorants in the liquid developing toner is usually several % so that the usual liquid developing toner is too thin to use as the ink for the ink jet printing in general, but due to the above described effect for gathering and compressing the colorants 11*d* alone at the surface of the ink 11 in this seventh embodiment, it is possible to raise the concentration of the colorants 11*d* up to 10 to several tens % at the surface of the ink 11, so that it is possible to use the usual liquid developing toner as the ink 11 in this seventh embodiment.

In addition to the DC bias voltage constantly applied from the bias voltage source 20, the individual electrode 13 is also applied with the pulsed voltage as the signal voltage according to the image signal from a driving circuit 19 in superposition to the DC bias voltage. Then, the colorants 11*d* compressed as a thin ink layer at the tip end portion of the projecting electrode 13*c* are repulsed by the signal voltage applied to the individual voltage 13 and attracted to the facing electrode 22 side, such that the ink drops 11*e* are ejected according to the applied signal voltage.

Here, the DC bias voltage is about 1 kV, and the signal voltage is about several hundred V. These voltages are quite low compared with those required in the conventional ink jet printing for ejecting the ink by means of the electrostatic force. The printing operation can be realized with such low driving voltages in this seventh embodiment because of the use of the ink 11 with the charged colorants 11*d* as described above. Namely, the repulsive force can be caused between the projecting electrode 13*c* and the charged colorants 11*d* so that the ink drops 11*e* can be ejected easily even by the low applied voltages.

In addition, another characteristic feature of the printing head section of this seventh embodiment is that the ink drops 11*e* are ejected from the tip ends of the projecting electrodes 13*c*, so that there is basically no need for providing any nozzle just as in the previous embodiments. Consequently, the problem of the clogging caused by the dried ink can be alleviated considerably, and it is easily possible to realize the line scanning printing head as shown in FIG. 14.

Figure 17:
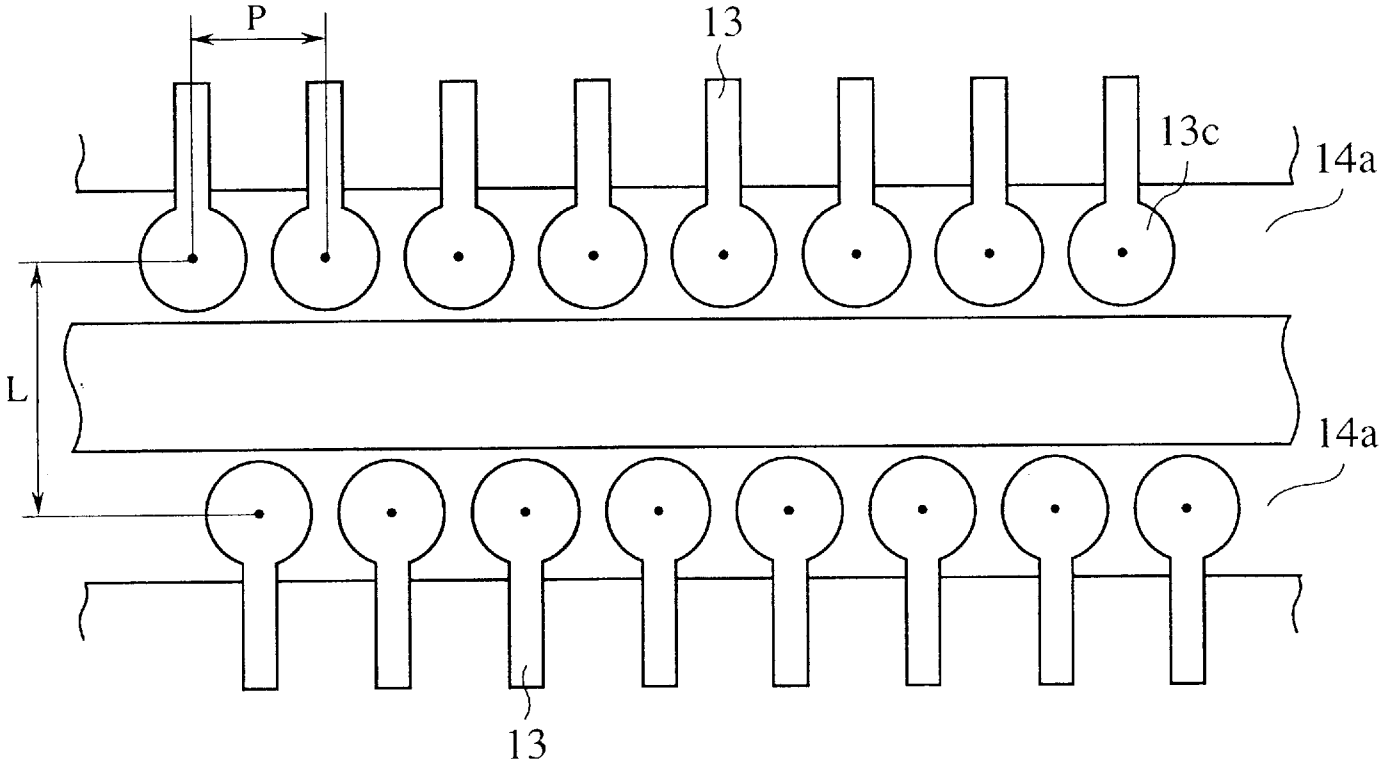
FIG. 17 is a top plan view of one arrangement of individual electrodes for a printing head section in the eighth embodiment of the ink jet printing apparatus according to the present invention.
Figure 18:
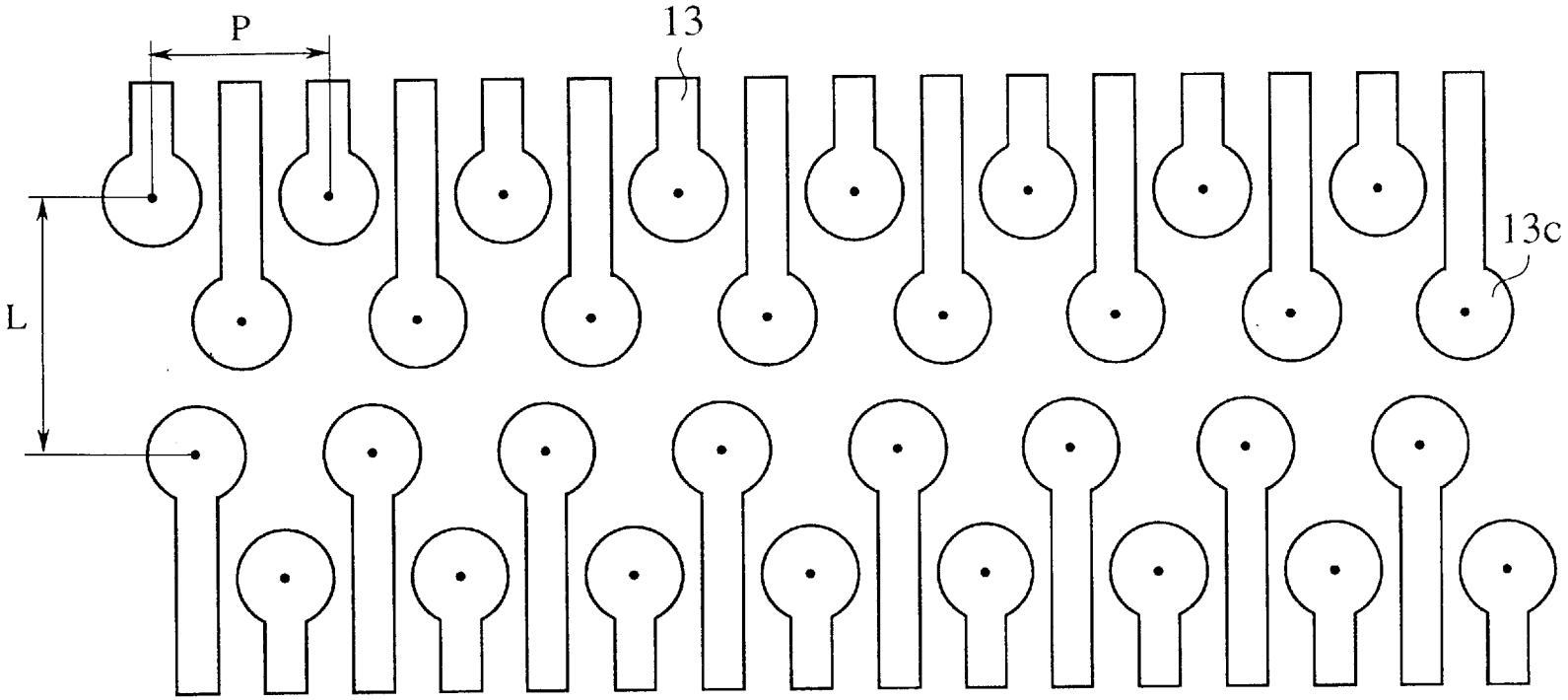
FIG. 18 is a top plan view of another arrangement of individual electrodes for a printing head section in the eighth embodiment of the ink jet printing apparatus according to the present invention.

Referring now to FIG. 17 and FIG. 18, the eighth embodiment of an ink jet printing apparatus according to the present invention will be described in detail.

In the above described seventh embodiment, the ink drops are ejected from the projecting electrode 13*c* covering the conical projections 12*c* on a plane in a direction perpendicular to the head substrate 12, so that it is possible to realize a planar ink ejection mechanism for the printing head section. This planar ink ejection mechanism has an advantage over the conventional ink ejection mechanism provided on an edge of the head substrate in that it becomes easier to manufacture the printing head. Furthermore, according to this eighth embodiment, by forming the planar ink ejection mechanism on a plane of the head substrate 12, it also becomes possible to realize a high resolution head configuration as shown in FIG. 17.

FIG. 17 shows a top plan view of the printing head section from a direction perpendicular to a plane of the head substrate 12. As indicated in FIG. 17, there is a pitch P which defines a closest distance between the adjacent individual electrodes 13. Namely, the bottom face of the projecting electrode 13*c* on the conical projection 12*c* has a certain radius, and there is a need to separate each projecting electrode 13*c* from adjacent projecting electrodes such that the bottom faces of the adjacent projecting electrodes 13*c* do not contact with each other. In addition, if the projecting electrode 13*c* is placed too close to the adjacent projecting electrode, the electric discharge between the adjacent electrodes can be caused when the signal voltage is applied to one of them and not to the other one of them. For these reasons, when the size of the conical projection 12*c* is determined, this determined size imposes a restriction on the pitch P between the adjacent individual electrodes 13, and consequently, it becomes impossible to raise the resolution level beyond that dictated by the pitch P.

However, in the planar ink ejection mechanism of this eighth embodiment, the individual electrodes 13 and the projecting electrodes 13*c* are arranged two dimensionally in two parallel rows with displaced pitches (i.e., in zigzag pattern) as shown in FIG. 17, so that the resolution level higher than that dictated by the pitch P can be realized.

Namely, in a case of arranging the projecting electrodes 13*c* one dimensionally in a single row, it is impossible to realize the resolution level higher than that dictated by the pitch P. In contrast, in this eighth embodiment, the projecting electrodes 13*c* are arranged two dimensionally in two parallel rows with the projecting electrodes 13*c* on one row displaced from the projecting electrodes 13*c* on the other row by ½ pitch (i.e., P/2) in the main scanning direction (i.e., a direction of arrangement of the projecting electrodes 13*c*), such that the resolution level becomes twice as high as that realizable by the single row arrangement. In this case, by setting a distance L between two rows of the projecting electrodes 13*c* to be:

$$L=P*(2*n+1)*(1/2)$$

where n is an integer, it is also possible to raise the resolution level in the sub scanning direction twice as high. Here, however, in a case of arranging the projecting electrodes 13*c* in two rows in this manner, the timings for applying the signal voltages to the electrode rows are to be displaced by a time required for covering (n+1) main scanning lines, so that there arises a need for an operation to delay the signal voltage application to one electrode row.

In this eighth embodiment, even when the projecting electrodes 13*c* can be arranged by the pitch corresponding to the resolution level of 400 dpi, it is possible to realize the high resolution printing with the resolution level of 800 dpi in the main scanning direction as well as in the sub scanning direction.

It is to be noted here that FIG. 17 depicts a case of providing two parallel slits 14*a* in correspondence to two electrode rows, but when a distance between the two electrode rows is not so large, it may also be possible to provide a single slit 14*a* over two electrode rows.

It is also to be noted that, a distance L between two rows of the projecting electrodes 13*c* may be set to be:

$$L=P*m$$

where m is an integer, to realize the same resolution level in the sub scanning direction as that in a single row arrangement. Also, this distance L may be set to be:

$$L=P*m*(1/k)$$

where m and k are integers, to realize the resolution level in the sub scanning direction which is k times higher than that in a single row arrangement.

FIG. 18 shows a further modified projecting electrode arrangement in which the projecting electrodes 13*c* are arranged two dimensionally in four parallel rows with mutually displaced pitches, so as to realize the resolution level in the main scanning direction which is four times higher than that dictated by the pitch P between the adjacent projecting electrodes in each electrode row. In this case, a distance L between the adjacent electrode rows should be set to be:

$$L=P*m*(1/k)$$

where m and k are integers. Here, by setting m to be an odd number and K=4, it is also possible to realize the resolution level in the sub scanning direction which is four times higher as well.

Figure 19:
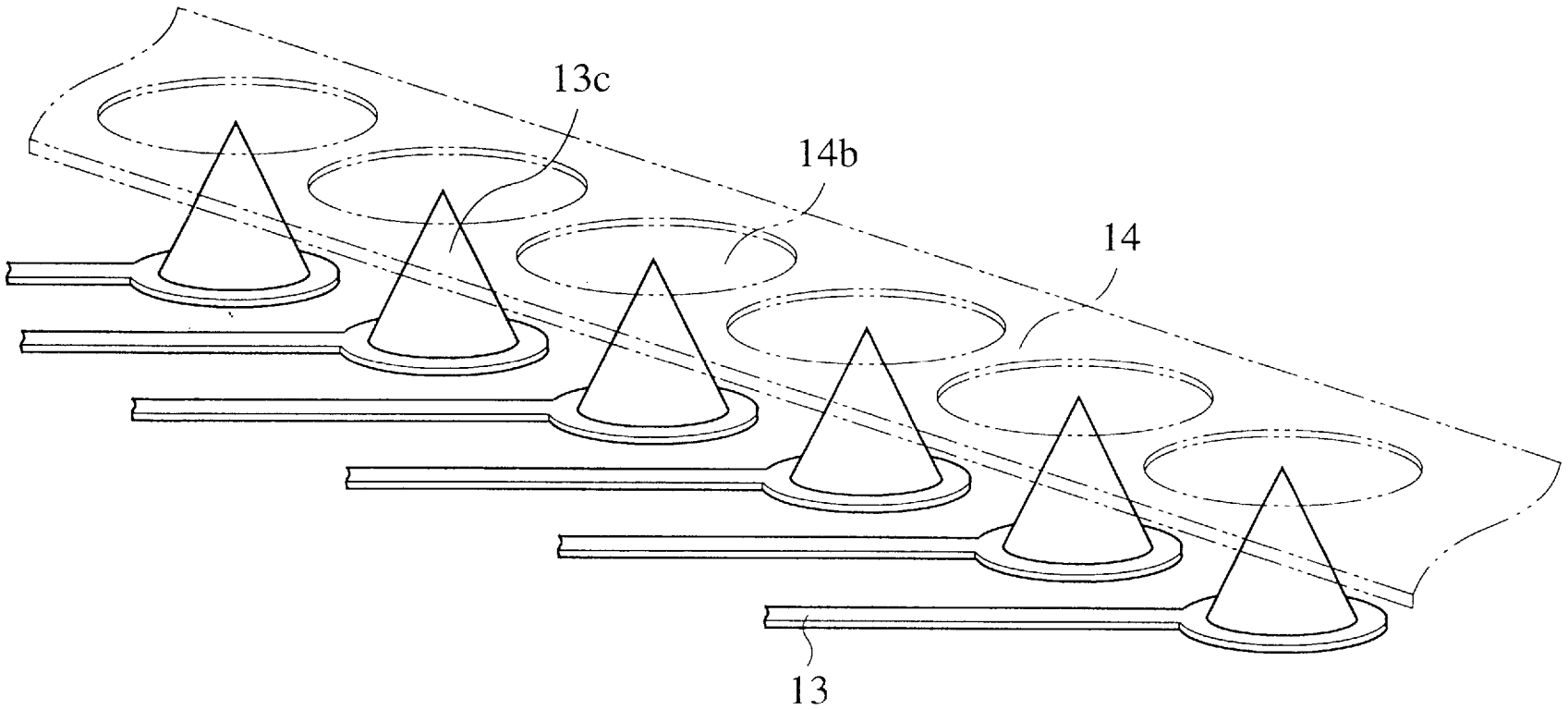
FIG. 19 is an illustration of a part of a printing head section in the ninth embodiment of an ink jet printing apparatus according to the present invention.
Figure 20A:
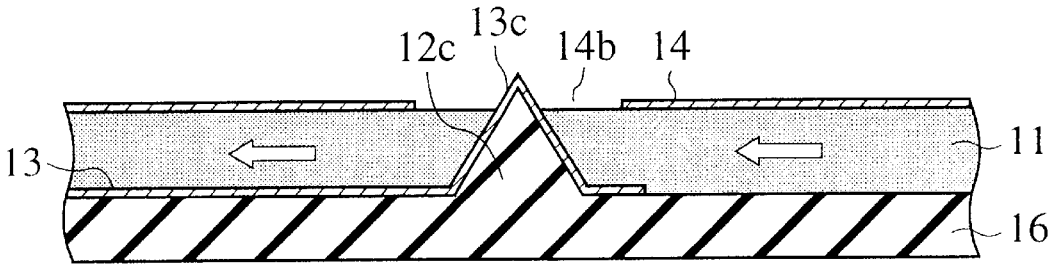
FIGS. 20A and 20B are cross sectional views of the printing head section shown in FIG. 19.
Figure 20B:
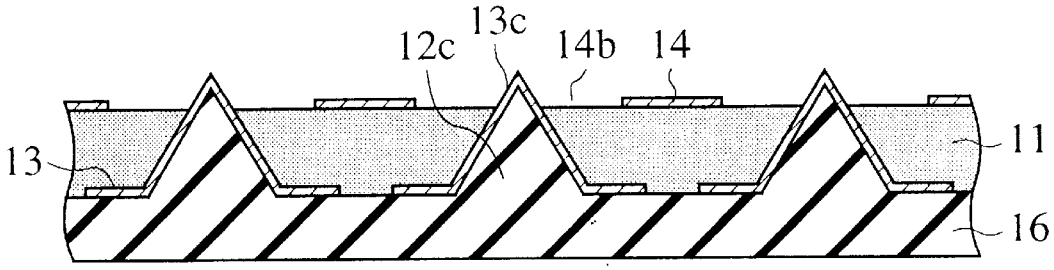

Referring now to FIG. 19 and FIGS. 20A and 20B, the ninth embodiment of an ink jet printing apparatus according to the present invention will be described in detail.

In the above described seventh embodiment, the slit 14*a* is formed on the upper cover 14 along a row of the conical projections 12*c*. In contrast, in this ninth embodiment, a series of holes 14*b* (referred hereafter as ink passing holes) are formed on the upper cover 14 in correspondence to the locations of the conical projections 12*c* as shown in FIG. 19. FIG. 20A shows a cross sectional view along a plane passing through the tip end of one conical projection 12*c* and perpendicular to the electrode row while FIG. 20B shows a cross sectional view along a plane passing through the tip ends of the conical projections 12*c* and parallel to the electrode row in this case.

In this ninth embodiment, it becomes possible to suppress the vibration of the ink liquid surface around each projecting electrode 13*c* by means of the upper cover 14 when the neighboring picture dot is printed. Here, when the diameter of each ink passing hole 14*b* is set small, the ink passing hole 14*b* can also be made to function as a nozzle in the usual ink jet printing. However, in the ink jet printing apparatus of this ninth embodiment, the ink drops are ejected from the tip ends of the projecting electrode 13*c* which is projecting above the upper cover 14, so that the ink passing hole 14*b* would not define a size of the ink drop to be ejected unlike the conventional ink jet nozzle, and therefore it is sufficient for the upper cover 14 to be able to suppress the vibration of the ink liquid surface and there is no need to be capable of enduring a large pressure. Thus, it is sufficient for the ink passing hole 14*b* to have a large diameter compared with the desired resolution level, unlike the conventional ink jet nozzle.

Referring now to FIGS. 21A to 21E and FIGS. 22A to 22B, the tenth embodiment of an ink jet printing apparatus according to the present invention will be described in detail.

Figure 21A:
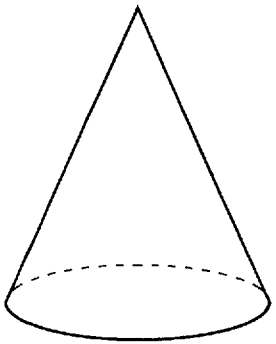
FIGS. 21A to 21E are illustrations of various shapes for a projection that can be used in a printing head section of the tenth embodiment of an ink jet printing apparatus according to the present invention.

In this tenth embodiment, various alternative shapes for the conical projection 12*c* will be described. In the above described seventh to ninth embodiments, the conical projection 12*c* having a literally conical shape as shown in FIG. 21A is used. However, the shape of this conical projection 12*c* can be any other shape which is tapering toward the tip end.

Figure 21B:
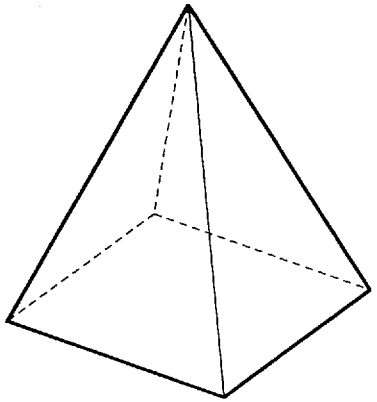
Figure 21C:
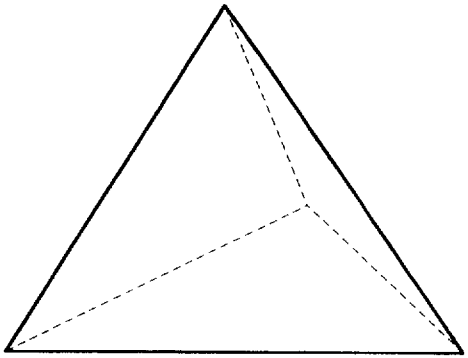
Figure 21D:
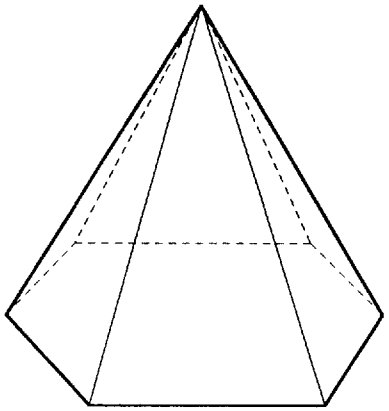
Figure 21E:
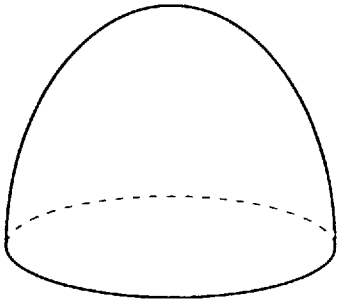

For example, various polyhedral shapes as shown in FIGS. 21B, 21C, and 21D, or a dome shape as shown in FIG. 21E may be used as the projection to be covered by the projecting electrode 13*c* for ejecting the ink drops. The similar effect as in a case of the conical projection 12*c* can be obtained as long as the projection has a shape which is tapering toward the tip end, because it is possible for the projection in such a shape to keep the surface of the projecting electrode 13*c* constantly wet by the ink 11 by means of the capillary phenomenon and the bias voltage applied to the individual electrodes 13, and consequently it is possible to carry out the supply of the ink 11 smoothly, eject the ink drops 11*e* stably, and prevent an occurrence of the electric discharge even when a strong electric field is applied between the individual electrode 13 and the facing electrode 22.

Figure 22A:
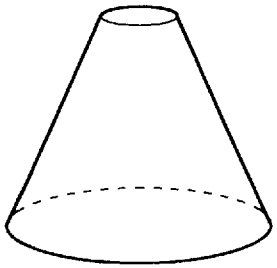
FIGS. 22A to 22E are illustrations of various shapes for a projection that can be used in a printing head section of the tenth embodiment of an ink jet printing apparatus according to the present invention.
Figure 22B:
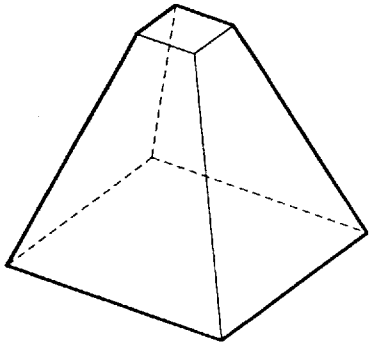
Figure 22C:
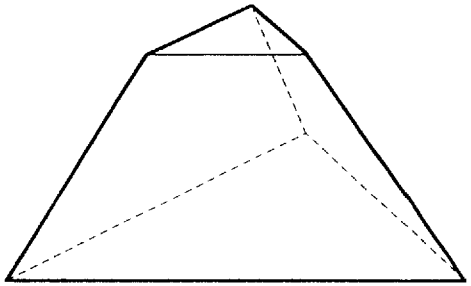
Figure 22D:
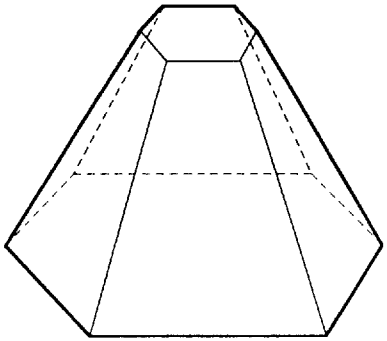
Figure 22E:
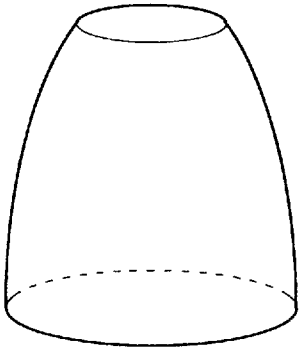

In addition, the projection may not necessarily have a sharply pointed tip end, so that a truncated conical shape as shown in FIG. 22A, various truncated polyhedral shapes as shown in FIGS. 22B, 22C, and 22D, or a truncated dome shape as shown in FIG. 22E may be used as the projection to be covered by the projecting electrode 13*c* for ejecting the ink drops. In a case of the shape having a sharply pointed tip end, an ink drop ejection direction or a size of the ejected ink drop size can be varied among different projections by the slight differences in the formation of the sharply pointed tip ends or varied in time, whereas in a case of the shape having a non-pointing tip end, these problems can be avoided. Also, in actually manufacturing the projections in the shape shown in FIGS. 22A to 22E, the tip end portion may not necessarily be formed in a completely flat shape and may very well be formed in a somewhat rounded shape, depending the manufacturing method, and the projection with the tip end portion formed in a somewhat rounded shape can also be used as the projection to be covered by the projecting electrode 13*c* for ejecting the ink drops.

Figure 23:
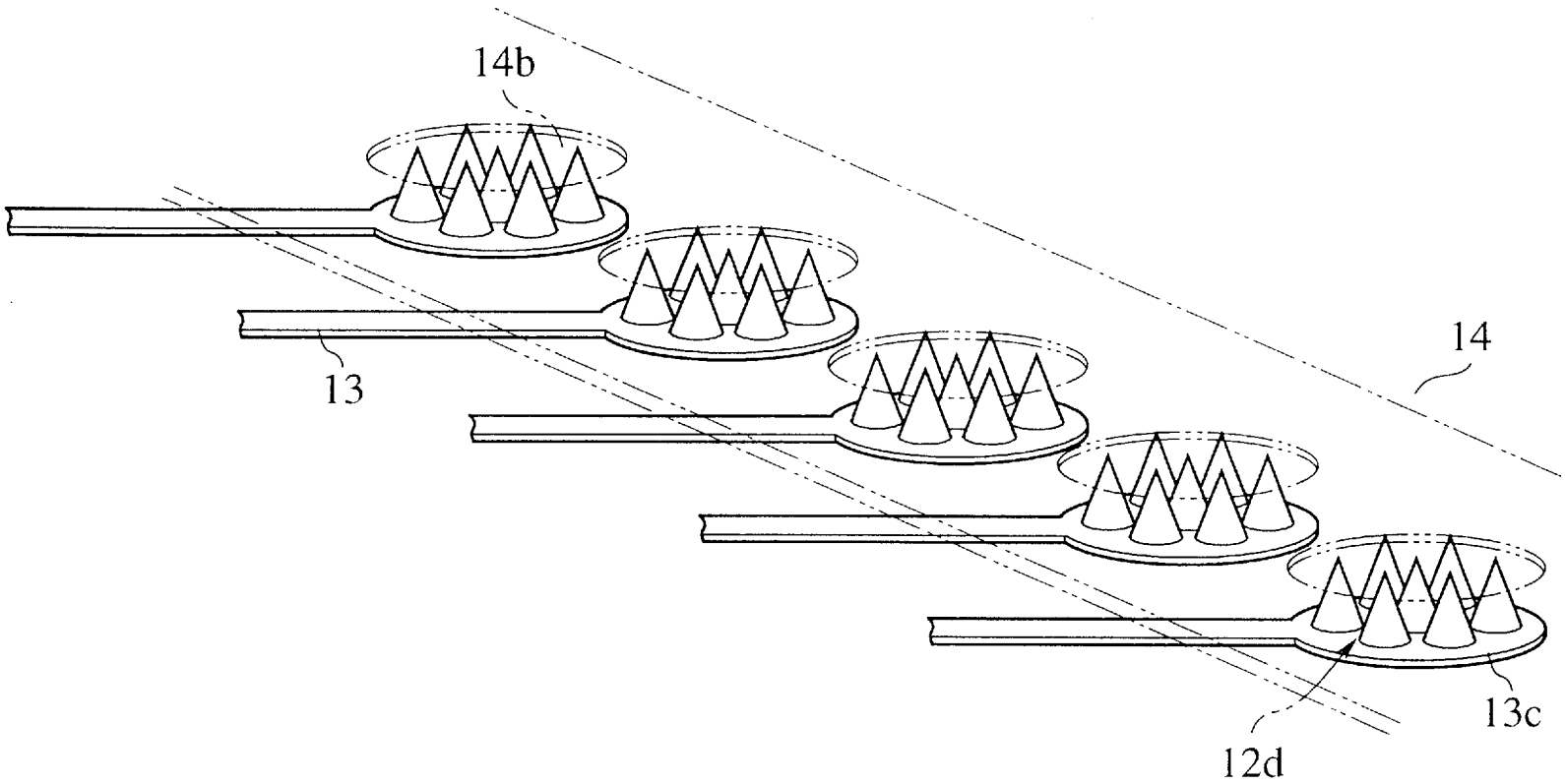
FIG. 23 is an illustration of a part of a printing head section in the eleventh embodiment of an ink jet printing apparatus according to the present invention.

Referring now to FIG. 23, the eleventh embodiment of an ink jet printing apparatus according to the present invention will be described in detail.

In the above described seventh to tenth embodiments, a case of using one conical projection covered by the projecting electrode for one picture dot has been described, but in this eleventh embodiment, a plurality of conical projections covered by the projecting electrodes are provided for each picture dot as shown in FIG. 23. Here, a case of providing the ink passing holes 14*b* on the upper cover 14 is depicted in FIG. 23. In this case, a group of conical projections 12*d* in tiny conical shapes are provided in correspondence to each ink passing hole 14*b*.

In manufacturing the conical projection, unless the manufacturing process is stabilized, it is difficult to produce a number of projections with the totally identical characteristic. In addition, although the occurrence of the electric discharge is prevented in this printing head section configuration in principle, if the electric discharge happens to occur, the characteristic of the projection may be altered due to the electric discharge during the use, and this in turn makes it impossible to form the picture dots stably by causing a situation in which the concentration of the picture dot or the picture dot formation position becomes unstable, or an even worse situation in which the picture dot is not formed at all depending on cases.

However, by providing a group of conical projections 12*d* for each picture dot as shown in FIG. 23, each picture dot is to be formed by many projections, so that even when some projections with different characteristics are involved, it is possible to stabilize the picture dot characteristic. Namely, even when there are some projections from which the ink drops are not ejected in a certain group of projections, the ink drops ejected from the other normally operating projections of this certain group of projections can effectively form the picture dot in this configuration.

Figure 24:
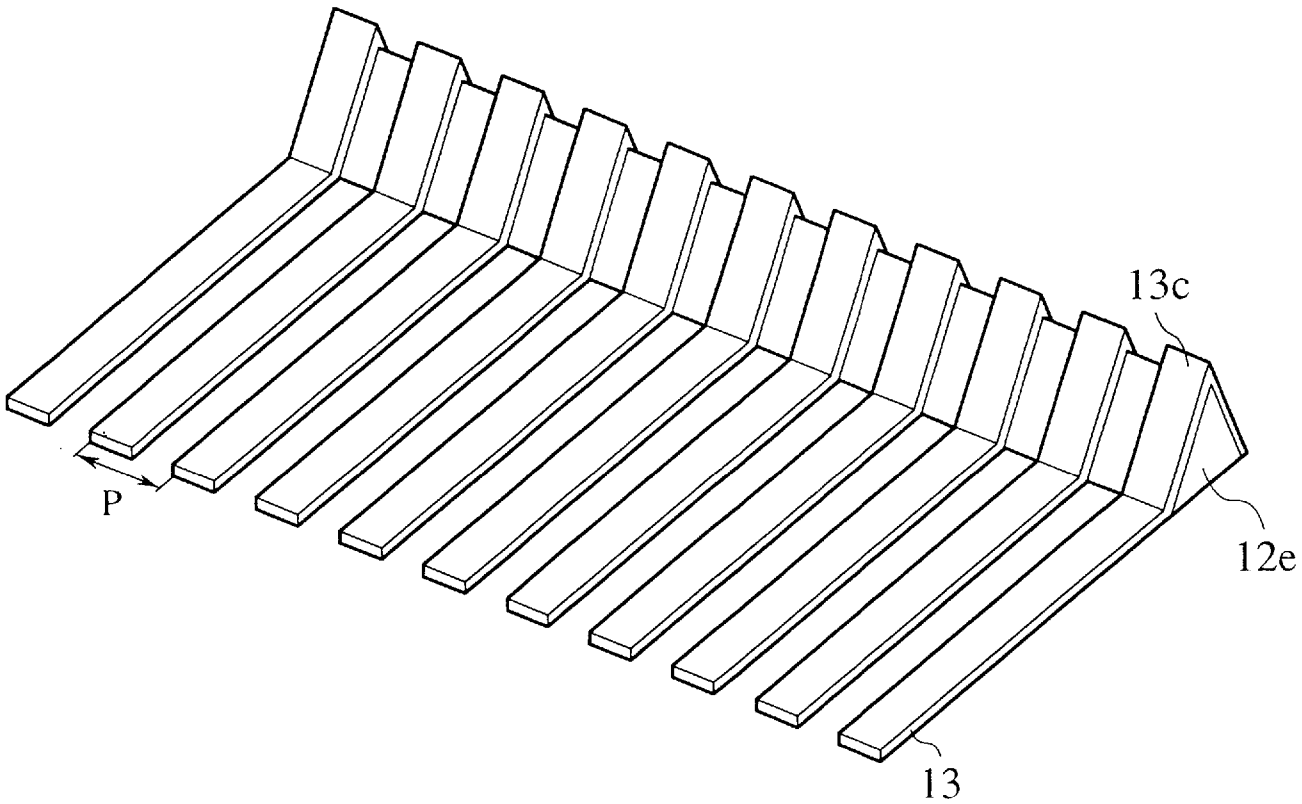
FIG. 24 is a top plan view of one arrangement of individual electrodes for a printing head section in the twelfth embodiment of the ink jet printing apparatus according to the present invention.
Figure 25:
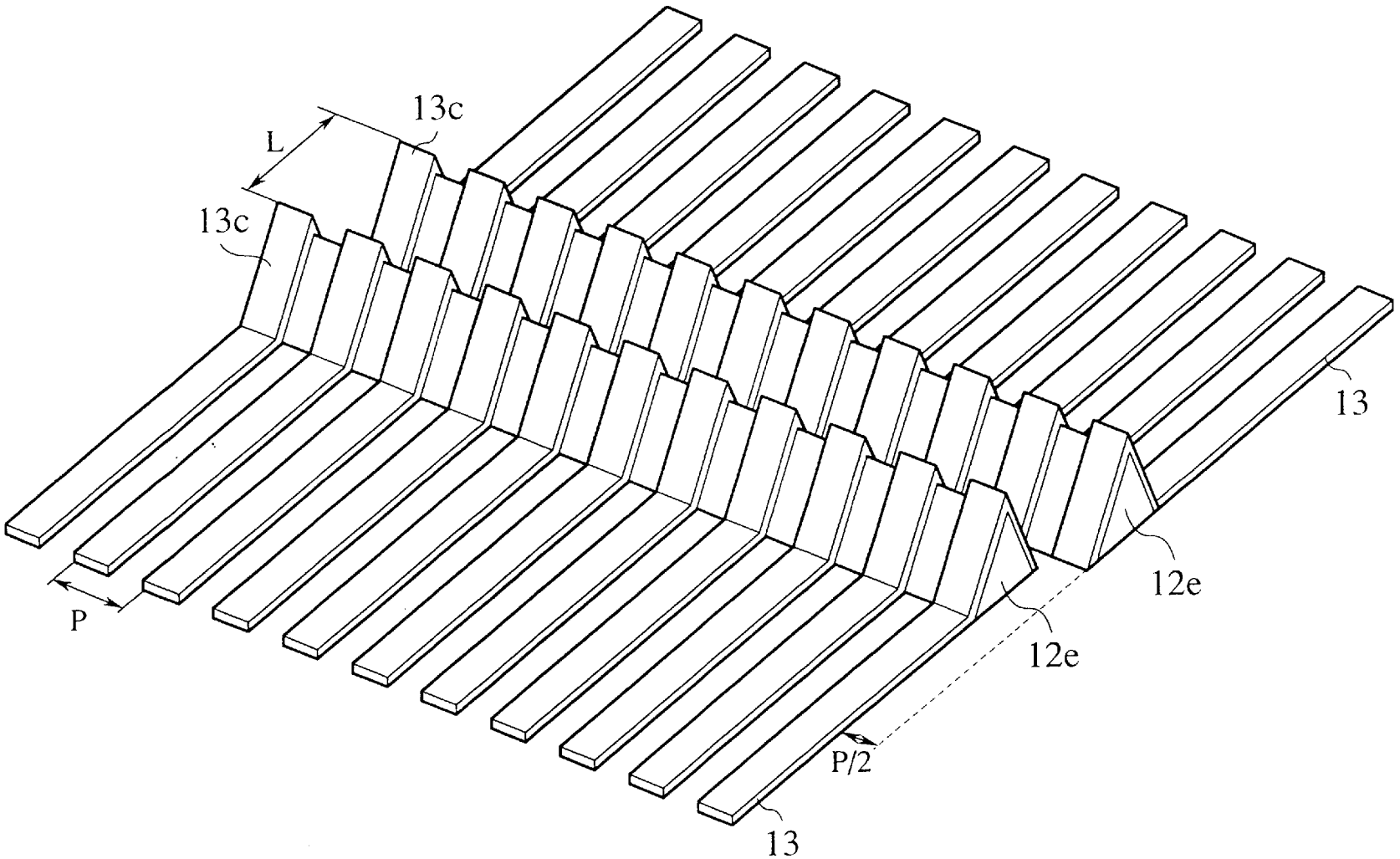
FIG. 25 is a top plan view of another arrangement of individual electrodes for a printing head section in the twelfth embodiment of the ink jet printing apparatus according to the present invention.

Referring now to FIG. 24 and FIG. 25, the twelfth embodiment of an ink jet printing apparatus according to the present invention will be described in detail.

The above described seventh to eleventh embodiments concerned with a use of the conical projection which is formed independently one by one, but in this twelfth embodiment, as shown in FIG. 24, a continuous projection 12*e* with a triangular cross sectional shape which is extending in the main scanning direction is provided, and the projecting electrodes 13*c* are formed by extending the individual electrodes 13 in the sub scanning direction over this continuous projection 12*e* at the constant pitch P in the main scanning direction. This continuous projection 12*e* has a cross sectional shape in the sub scanning direction which is tapering toward the tip end, so that the same effect as in a case of using the conical projections can be obtained in this case as well. In addition, there is no need to provide the projections independently one by one, so that it has an advantage of being easier to manufacture.

FIG. 25 shows a modified configuration for realizing a high resolution level, in which two continuous projections 12*e* with a triangular cross sectional shape are arranged in two parallel line along the sub scanning direction, by setting a distance L between the two continuous projections to be:

$$L=P*(1/2)*(2*n+1)$$

where n is an integer, while the projecting electrodes 13*c* are formed by extending the individual electrodes 13 in the sub scanning direction over each of these continuous projections 12*e*, at the constant pitch P in the main scanning direction over each continuous projection 12*e*, with the pitch displacement of P/2 in the main scanning direction between these two continuous projections 12*e*. In this configuration of FIG. 25, the resolution level is raised twice as high as that in the configuration of FIG. 24, both in the main scanning direction as well as in the sub scanning direction.

It is to be noted that the cross sectional shape of the continuous projection 12*e* in this twelfth embodiment may not necessarily be limited to the triangular shape as shown in FIG. 24 and FIG. 25, and may be a partial circular or elliptical shape, or a trapezoidal shape, or a shape having a rounded tip end resulting from a manufacturing process. In other words, just as in a case of the conical projection described above, it suffices for the continuous projection of this twelfth embodiment to have a cross sectional shape which is tapering toward the tip end.

Referring now to FIGS. 26A to 26F, the thirteenth embodiment of an ink jet printing apparatus according to the present invention will be described in detail.

Figure 26A:
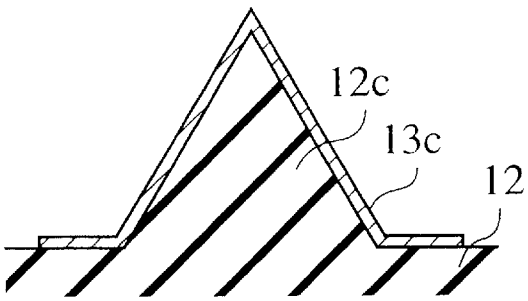
FIGS. 26A to 26F are illustrations of various structures for a projection that can be used in a printing head section of the thirteenth embodiment of an ink jet printing apparatus according to the present invention.

In this thirteenth embodiment, some exemplary structures and manufacturing method for the conical projection 12*c* and the projecting electrode 13*c* will be described. The above described seventh to twelfthth embodiments concerned with a case of manufacturing the conical projection 12*c* or the continuous projection 12*e* with a triangular cross sectional shape on the head substrate 12, and then forming the projecting electrode 13*c* on the conical projection 12*c* or the continuous projection 12*e* as shown in FIG. 26A. In this case, the conical projection 12*c* or the continuous projection 12*e* can be either insulative or conductive. Here, it is required to manufacture very small structures accurately, so that the method for processing Si and conductive Si by the semiconductor manufacturing process is the simplest available method for manufacturing the conical projection 12*c* or the continuous projection 12*e* and the projecting electrode 13*c* in this manner.

Figure 26B:
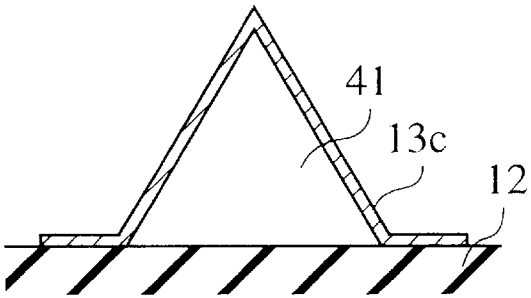

On the other hand, FIG. 26B shows a case in which a conically manufactured projecting electrode 13*c* is adhered on the head substrate 12. In this case of FIG. 26B, the interior region of the conically manufactured projecting electrode 13*c* is left as a cavity 41.

Figure 26C:
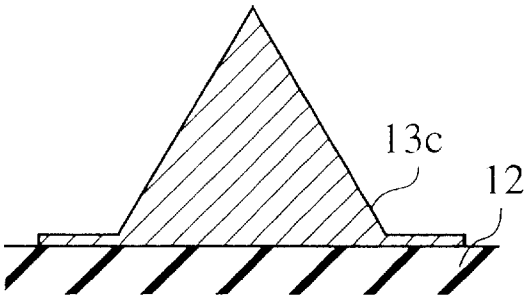

FIG. 26C also shows a case of adhering the conically manufactured projecting electrode 13*c* to the head substrate 12, but in this case of FIG. 26C, the interior region of the conically manufactured projecting electrode 13*c* is filled with the same conductive material, such that the conically manufactured projecting electrode 13*c* plays the functions of the conical projection 12*c* as well.

Figure 26D:
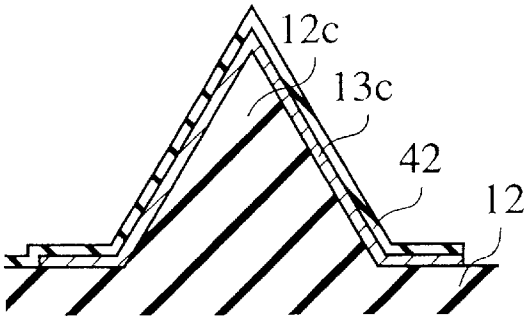
Figure 26E:
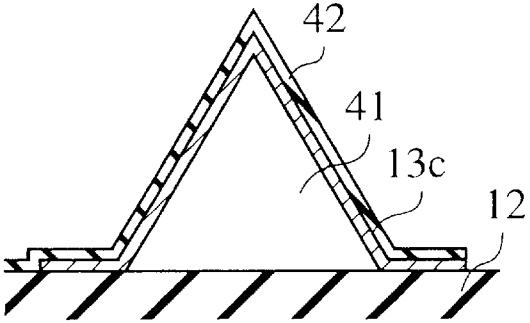
Figure 26F:
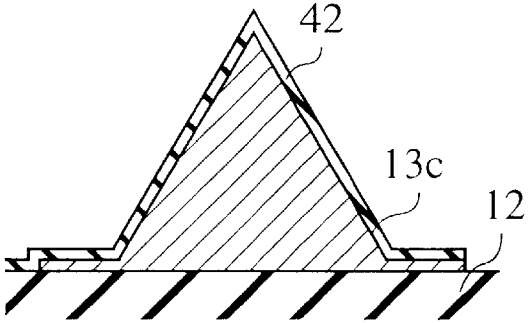

FIG. 26D, 26E, and 26F show cases of forming an insulative layer 42 over the surface of the individual electrode 13 including the projecting electrode 13*c* corresponding to that shown in FIGS. 26A, 26B, and 26C, respectively.

Namely, in a case the individual electrode 13 and the projecting electrode 13*c* which are made of metallic or conductive material are exposed in the air, when the charged colorants in the ink contacts with the individual electrode 13 and the projecting electrode 13*c*, the charge injection from the individual electrode 13 and the projecting electrode 13*c* to the colorants in the ink occurs such that there are cases in which the colorants are charged more than necessary. This charge injection can also cause a variation in the characteristics of the colorants which are directly charge injected from the individual electrode 13 and the projecting electrode 13*c* with respect to the other colorants. When this occurs, the ink ejection characteristic becomes unstable, and it becomes impossible to print the image at the constant concentration continuously. This problem can be resolved by using the ink which can control the amount of charging on the colorants, but it is also possible to resolve this problem by providing the additional insulative layer 42 on the surface of the individual electrode 13 and the projecting electrode 13*c* as described above.

Here, as a method for forming the insulative layer 42, it is possible to use a method for applying the resin over the surface of the individual electrode 13 and the projecting electrode 13*c* for a thickness in a range of sub-micron to ten and several microns, or a method for applying an insulative layer of $SiO_2$, etc. In addition, in a case of forming the individual electrode 13 by the conductive Si, it is also possible to use a method for forming an insulative film by oxidizing the electrode surface.

Figure 27:
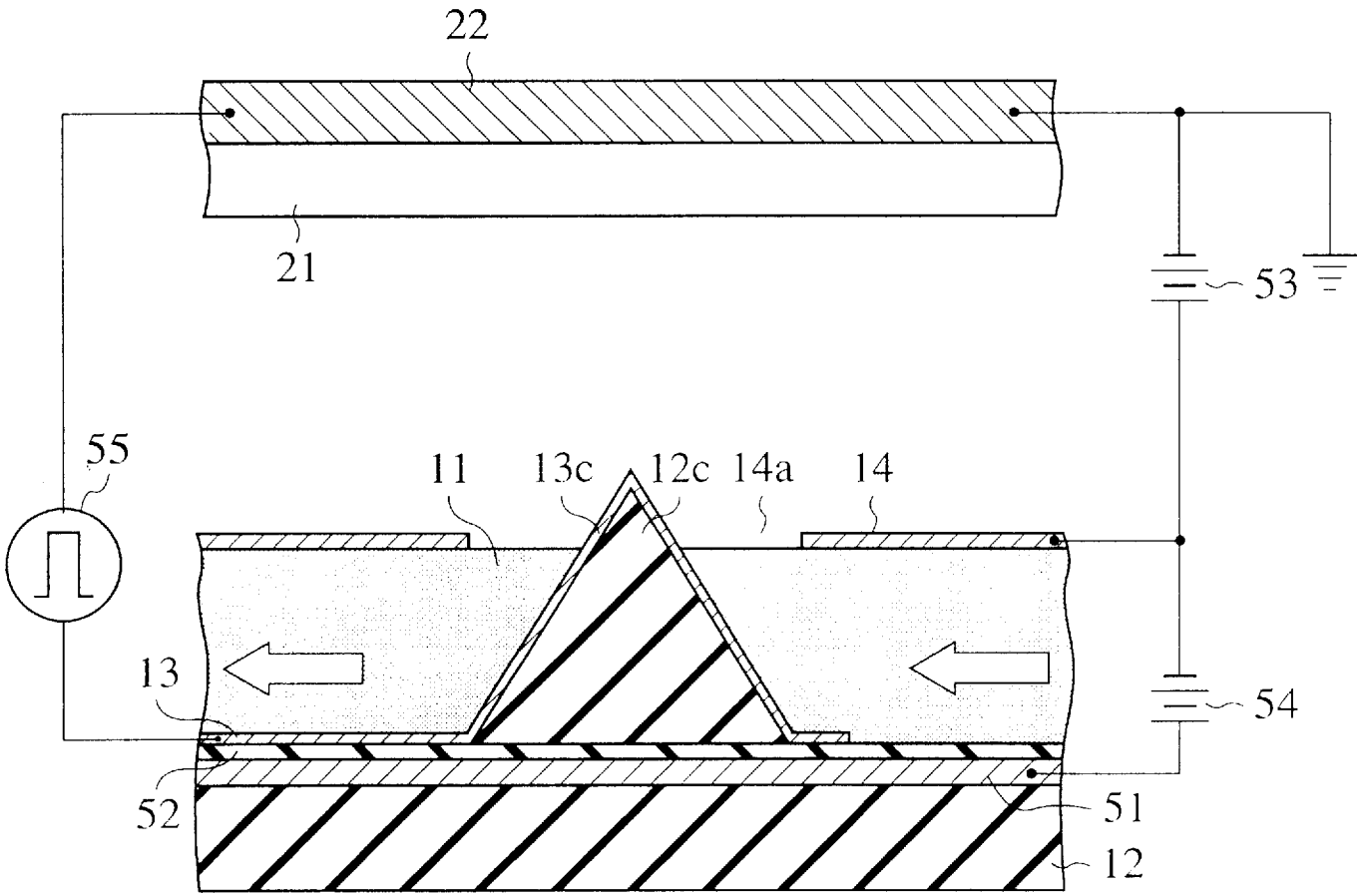
FIG. 27 is a schematic diagram of an ink jet printing apparatus in the fourteenth embodiment according to the present invention.

Referring now to FIG. 27, the fourteenth embodiment of an ink jet printing apparatus according to the present invention will be described in detail.

This fourteenth embodiment particularly concerns with an alternative manner of applying voltages to various electrodes.

In this fourteenth embodiment, as shown in FIG. 27, a colorant compression electrode 51 is formed over the head substrate 12 entirely while an insulative layer 52 is formed over this colorant compression electrode 51, and the conical projection 12*c*, the individual electrode 13, and the projecting electrode 13*c* are formed over the insulative layer 52. Then, the upper cover 14 having the slit 14*a* is placed with spacers (not shown) inserted between the upper cover 14 and the insulative layer 52 to form the ink flow passage for supplying the ink 11. In this fourteenth embodiment, the upper cover 14 is made of a conductive material.

In this configuration of FIG. 27, a positive acceleration bias voltage is applied by an acceleration bias voltage source 53 between the upper cover 14 and the facing electrode 22 contacting with the recording medium 21, while a positive colorant compression bias voltage is applied by a colorant compression bias voltage source 54 between the upper cover 14 and the colorant compression electrode 51. When this colorant compression bias voltage is applied, an electric field is formed between the upper cover 14 and the colorant compression electrode 51 such that the positively charged colorants are gathered around the upper cover 14 due to this electric field. In other words, the colorants are compressed at an upper layer portion of the ink 11. This portion with a higher colorant concentration flows sequentially from the upstream side to the downstream side along the flow of the ink 11 indicated by arrows in FIG. 27, such that the colorant compressed ink is also supplied to a vicinity of the tip end of the conical projection 12*c* as well.

Then, when the pulsed voltage as the signal voltage according to the image signal is applied from a driving circuit 55 to the individual electrode 13, the ink drops are ejected from the tip end portion of the projecting electrode 13*c*. The ejected ink drops are then accelerated toward the recording medium 21 by the electric field formed by the acceleration bias voltage.

In this fourteenth embodiment, the colorant compression and the ink drop ejection can be controlled separately by the separate voltage sources, i.e., the colorant compression bias voltage source 54 and the driving circuit 55. In a case of realizing the colorant compression and the ink drop ejection simultaneously as in the seventh embodiment described above, it is necessary to superpose the compression bias voltage of about 1 kV with the ejection pulsed voltage of about several hundred V as described above, so that it is necessary to use the IC with an endurable voltage greater than a sum of these voltages to be superposed. In contrast, in a case of separating the colorant compression and the ink drop ejection as in FIG. 27, the acceleration and colorant compression bias voltages can be applied commonly for all the picture dots and it is only necessary to control the ejection pulsed voltage of about several hundred V, so that it is possible to use a cheaper IC with lower endurable voltage, and this in turn can make a significant contribution to a reduction of size and a stabilization of operation in the ink jet printing apparatus.

It is to be noted that, in FIG. 27, the acceleration bias voltage from the acceleration bias voltage source 53 is assumed to be the DC voltage, but it is also possible to use the pulsed voltage synchronized with the image signal as the acceleration bias voltage.

Figure 28A:
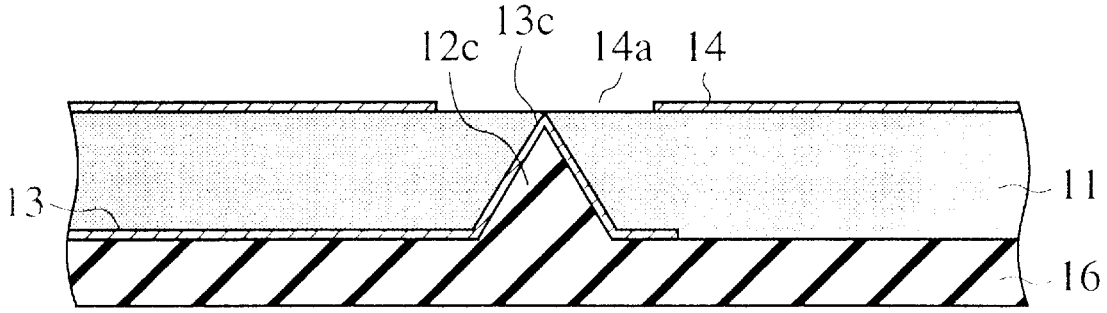
FIGS. 28A and 28B are cross sectional views of two possible configurations for a part of a printing head section in the fifteenth embodiment of an ink jet printing apparatus according to the present invention.
Figure 28B:
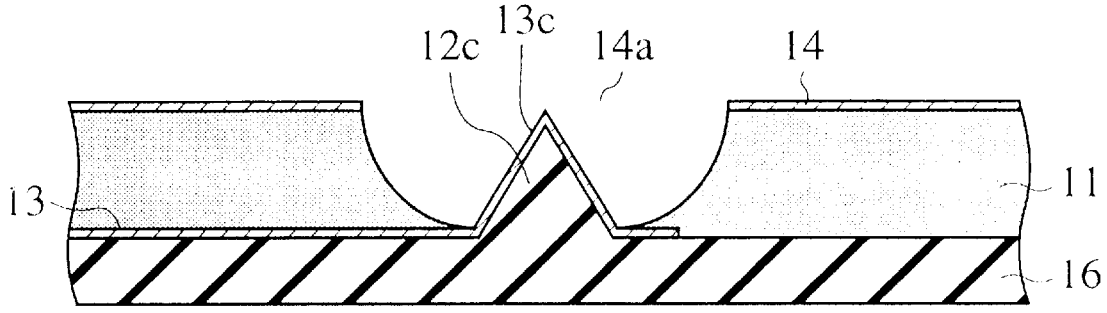

Referring now to FIGS. 28A and 28B, the fifteenth embodiment of an ink jet printing apparatus according to the present invention will be described in detail.

The above described seventh to fourteenth embodiments concerned with a case in which the tip end of the projecting electrode 13*c* is slightly sticking out from the liquid surface of the ink 11, but it is also possible to eject the ink drops in the following cases.

First, FIG. 28A shows a case in which the tip end of the projecting electrode 13*c* is located slightly below the liquid surface of the ink 11. Even in this state in which the projecting electrode 13*c* is completely immersed into the ink 11, the upper portion of the ink 11 is in a state in which the colorants are compressed to have a higher colorant concentration by means of the bias voltage, so that when the signal voltage is applied to the individual electrode 13, the colorants compressed in a vicinity of the tip end of the projecting electrode 13*c* can be ejected as the ink drops. In this case, the tip end of the projecting electrode 13*c* is always immersed in the ink 11 and therefore it is always kept wet, so that it is possible to prevent the occurrence of the electric discharge more surely.

On the other hand, FIG. 28B shows a case in which the projecting electrode 13*c* is almost completely sticking out from the liquid surface of the ink 11, which can be realized by applying an appropriate negative pressure to the ink 11. Even in this state, a thin ink layer can be formed at the tip end of the projecting electrode 13*c* by means of the capillary phenomenon when the conical projection 12*c* is small, or by means of the bias voltage application when the conical projection 12*c* is large, so that it is possible to eject the ink drops. Here, the thin ink layer on the surface of the projecting electrode 13*c* can be formed more stably at a position more distanced from the liquid surface of the ink 11, so that it is possible to realize the stable ink drop ejection, and consequently it is possible to realize the stable image printing.

However, when the projecting electrode 13*c* is distanced from the liquid surface of the ink 11 as in FIG. 28B, it becomes easier for the projecting electrode 13*c* to be dried, so that it is preferable to withdraw the ink 11 in a vicinity of the projecting electrode 13*c* whenever the apparatus is not going to be used for a while, and inject the ink 11 again at a time of using the apparatus again. At a time of injecting the ink 11, the ink 11 is injected at a slightly higher pressure first in order to wet the projecting electrode 13*c* all the way up to its tip end, and then the pressure is switched to a negative pressure to realize a state as shown in FIG. 28B. In this manner, the projecting electrode 13*c* can be wet all the way up to its tip end so that the smooth ink supply becomes possible by means of the voltage application.

Figure 29A:
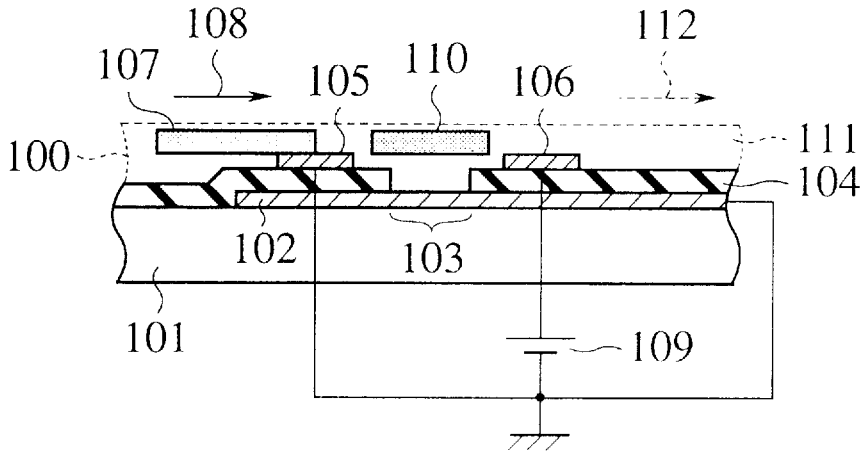
FIGS. 29A and 29B are schematic diagrams of a part of a printing head section in the sixteenth embodiment of an ink jet printing apparatus according to the present invention.
Figure 29B:
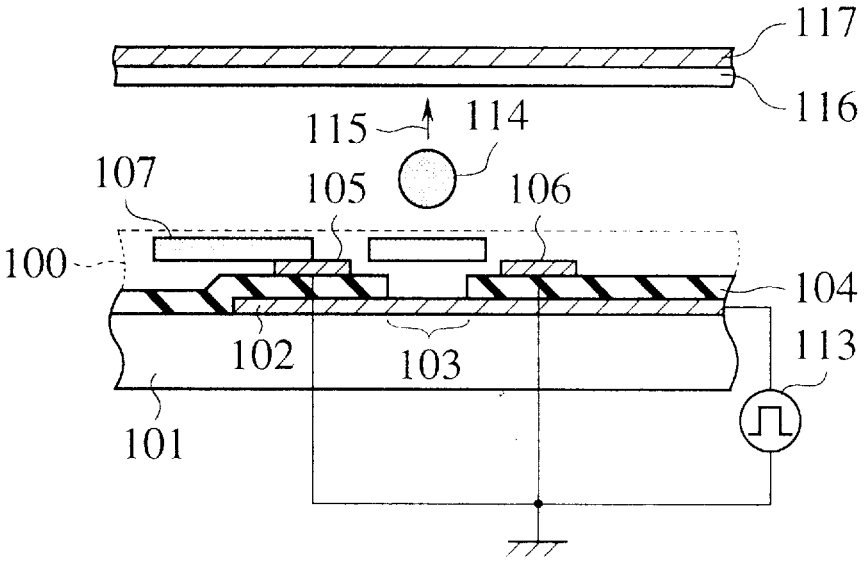

Referring now to FIGS. 29A and 29B, the sixteenth embodiment of an ink jet printing apparatus according to the present invention will be described in detail.

In this sixteenth embodiment, a printing head section of the ink jet printing apparatus has a configuration as shown in FIG. 29A, in which the ink with the colorants charged in a prescribed polarity are distributed in the solvent is used while the flow of the colorants in this ink is regulated to compress the colorants by means of an electric field produced by a pair of colorant compression electrodes, and the compressed colorants are ejected toward the recording medium by means of an electric field produced by an ejection electrode provided in a direction across the colorant compression electrodes with an insulative layer inserted in between.

Namely, in this sixteenth embodiment, in an ink flow passage 100 for conveying the ink 107, an insulative head substrate 101 made of a ceramic substrate in thickness of about 1 mm with a glass layer applied thereon or a glass plate is provided, and on this head substrate 101, the ejection electrode 102 in width of about 100 $\mu$m corresponding to the recording dot is formed along a direction parallel to a plane of the cross section shown in FIG. 29A. On this ejection electrode 102, the insulative layer 104 made of a glass, for example, in thickness of about several to several tens $\mu$m is formed except for a recording picture dot formation region 103 in width of about 50 $\mu$m.

Then, on the insulative layer 104, a pair of the colorant compression electrodes 105 and 106 having a gap of about 100 $\mu$m therebetween for compressing the charged colorants in the ink 107 are provided along a direction perpendicular to that of the ejection electrode 102, i.e., a direction perpendicular to a plane of the cross section shown in FIG. 29A. These colorant compression electrodes 105 and 106 are covered by insulative layers (not shown) made of $SiO_2$ film, for example, in thickness of less than several $\mu$m according to the need, so as to prevent the charge injection from these colorant compression electrodes 105 and 106 into the ink solvent as well as the electric discharge between the ejection electrode 102 and these colorant compression electrodes 105 and 106. Here, the thickness of each of the ejection electrode 102 and the colorant compression electrodes 105 and 106 is set to be about several thousand Å.

In this configuration of FIG. 29A, the operation for compressing and ejecting the colorants in the ink 107 conveyed through the ink flow passage 100 is realized as follows.

First, FIG. 29A is showing a step of compressing the colorants in the ink. Here, the ink 107 to be used in this sixteenth embodiment is formed by an ink solvent made of a kerosene or isoparaffin which is a kind of a petroleum with over $10^{-8}$ ωm of insulativeness in which positively charged colorants made by mixing pigments with charge control agents and binders are colloidally distributed and floating. Here, the colorants may be charged negatively if desired, and in such a case the polarity of the voltages to be applied to the ejection electrode 102 and the colorant compression electrodes 105 and 106 should be reversed.

This ink 107 which has positively charged colorants in the ink solvent is conveyed through the ink flow passage 100 in constant amount over the head substrate 101 in a direction indicated by an arrow 108 in FIG. 29A. In order to compress the charged colorants in this ink 107, the colorant compression electrode 105 at an upstream side in the ink conveying direction is set at the ground level, while the colorant compression electrode 106 at a downstream side in the ink conveying direction is applied with a colorant compression voltage of +50 V, for example, from a colorant compression voltage source 109, such that a strong electric field of about $2\times10^4$ V/cm for exerting a force in a direction opposite to that of the flow of the ink 107 on the colorants is formed.

By means of this strong electric field formed between the colorant compression electrodes 105 and 106, the charged colorants in the ink 107 are regulated to resist against the flow of the ink 107, to form the compressed colorants 110 over the recording picture dot formation region 103 of the ejection electrode 102 located between the colorant compression electrodes 105 and 106. Namely, the charged colorants 110 in the ink 107 are compressed by being held at the recording picture dot formation region 103. On the other hand, as the compressed colorants 110 are formed, the ink solvent 111 with a reduced colorant concentration flows further down in the direction of an arrow 112 shown in FIG. 29A without being affected by the electric field.

Next, FIG. 29B is showing a step of ejecting the compressed colorants 110 by means of an electric field. Here, in order to form a strong electric field for ejection in a vertical direction, the colorant compression electrodes 105 and 106 are set at the ground level, while the ejection electrode 102 provided across the colorant compression electrodes 105 and 106 with the insulative layer 104 inserted in between is applied with a pulsed signal voltage of about +200 V, for example, by a signal voltage source 113 according to the image signal. By the application of this pulsed signal voltage, the strong electric field of about $10^5$ V/cm is formed at the recording picture dot formation region 103 between the colorant compression electrodes 105 and 106 in a direction perpendicular to the head substrate 101, i.e., a direction toward a recording medium 116, so that the positively charged and compressed colorants 110 are ejected toward the recording medium 116 in a direction indicated by an arrow 115 in FIG. 29B in a form of an ink drop 114.

The recording medium 116 is a plain paper, for example, and located at a position distanced by about several hundred $\mu$m from the ejection electrode 102 and the colorant compression electrodes 105 and 106 on the head substrate 101, and on its back side, a facing electrode 117 which also functions as a platen is provided. This facing electrode 117 is set at the ground level so as to stabilize the ejection of the colorants in a form of the ink drop 114. At a time of ejecting the colorants, the positive charge injection into the ink 107 at the recording picture dot formation region 103 is made by the ejection electrode 102 in order to carry out the ejection of the compressed colorants 110 efficiently. In this manner, the image is printed on the recording medium 116.

According to this sixteenth embodiment, the compression of the colorants and the ejection of the compressed colorants are separately controlled by the colorant compression electrodes 105 and 106 and the ejection electrode 102, so that it is possible to optimize both the voltage to be applied by the colorant compression voltage source 109 and the pulsed signal voltage for ejection to be applied by the signal voltage source 113.

Consequently, even when the voltage for ejection is set to be a sufficiently low voltage in order to prevent the electric field interference among the neighboring ejection electrodes, it is still possible to compress the colorants by a sufficiently high colorant compression voltage, and therefore it is possible to realize a satisfactory printing without any mutual interference among the recording picture dots even in a multi-head configuration formed by arranging a number of ink drop ejection holes as described in the following seventeenth embodiment.

Figure 30:
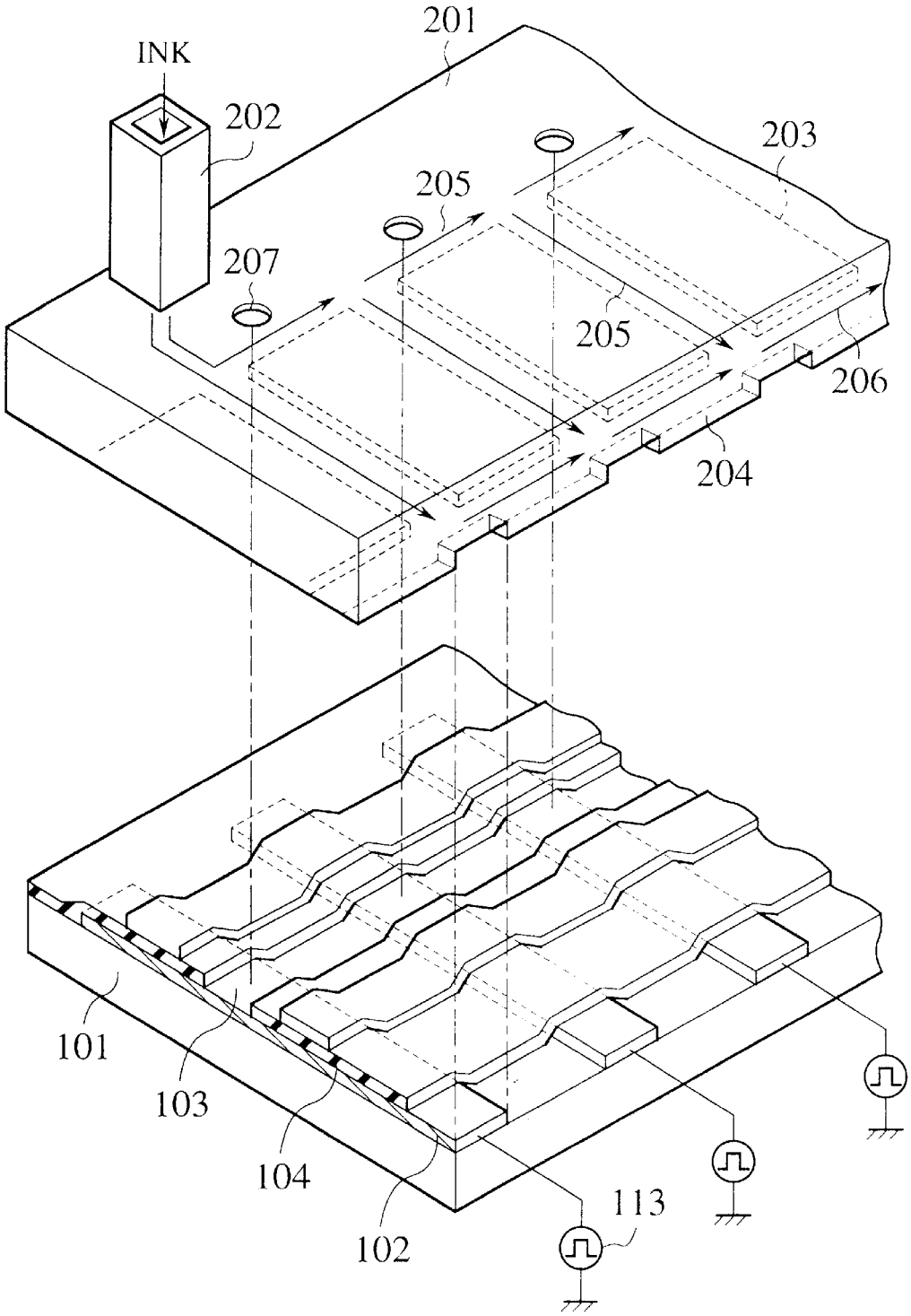
FIG. 30 is an expanded view of a part of a printing head section in the seventeenth embodiment of an ink jet printing apparatus according to the present invention.

Referring now to FIG. 30, the seventeenth embodiment of an ink jet printing apparatus according to the present invention will be described in detail.

This seventeenth embodiment concerns with a multi-head configuration as shown in FIG. 30 which is formed by using the printing head section of the above described sixteenth embodiment.

Namely, in the printing head section of this seventeenth embodiment, an insulative head substrate 101 made of a ceramic substrate in thickness of about 1 mm with a glass layer applied thereon or a glass plate is provided, and on this head substrate 101, a plurality of ejection electrodes 102, each in width of about 100 $\mu$m corresponding to the recording dot, are formed in parallel at constant interval. On these ejection electrodes 102, the insulative layer 104 made of a glass, for example, in thickness of about several to several tens $\mu$m is formed, commonly for all the ejection electrodes 102, except for a recording picture dot formation region 103 in width of about 50 $\mu$m.

Then, on the insulative layer 104, a pair of the colorant compression electrodes 105 and 106 having a gap of about several hundred $\mu$m therebetween for compressing the charged colorants in the ink 107 are provided along a direction perpendicular to that of the ejection electrodes 102, commonly for all the ejection electrodes 102. These colorant compression electrodes 105 and 106 are covered by insulative layers (not shown) made of $SiO_2$ film, for example, in thickness of less than several $\mu$m according to the need, so as to prevent the charge injection from these colorant compression electrodes 105 and 106 into the ink solvent as well as the electric discharge between the ejection electrode 102 and these colorant compression electrodes 105 and 106. Here, the thickness of each of the ejection electrodes 102 and the colorant compression electrodes 105 and 106 is set to be about several thousand Å.

This printing head section is covered by a cover 201 for an ink conveying system which is provided with about 50 $\mu$m gap therebetween. This cover 201 is made of the resin with the similar dielectric constant as the ink solvent so as not to disturb the electric field formed by the ejection electrodes 102 and the colorant compression electrodes 105 and 106. This cover 201 has an ink entry pipe 202 connected thereto, as well as passage formation blocks 203 and projected edges 204 on its lower surface for forming an ink supply passage 205 and an ink collection passage 206 between the cover 201 and the head substrate 101.

The ink entry pipe 202 is connected with an ink circulation mechanism equipped with a pump (not shown), such that the ink is entered with a positive pressure exerted by the pump of this ink circulation mechanism. The entered ink is then supplied over the recording picture dot formation region 103 of the ejection electrodes 102 through the ink supply passage 205, and then collected to the ink circulation mechanism through the ink collection passage 206 to which a negative pressure is exerted by the pump of this ink circulation mechanism. In addition, the cover 201 has a number of ink drop ejection holes 207 over the recording picture dot formation region 103, in correspondence to the ejection electrodes 102.

An end portion of each ejection electrode 102 is extended out to an external of the cover 201 and connected with the signal voltage source 113, while the colorant compression electrodes 105 and 106 are extended out at both ends along a length direction of this printing head and connected with the colorant compression voltage source (not shown).

With this configuration of FIG. 30, the ink jet printing apparatus of this seventeenth embodiment operates as follows. Here, the operation for compressing and ejecting the colorants in the ink is basically the same as in the sixteenth embodiment described above.

First, the ink with the positively charged colorants is entered into the ink entry pipe 202, and supplied over the recording picture dot formation region 103 of the ejection electrodes 102 through the ink supply passage 205. Then, the colorants in the ink at the recording picture dot formation region 103 are compressed by the strong electric field produced by an application of the colorant compression voltage between the colorant compression electrodes 105 and 106.

Then, when the pulsed signal voltages according to the image signal are applied by the signal voltage sources 113 to the ejection electrodes 102, the strong electric field of about $10^5$ V/cm is formed at the recording picture dot formation region 103 between the colorant compression electrodes 105 and 106 in a direction perpendicular to the head substrate 101, i.e., a direction toward a recording medium (not shown), so that the positively charged and compressed colorants are ejected in forms of ink drops through the ink drop ejection holes 207, toward the recording medium located at a position distance by about several hundred $\mu$m above the cover 201. In a back side of this recording medium, there is provided a facing electrode (now shown) which also functions as a platen. This facing electrode is set at the ground level so as to stabilize the ejection of the colorants in forms of the ink drops. In this manner, the image according to the image signal is printed on the recording medium.

Here, as in the sixteenth embodiment described above, at a time of ejecting the colorants, the positive charge injection into the ink at the recording picture dot formation region 103 is made by the ejection electrodes 102 in order to carry out the ejection of the compressed colorants efficiently. In this case, the amount of charges to be injected is determined by the magnitude and the pulse width of the pulsed signal voltages to be applied by the signal voltage sources 113 to the ejection electrodes 102, so that by changing the magnitude and/or pulse width of the pulse signal voltages for each recording picture dot according to the image signal, it is possible to adjust the dot size for each recording picture dot so as to realize the gradation printing while preventing the fogging.

On the other hand, the ink which passed through the ink supply passage 205 is collected through the ink collection passage 206. Here, the ink is regulated by the cover 201 so that the ink flows through the ink supply passage 205 and the ink collection passage 206 in a form of a layer in a constant thickness of about 50 $\mu$m, so that the stable compression and ejection of the colorants in the ink.

According to this seventeenth embodiment, just as in the sixteenth embodiment, the compression of the colorants and the ejection of the compressed colorants are separately controlled by the colorant compression electrodes 105 and 106 and the ejection electrode 102, so that it is possible to optimize both the voltage to be applied by the colorant compression voltage source 109 and the pulsed signal voltages for ejection to be applied by the signal voltage sources 113.

Consequently, even when the voltage for ejection is set to be a sufficiently low voltage in order to prevent the electric field interference among the neighboring ejection electrodes, it is still possible to compress the colorants by a sufficiently high colorant compression voltage, and therefore it is possible to realize a satisfactory printing without any mutual interference among the recording picture dots even in a multi-head configuration of this seventeenth embodiment.

Figure 31A:
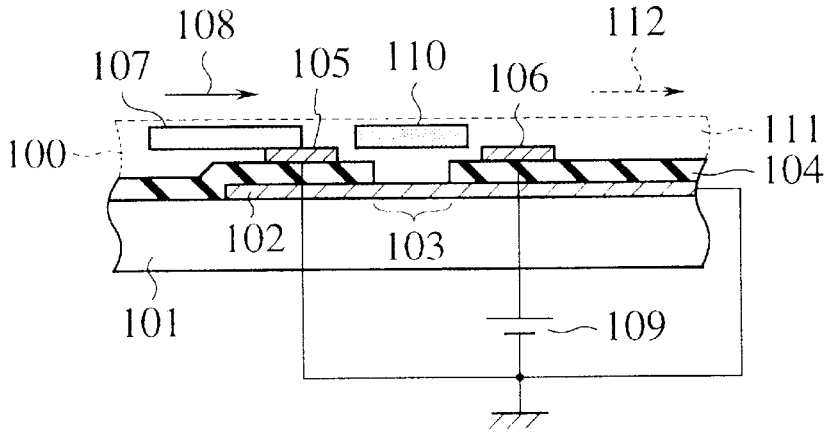
FIGS. 31A, 31B, and 31C are schematic diagrams of a part of a printing head section in the eighteenth embodiment of an ink jet printing apparatus according to the present invention.
Figure 31B:
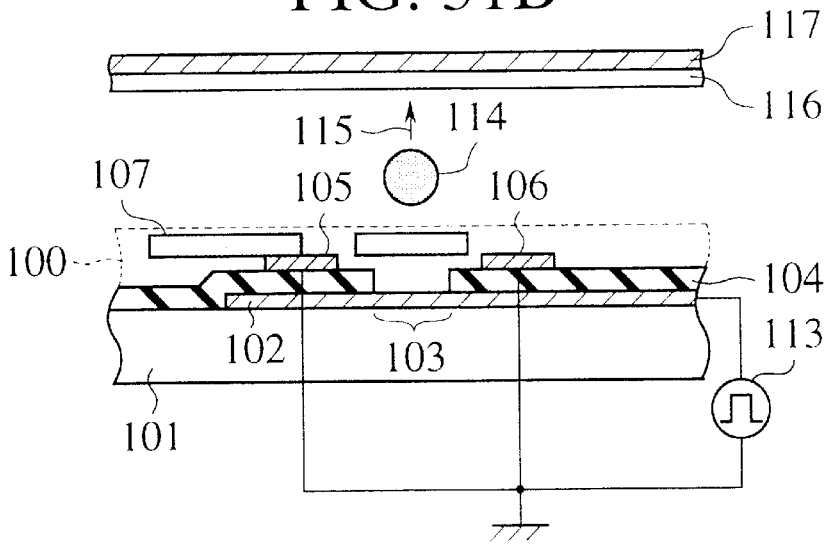
Figure 31C:
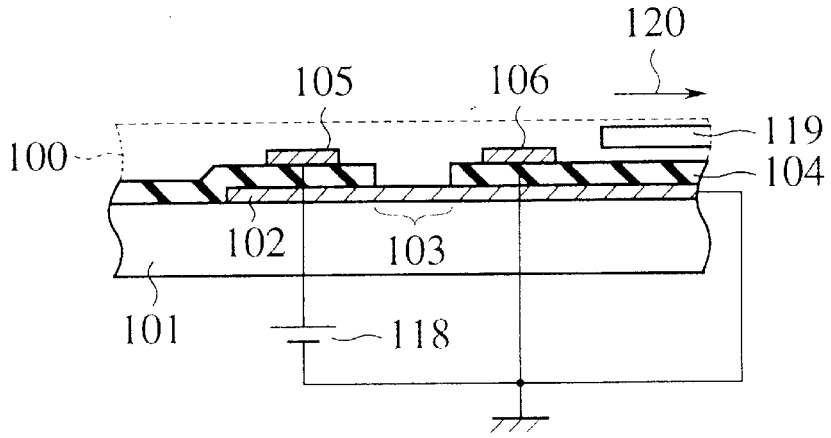

Referring now to FIGS. 31A to 31C, the eighteenth embodiment of an ink jet printing apparatus according to the present invention will be described in detail.

This eighteenth embodiment concerns with a manner of voltage application for the printing head section in a configuration similar to that of the above described sixteenth embodiment.

In this eighteenth embodiment, the step of compressing the colorants in the ink is realized as shown in FIG. 31A which is substantially the same as FIG. 29A described above, and the step of ejecting the compressed colorants in the ink is realized as shown in FIG. 31B which is substantially the same as FIG. 29B described above. Then, the step of removing the residual colorants after the ink drop ejection is realized as shown in FIG. 31C by means of the electric field in a polarity opposite to that used in the step of compressing such that the residual colorants can be collected along with the ink.

Namely, as shown in FIG. 31C, contrary to the colorant compression process of FIG. 31A, the colorant compression electrode 106 at a downstream side in the ink conveying direction is set at the ground level, while the colorant compression electrode 105 at an upstream side in the ink conveying direction is applied with a colorant removal voltage of +50 V, for example, in the same polarity as the charged colorants from a colorant removal voltage source 118, such that a strong electric field in a polarity opposite to that for the colorant compression is formed.

By means of this strong electric field formed between the colorant compression electrodes 105 and 106, the residual colorants 119 which have not been ejected by the ink drop ejection process receives a force in a direction indicated by an arrow 120 and pushed out along with the ink flow. In this manner, the recording picture dot formation region 103 of the ejection electrode 102 is cleaned after each ink drop ejection process, and always reset to the initial state as the new ink is conveyed therein, such that the stable ejection of the colorants in the ink can be realized while preventing the image quality degradation such as blurring.

Figure 32:
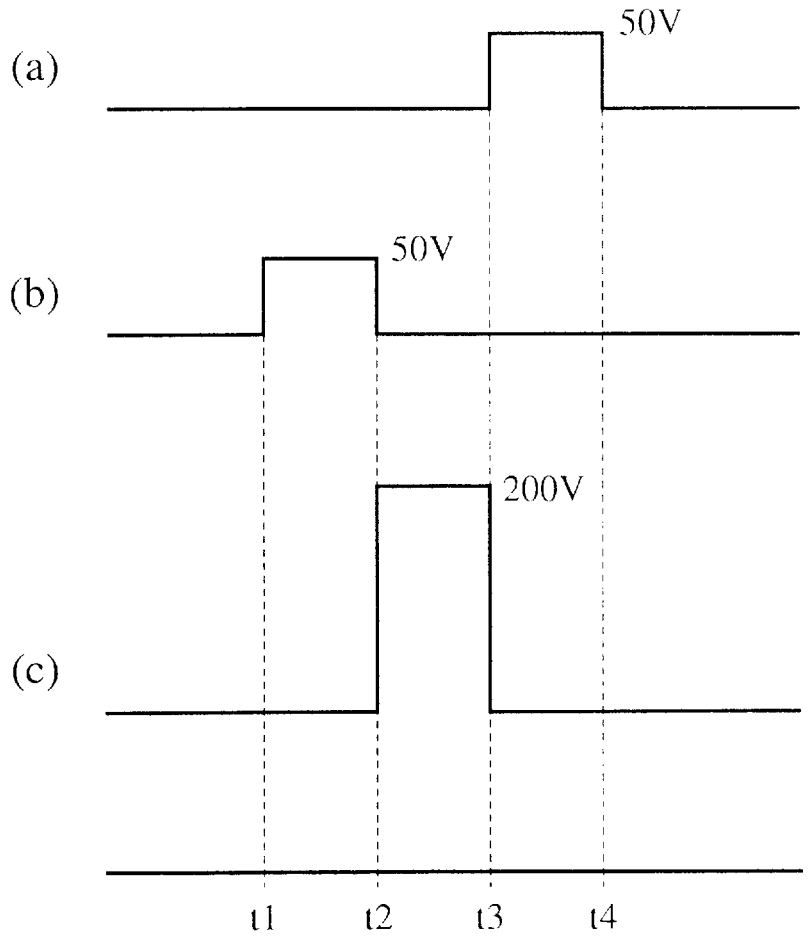
FIG. 32 is a timing chart for voltages to be applied to various electrodes of the printing head section in the eighteenth embodiment of an ink jet printing apparatus according to the present invention.

FIG. 32 shows a timing chart for the application of the voltages to the various electrodes in this eighteenth embodiment, where a part (a) indicates the voltage to be applied to the colorant compression electrode 105, a part (b) indicates the voltage to be applied to the colorant compression electrode 106, and a part (c) indicates the pulsed signal voltage to be applied to the ejection electrode 102.

First, at a timing t1, the colorant compression electrode 105 is set at the ground level, while the colorant compression electrode 106 is applied with a colorant compression voltage of +50 V. As a result, the strong electric field for exerting a force in a direction opposite to that of the flow of the ink on the colorants is formed between the colorant compression electrodes 105 and 106, such that the charged colorants are compressed at the recording picture dot formation region 103 of the ejection electrode 102. After this colorant compression, the ink solvent flows further down by means of the ink circulation mechanism described above.

Next, at a timing t2, both of the colorant compression electrodes 105 and 106 are set at the ground level, while the pulsed signal voltage of +200 V is applied to the ejection electrode 102. As a result, the strong electric field is formed at the recording picture dot formation region 103 of the ejection electrode 102 in a direction perpendicular to the head substrate 101, i.e., a direction toward a recording medium 116, so that the positively charged and compressed colorants 110 are ejected toward the recording medium 116 in a form of the ink drop 114. At this point, as the charges are directly injected from the ejection electrode 102 into the compressed colorants, the ejection can be realized easily. Also, the ejection electrode 102 is covered by a thin $SiO_2$ film in order to prevent the charge injection in the opposite polarity from this ejection electrode 102.

Then, at a timing t3, the colorant compression electrode 105 is applied with a colorant removal voltage of +50 V, while the colorant compression electrode 106 is set at the ground level. As a result, the positively charged and compressed colorants remaining in the recording picture dot formation region 103 of the ejection electrode 102 are exerted with an electrostatic force in the same direction as that of the ink flow, so that the residual colorants are flushed along with the ink flow. After that, at a timing t4, it is reset to the initial state. In this manner, it is possible to realize the printing by stably ejecting the compressed colorants.

Figure 33A:
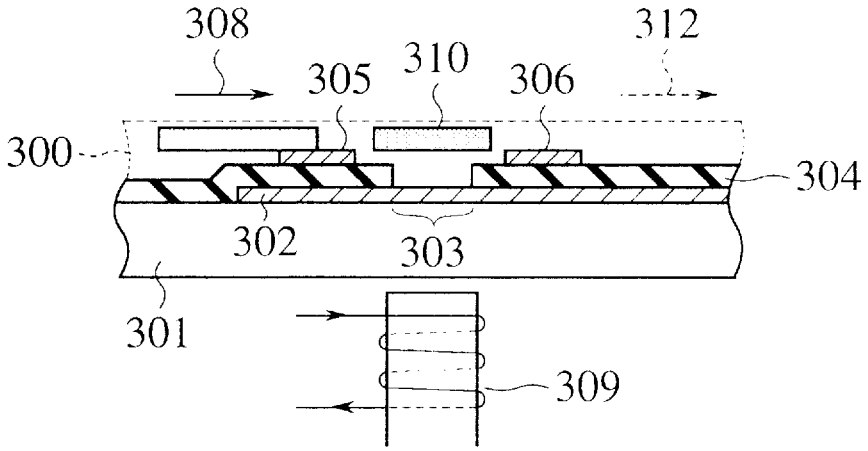
FIGS. 33A and 33B are schematic diagrams of a part of a printing head section in the nineteenth embodiment of an ink jet printing apparatus according to the present invention.
Figure 33B:
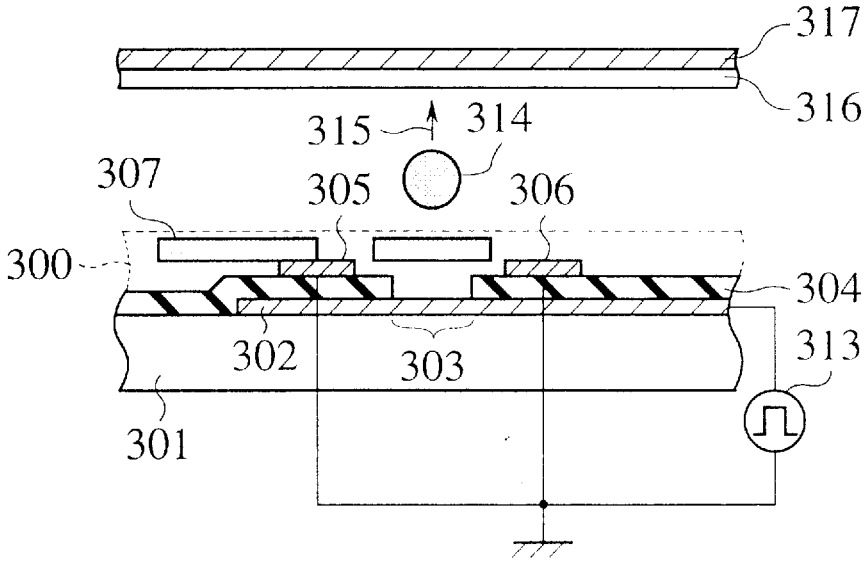

Referring now to FIGS. 33A and 33B, the nineteenth embodiment of an ink jet printing apparatus according to the present invention will be described in detail.

This nineteenth embodiment concerns with a case of using the magnetic ink in the printing head section in a configuration similar to that of the above described sixteenth embodiment.

Namely, in this nineteenth embodiment, an insulative head substrate 301 made of a ceramic substrate in thickness of about 1 mm with a glass layer applied thereon or a glass plate is provided in an ink flow passage 300, and an electromagnet 309 for generating a magnetic field for colorant compression is provided below this head substrate 301. On the other hand, on this head substrate 301, the ejection electrode 302 in width of about 100 $\mu$m corresponding to the recording dot is formed along a direction parallel to a plane of the cross section shown in FIG. 33A. On this ejection electrode 302, the insulative layer 304 made of a glass, for example, in thickness of about several to several tens $\mu$m is formed except for a recording picture dot formation region 303 in width of about 50 $\mu$m.

Then, on the insulative layer 304, a pair of induction electrodes 305 and 306 having a gap of about 100 $\mu$m therebetween are provided along a direction perpendicular to that of the ejection electrode 302, i.e., a direction perpendicular to a plane of the cross section shown in FIG. 33A. These induction electrodes 305 and 306 are covered by insulative layers (not shown) made of $SiO_2$ film, for example, in thickness of less than several $\mu$m according to the need, so as to prevent the charge injection from these induction electrodes 305 and 306 into the ink solvent as well as the electric discharge between the ejection electrode 302 and these induction electrodes 305 and 306. Here, the thickness of each of the ejection electrode 302 and the induction electrodes 305 and 306 is set to be about several thousand Å.

In this configuration of FIG. 33A, the operation for compressing and ejecting the colorants in the ink conveyed through the ink flow passage 300 is realized as follows.

First, FIG. 33A is showing a step of compressing the colorants in the ink. Here, the ink 307 to be used in this nineteenth embodiment a magnetic ink in which magnetic and insulative colorants are distributed and floating in an ink solvent. This magnetic ink 307 is conveyed through the ink flow passage 300 in constant amount over the head substrate 301 in a direction indicated by an arrow 308 in FIG. 33A. The colorants in this magnetic ink 307 are regulated to resist against the flow of the ink 307 by means of the magnetic field generated by conducting the currents through the electromagnet 309, to form the compressed colorants 310 over the recording picture dot formation region 303 of the ejection electrode 302 located between the induction electrodes 305 and 306. Namely, the magnetic colorants 310 in the magnetic ink 307 are compressed by being held at the recording picture dot formation region 303. On the other hand, as the compressed colorants 310 are formed, the ink solvent 311 with a reduced colorant concentration flows further down in the direction of an arrow 312 shown in FIG. 33A without being affected by the magnetic field.

Next, FIG. 33B is showing a step of ejecting the compressed colorants 310 by means of an electric field. Here, in order to form a strong electric field for ejection in a vertical direction, the induction electrodes 305 and 306 are set at the ground level, while the ejection electrode 302 provided across the induction electrodes 305 and 306 with the insulative layer 304 inserted in between is applied with a pulsed signal voltage of about +200 V, for example, by a signal voltage source 313 according to the image signal. By the application of this pulsed signal voltage, the strong electric field of about $10^5$ V/cm is formed at the recording picture dot formation region 303 between the induction electrodes 305 and 306 in a direction perpendicular to the head substrate 301, i.e., a direction toward a recording medium 316, so that the compressed colorants 310 are ejected toward the recording medium 316 in a direction indicated by an arrow 315 in FIG. 33B in a form of an ink drop 314.

The recording medium 316 is a plain paper, for example, and located at a position distanced by about 100 $\mu$m from the ejection electrode 302 and the induction electrodes 305 and 306 on the head substrate 301, and on its back side, a facing electrode 317 which also functions as a platen is provided. At a time of ejecting the colorants, the charge injection into the magnetic ink 307 at the recording picture dot formation region 303 is made by the ejection electrode 302, while the compressed colorants 310 are repulsed by the strong electric field formed in a direction toward the recording medium 316 between the induction electrodes 305 and 306 which are set at the ground level and this ejection electrode 302, such that the ejection of the compressed colorants 310 in a form of the ink drop 314 in a direction toward the recording medium 316 can be carried out efficiently. The residual colorants in the recording picture dot formation region 303 after the ink drop ejection are removed and conveyed along with the ink 307 by turning the current conduction to the electromagnet 309 off to eliminate the magnetic field.

It is to be noted here that, the sixteenth to nineteenth embodiments described above concerned with a case of using a three dimensional configuration in which the insulative layer is inserted between the ejection electrode and a pair of the colorant compression electrodes or the induction electrodes, but it is also possible to use a planar configuration in which the ejection electrode and the colorant compression electrodes or the induction electrodes are provided on the same head substrate surface by sandwiching the ejection electrode with a pair of the colorant compression electrodes or the induction electrodes from both sides. In addition, it is also possible to modify the above described sixteenth to nineteenth embodiments such that the ejection electrode is provided as a common electrode while the colorant compression electrodes or the induction electrodes are provided as individual electrodes. Moreover, it is also possible to use a continuous slit on the cover instead of the ink drop ejection holes corresponding to the individual recording picture dots.

Figure 34:
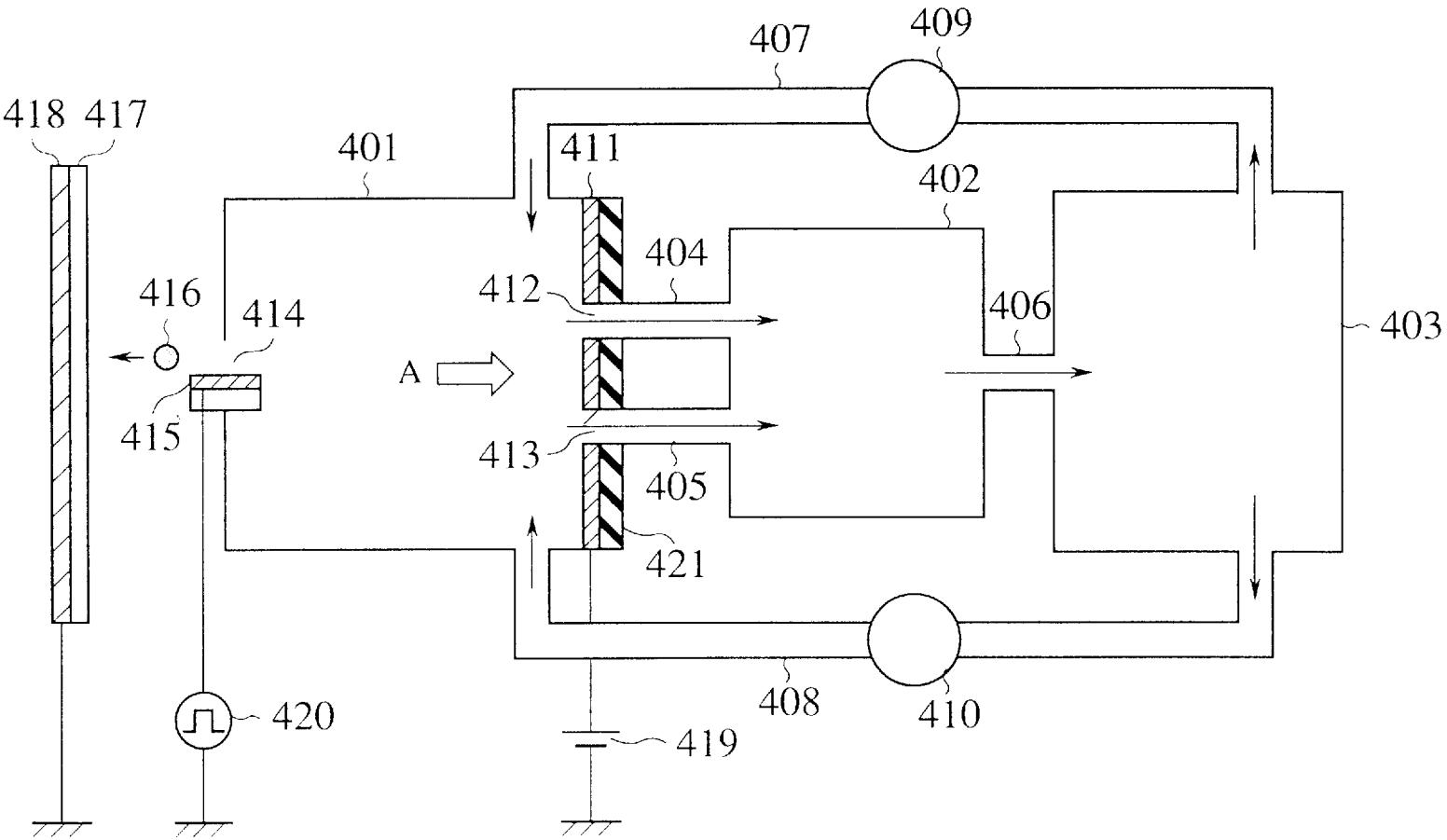
FIG. 34 is a schematic diagram of an ink jet printing apparatus in the twentieth embodiment according to the present invention.
Figure 35:
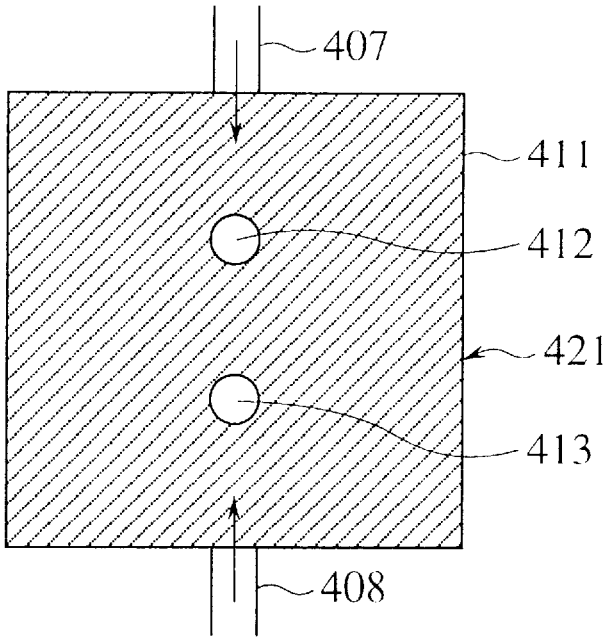
FIG. 35 is an illustration of a colorant compression electrode section in the ink jet printing apparatus of FIG. 34.

Referring now to FIG. 34 and FIG. 35, the twentieth embodiment of an ink jet printing apparatus according to the present invention will be described in detail.

FIG. 34 shows a schematic configuration of the ink jet printing apparatus according to this twentieth embodiment, while FIG. 35 shows a view from a direction of an arrow A indicated in FIG. 34.

This twentieth embodiment concerns with a case in which the ink with the colorants charged in a prescribed polarity are distributed in the solvent is used while the flow of the colorants in this ink is regulated to compress the colorants by means of an electric field produced by a pair of colorant compression electrodes, and the compressed colorants are ejected toward the recording medium by means of an electric field produced by an ejection electrode provided in a direction across the colorant compression electrodes with an insulative layer inserted in between.

In this twentieth embodiment, a main ink chamber 401, a low concentration ink chamber 402, and a high concentration ink chamber 403 are provided on the same plane, where the main ink chamber 401 and the low concentration ink chamber 402 are connected through collection passages 404 and 405 while the low concentration ink chamber 402 and the high concentration ink chamber 403 are connected through a conveyance passage 406. In addition, the main ink chamber 401 and the high concentration ink chamber 403 are connected by an ink circulation mechanism having pumps 409 and 410 through ink supply passages 407 and 408.

The main ink chamber 401 is for compressing and ejecting the colorants in the supplied ink, in which a colorant compression electrode 411 is provided on one inner wall surface at the low concentration ink chamber 402 side, while an ejection electrode 415 is provided at an ink drop ejection hole 414 provided on another inner wall surface opposite to said one inner wall surface.

The colorant compression electrode 411 is formed on an insulative substrate 421 provided on said one inner wall surface of the main ink chamber 401. This insulative substrate 421 and the colorant compression electrode 411 formed thereon have have ink collection holes 412 and 413 as entrances of the collection passages 404 and 405 connecting the main ink chamber 401 and the low concentration ink chamber 402, such that the colorant compression electrode 411 covers the insulative substrate 421 except for areas of these ink collection holes 412 and 413, as shown in FIG. 35.

With this configuration of FIG. 34, the ink jet printing apparatus of this twentieth embodiment operates as follows.

Here, the ink to be used in this twentieth embodiment is formed by an ink solvent made of a kerosene or isoparaffin which is a kind of a petroleum with over $10^{-8}$ ωm of insulativeness in which positively charged colorants made by mixing pigments with charge control agents and binders are colloidally distributed and floating. Here, the colorants may be charged negatively if desired, and in such a case the polarity of the voltages to be applied to the ejection electrode 415 and the colorant compression electrode 411 should be reversed.

This ink having positively charged colorants is supplied from the high concentration ink chamber 403 through the ink supply passages 407 and 408 to the main ink chamber 401 by means of positive pressures applied by the pumps 409 and 410. In this state, when the positive voltage in the same polarity as the charged colorants of about DC 1.0 kV, for example, is applied from the colorant compression electrode 411 by a colorant compression voltage source 419, the positively charged colorants are compressed by being moved away from the colorant compression electrode 411 due to the electric field produced by the colorant compression electrode 411, i.e., by means of the electrostatic repulsive force. Consequently, the ink in the main ink chamber 401 is set in a high colorant concentration state at positions away from the colorant compression electrode 411 such that the compressed colorants are gathered in a vicinity of the ejection electrode 415.

Next, when the pulsed signal voltage of about 500 V for example according to the image signal is applied from a signal voltage source 420 to the ejection electrode 415 at a timing for forming the picture dot, the compressed colorants existing in a vicinity of the ejection electrode 415 are ejected toward a recording medium 417 in a form of an ink drop 416 from the ink drop ejection hole 414 due to the electric field produced by the ejection electrode 415.

The recording medium 417 is a plain paper for example, and on its back side, a facing electrode 418 which also functions as a platen is provided. This facing electrode 418 is set at the ground level so as to stabilize the ejection of the colorants in a form of the ink drop 416. In this manner, the image is printed on the recording medium 417.

On the other hand, the ink in a vicinity of the colorant compression electrode 411 in the main ink chamber 401 which has a reduced colorant concentration as the colorants are moved to a vicinity of the ejection electrode 415 is collected from the ink collection holes 412 and 413 formed on the colorant compression electrode 411 through the collection passages 404 and 405, and ejected to the low concentration ink chamber 402 where it is temporarily stored. The ink with a very low colorant concentration and a majority of the ink solvent in the low concentration ink chamber 402 is then conveyed through the conveyance passage 406 to the high concentration ink chamber 403 which contains a large amount of colorants, and then dissolved into the ink in the high concentration ink chamber 403 so as to produce the ink with the same level of the colorant concentration as the ink in the main ink chamber 401. This ink in the high concentration ink chamber 403 is then supplied through the ink supply passages 407 and 408 to the main ink chamber 401 by means of positive pressures applied by the pumps 409 and 410 as described above. Here, the ink in the main ink chamber 401 is maintained at a constant pressure by means of the pumps 409 and 410.

It is to be noted that the above described configuration of FIG. 34 has two ink collection holes, two collection passages, and two ink supply passages, but a number of each of these elements is arbitrary, and can be one or more than two, if desired.

Figure 36:
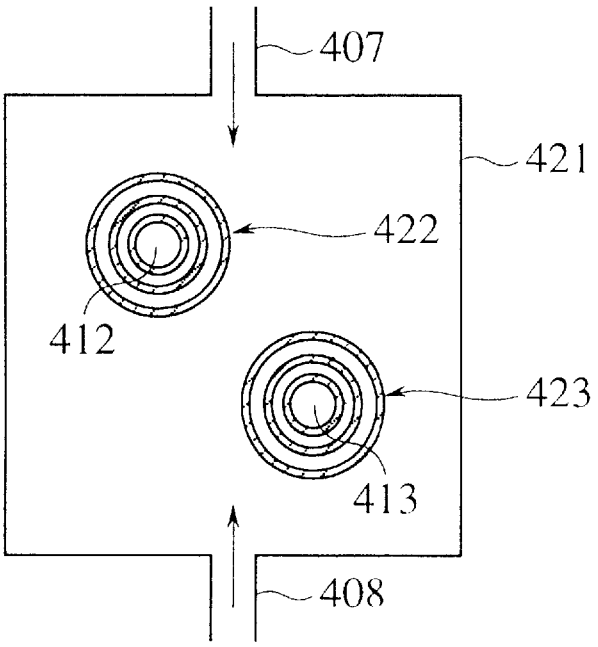
FIG. 36 is an illustration of a colorant compression electrode section in the twenty-first embodiment of an ink jet printing apparatus according to the present invention.

Referring now to FIG. 36, the twenty-first embodiment of an ink jet printing apparatus according to the present invention will be described in detail.

FIG. 36 shows a view of the colorant compression electrodes in this twenty-first embodiment, from the same direction as that of an arrow A indicated in FIG. 34 described above, which are to be used in a configuration similar to that of the above described twentieth embodiment.

As shown in FIG. 36, in this twenty-first embodiment, the colorant compression electrodes 422 and 423 are provided in forms of concentric circles surrounding the ink collection holes 412 and 413. In other words, instead of a plane electrode covering the area other than those of the ink collection holes 412 and 413 used in the above described twentieth embodiment, the colorant compression electrodes 422 and 423 of this twenty-first embodiment comprise a plurality of line electrodes in circular shapes with different radii. The other features of this twenty-first embodiment are substantially the same as the twentieth embodiment described above.

It is to be noted that the above described configuration of FIG. 36 has two colorant compression electrodes, but a number of colorant compression electrodes is arbitrary, and can be one or more than two, if desired. Also, in the above described configuration of FIG. 36, each colorant compression electrode is formed by triple concentric circular shaped line electrodes, but it may be formed by double or more than triple concentric circular shaped line electrodes, or even a single circular shaped line electrodes, if desired.

In this twenty-first embodiment, just as in the twentieth embodiment described above, by applying the voltage in the same polarity as the charged colorants to the colorant compression electrodes 422 and 423 to move the charged colorants away from the colorant compression electrodes 422 and 423 by means of the electrostatic repulsive force, it is possible to compress the ink in a vicinity of the ejection electrode 415 such that the ink drop can be ejected toward the recording medium by means of the ejection electrode.

In addition, in this twenty-first embodiment, the colorants in the ink around the ink collection holes 412 and 413 can be moved away from the colorant compression electrodes 422 and 423 by means of the electrostatic repulsive force efficiently, by using the colorant compression electrodes 422 and 423 which are provided only around the ink collection holes 412 and 413, so that it is also possible to prevent the ink collection holes 412 and 413 from being choked by the colorants staying in a vicinity of the ink collection holes 412 and 413.

Referring now to FIGS. 37A to 37C and FIGS. 38A to 38C, the twenty-second embodiment of an ink jet printing apparatus according to the present invention will be described in detail.

Figure 37A:
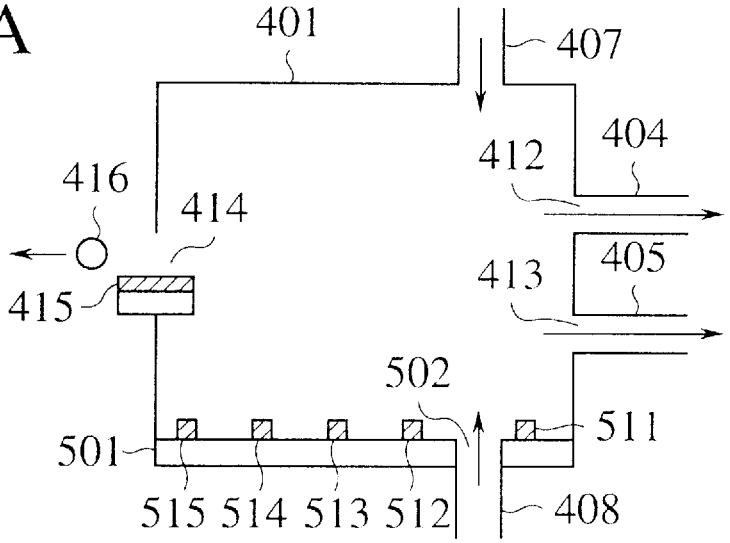
FIG. 37A is a schematic diagram of a part of an ink jet printing apparatus in the twenty-second embodiment according to the present invention.
Figure 37B:
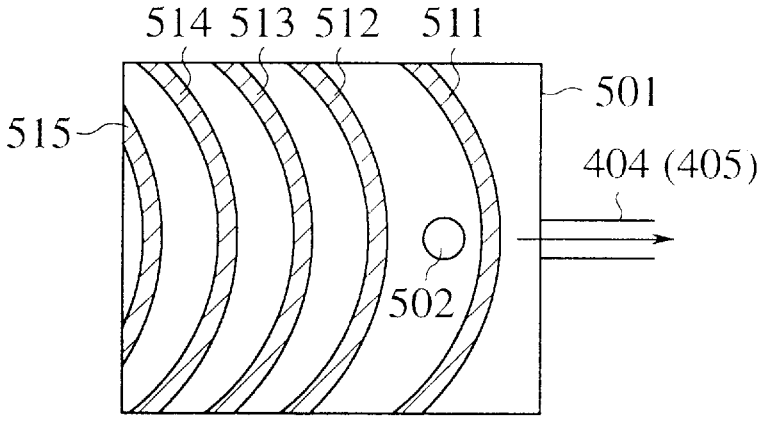
FIGS. 37B and 37C are illustrations of two possible configurations for a colorant compression electrode section in the ink jet printing apparatus of FIG. 37A.
Figure 37C:
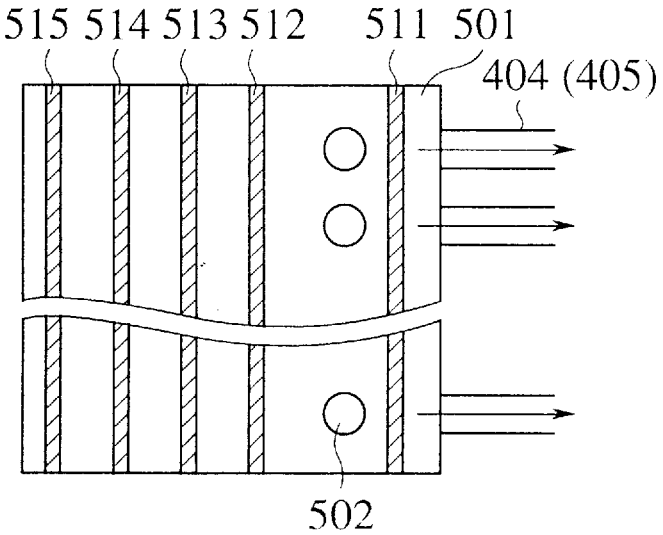

FIGS. 37A to 37C show a configuration of the colorant compression electrodes in this twenty-second embodiment, which are to be used in the ink jet printing apparatus similar to that of the above described twentieth embodiment, where FIG. 37A shows a cross sectional view of the main ink chamber 401, FIG. 37B shows a top plan view of a bottom surface of the main ink chamber 401 in a case of a single head configuration using a single ink drop ejection hole 414, and FIG. 37C shows a top plan view of a bottom surface of the main ink chamber 401 in a case of a multi-head configuration using a plurality of ink drop ejection holes 414 which are arranged in a direction perpendicular to the cross section shown in FIG. 37A.

In this twenty-second embodiment, a plurality of colorant compression electrodes 511 to 515 are arranged on an insulative substrate 501 provided on a bottom surface of the main ink chamber 401 and having one or more ink supply holes 502, along a direction from the ink collection holes 412 and 413 to the ejection electrode 415. As for the shape of these colorant compression electrodes 511 to 515, it is preferable to use arc shapes with appropriate radii of curvature around the ejection electrode 415 in a case of a single head configuration as shown in FIG. 37B, and it is preferable to use parallel straight line shapes in a case of a multi-head configuration as shown in FIG. 37C. The other features of this twenty-second embodiment are substantially the same as the twentieth embodiment described above.

Figure 38A:
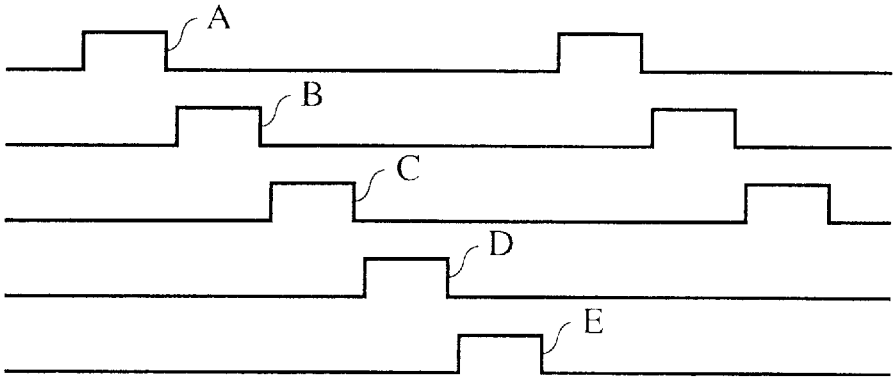
FIGS. 38A, 38B, and 38C are timing charts for three possible patterns of voltages to be applied to colorant compression electrodes in the ink jet printing apparatus of FIG. 37A.
Figure 38B:
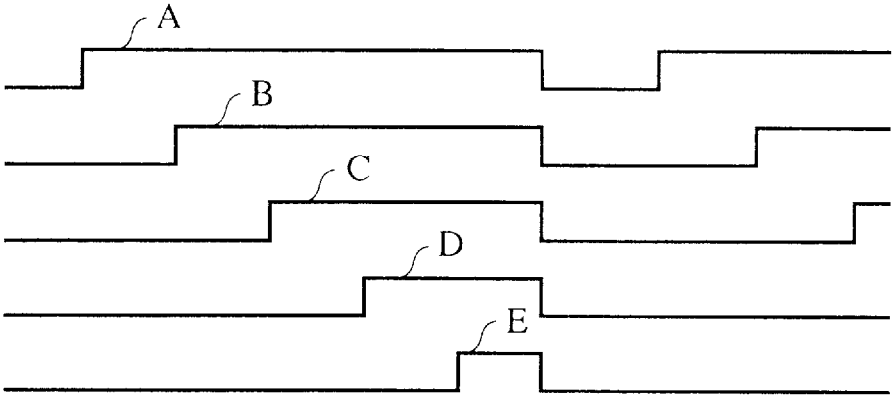
Figure 38C:
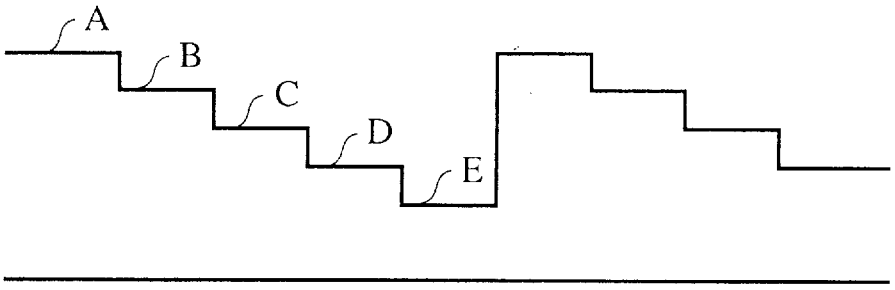

FIGS. 38A to 38C show various examples of the voltage waveforms to be applied to the colorant compression electrodes 511 to 515 in this twenty-second embodiment, where A, B, C, D, and E indicate the voltage waveforms to be applied to the colorant compression electrodes, 511, 512, 513, 514, and 515, respectively.

FIG. 38A is showing a case of applying the pulsed voltages with the same pulse width at sequentially displaced timings from the colorant compression electrode 511 which is farthest from the ejection electrode 415 to the colorant compression electrode 515 which is closest to the ejection electrode 415.

FIG. 38B is showing a case of applying the pulsed voltages with the same fall timing and sequentially displaced rise timings from the colorant compression electrode 511 which is farthest from the ejection electrode 415 to the colorant compression electrode 515 which is closest to the ejection electrode 415.

FIG. 38C is showing a case of applying the pulsed voltages with sequentially decreased magnitude from the colorant compression electrode 511 which is farthest from the ejection electrode 415 to the colorant compression electrode 515 which is closest to the ejection electrode 415. In any of these cases shown in FIGS. 38A to 38C, the polarity of the voltages to be applied is the same as that of the charged colorants in the ink.

When such voltages are applied at the sequentially displaced timings or in sequentially changed magnitudes, the colorants in the ink within the main ink chamber 401 can be moved toward the ejection electrode 415 by means of the electrostatic forces sequentially received from the colorant compression electrodes 511 to 515 while being compressed at the same time, so that the compressed colorants can be gathered in a vicinity of the ejection electrode 415.

Then, when the pulsed signal voltage of about 500 V, for example, according to the image signal is applied to the ejection electrode 415 at a timing for forming the picture dot, the compressed colorants existing in a vicinity of the ejection electrode 415 are ejected toward a recording medium in a form of an ink drop from the ink drop ejection hole 414 due to the electric field produced by the ejection electrode 415. In this manner, the image is printed on the recording medium, just as in the above described twentieth embodiment. Here, the other operations in this twenty-second embodiments are substantially the same as the twentieth embodiment described above.

According to this twenty-second embodiment, it becomes possible to compress the colorants more effectively compared with the twentieth and twenty-first embodiments described above, as the colorants are compressed while being moved toward the ejection electrode 415 by means of a plurality of colorant compression electrodes 511 to 515.

Figure 39:
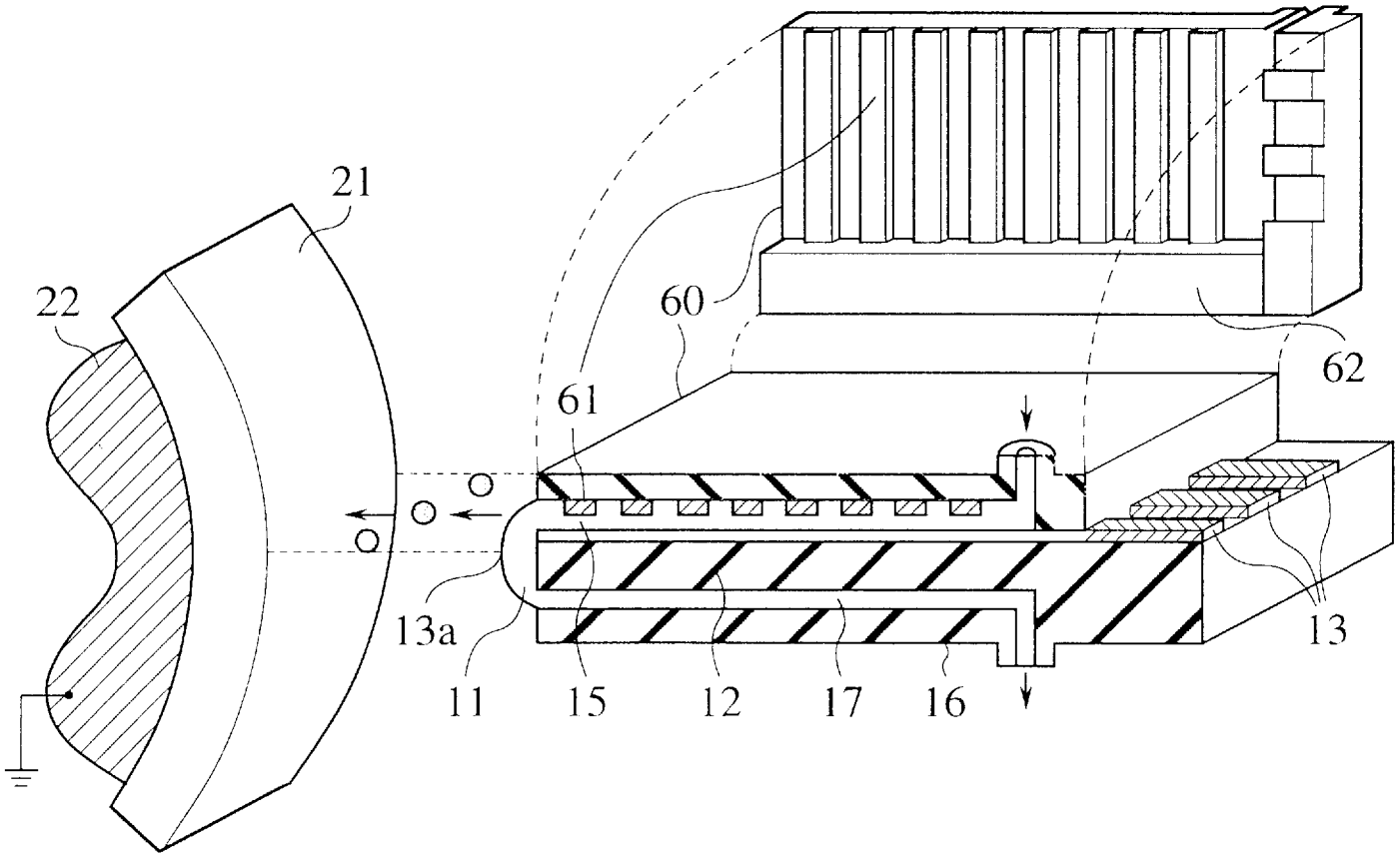
FIG. 39 is a schematic diagram of an ink jet printing apparatus in the twenty-third embodiment according to the present invention.

Referring now to FIG. 39, the twenty-third embodiment of an ink jet printing apparatus according to the present invention will be described in detail.

FIG. 39 shows a schematic configuration of the ink jet printing apparatus in this twenty-third embodiment, in which a plurality of parallel stripe shaped individual electrodes constituting a principal electrode array 13 to which the signal voltages are to be applied for the purpose of ejecting the ink 11 are arranged on an upper surface of the head substrate 12. It is to be noted here that the shape of the principal electrode array 13 is not necessarily limited to the stripe shape, and can be a matrix shape formed by a plurality of dot shaped electrodes, a shape formed by arranging a number of curved electrodes, or any other suitable shape.

Then, over this principal electrode array 13 formed on the head substrate 12, an auxiliary substrate 60 in a form of a flat plate parallel to the head substrate 12 for forming an ink supply passage 15 with the head substrate 12 is provided with spacers (not shown) of about 300 $\mu$m thickness inserted therebetween, and a plurality of stripe shaped electrodes constituting an auxiliary electrode array 61 are arranged perpendicularly to the principal electrode array 13 on an inner surface of this auxiliary substrate 60 facing toward the head substrate 12. In FIG. 39, an expanded view of the auxiliary substrate 60 and an auxiliary electrode array 61 are also depicted. The auxiliary substrate 60 also has an auxiliary electrode driver circuit 62 for driving the auxiliary electrode array 61 on a part of its inner surface not covering over the principal electrode array 13.

The ink 11 is supplied to the ink supply passage 15 from a right side in FIG. 39 by means of an ink circulation mechanism having a pump (not shown). Here, the ink 11 is formed by a solvent with over $10^{-8}$ ωcm of insulativeness in which positively charged colorants are colloidally distributed and floating along with charge control agents and binders. The ink 11 which supplied to the ink supply passage 15 flows over the principal electrode array 13 along the ink supply passage 15, reaches to a colorant ejection point 13*a* in a form of an opening at a tip end of the head substrate 12 and the auxiliary substrate 60, and then collected to the ink circulation mechanism through an ink collection passage 17 formed between a lower surface of the head substrate 12 and a lower cover 16.

Now, the operation in this configuration of FIG. 39 will be described with references to FIGS. 40A t0 40C ad FIGS. 41A to 41D.

Figure 40A:
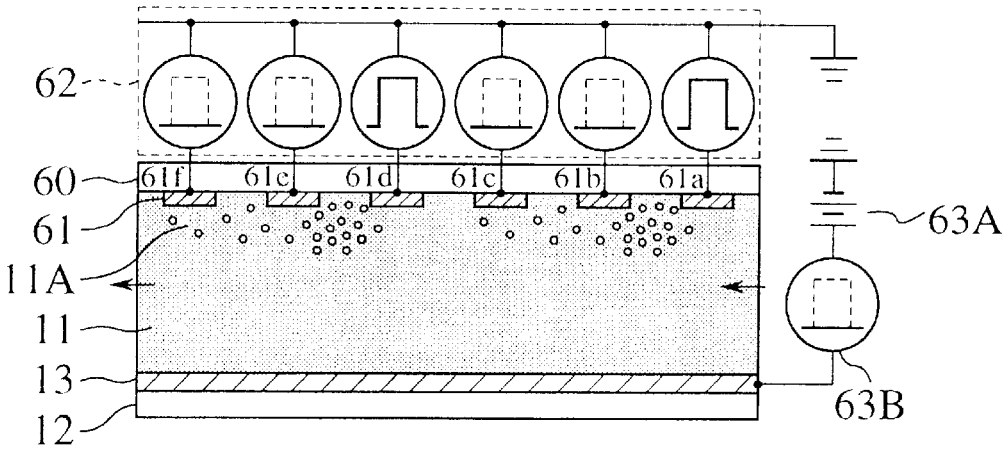
FIGS. 40A, 40B, and 40C are cross sectional views of a part of the printing head section in the ink jet printing apparatus of FIG. 39 for explaining its operation.
Figure 40B:
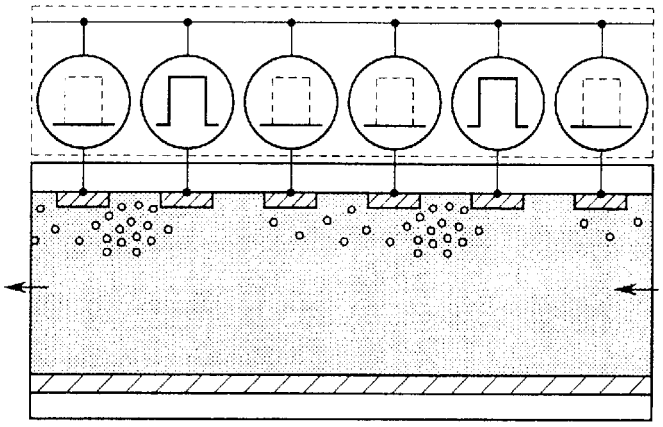
Figure 40C:
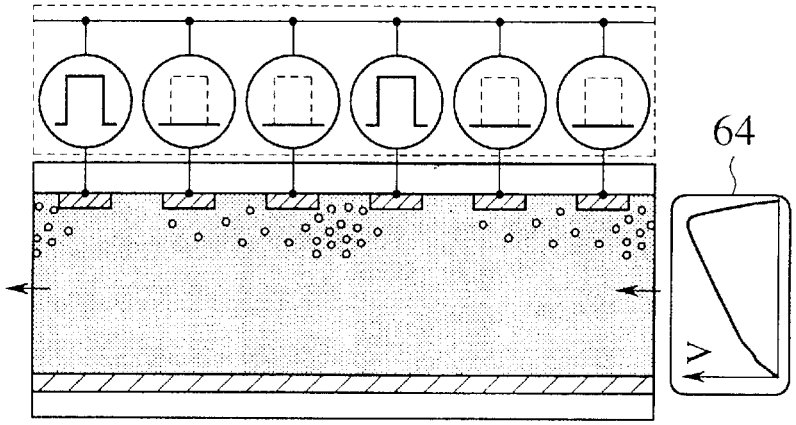

FIGS. 40A to 40C show a part of the ink supply passage 15 in the configuration of FIG. 39 in enlargement in which the movement of the colorants 11A in the ink 11 is depicted in conjunction with the operation of the auxiliary electrode driver circuit 62. Here, a bias voltage 63A of DC 1.5 kV, for example, is constantly applied to all the individual electrodes of the principal electrode array 13, and at a time of printing, a pulsed voltage 63B of 500 V for an ON state for example is superposed thereon as a signal voltage at selected individual electrodes of the principal electrode array 13 according to an image signal.

In this manner, the principal electrode array 13 is constantly applied with the voltage over 1.5 kV, so that the positively charged colorants 11A which are colloidally floating in the ink 11 within the ink supply passage 15 over that principal electrode array 13 are moved in a compressed state resulting from being pushed against an inner surface of the auxiliary substrate 60 by means of the electrostatic repulsive force exerted by the principal electrode array 13, as shown in FIGS. 40A to 40C. Note that FIG. 40C also shows a velocity distribution 64 in the ink supply passage in this case, which will be explained in the later embodiment.

Figure 41A:
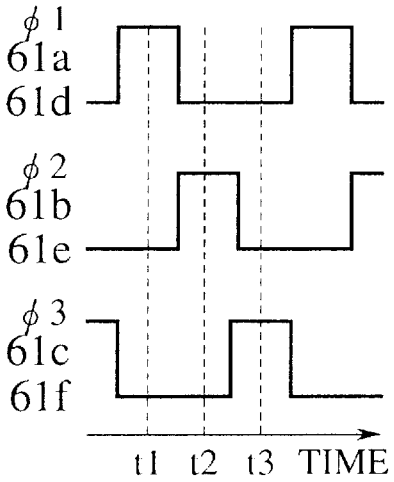
FIGS. 41A, 41B, 41C, and 41D are timing charts for four possible patterns of voltages to be applied to auxiliary electrodes in the ink jet printing apparatus of FIG. 39.

On the other hand, the electrodes 16*a*, 16*b*, 16*c*, 16*d*, 16*e*, and 16*f* constituting the auxiliary electrode array 61 are applied with three phase voltage pulse sequence shown in FIG. 41A, which is phase shift controlled to sequentially shift voltage application positions toward the opening at the tip end of the printing head as time elapses, by the auxiliary electrode driver circuit 62. Here, the phase velocity and the voltage value in this voltage pulse sequence are to be determined according to the electrical mobility of the colorants 11A in the ink 11, the repetition interval in the auxiliary electrode array 61, and a required amount of colorants to be conveyed to the colorant ejection point 13*a*, but in practice, these values can be derived easily by an experiment using the voltage and the pulse application period as parameters to determine a condition under which the ink flows most efficiently.

It should be noted, however, that there is a limitation for the voltage value of the voltage pulse sequence to be applied to the auxiliary electrode array 61 in that it must be set lower than the voltage applied to the principal electrode array 13 in order not to interfere with the effect for compressing the colorants 11A by means of the electrostatic force due to the voltage application to the principal electrode array 13, so that it is necessary for the voltage value of the voltage pulse sequence to be less than 1.5 kV in this embodiment, and in view of the fact that the auxiliary electrode driver circuit 62 is to be realized by an IC, it is preferable for the voltage value of the voltage pulse sequence to be less than several tens V.

When the voltage pulse sequence in which the voltage value and the phase velocity are optimized in this manner is applied to the auxiliary electrode array 61, the charged colorants 11A in the ink 11 within the ink supply passage 15 which have moved to the inner surface of the auxiliary substrate 60 are conveyed toward the colorant ejection point 13*a* in a manner of sliding along the inner surface of the auxiliary substrate 60 at the same velocity as the phase velocity of the voltage pulse sequence.

Namely, at a timing t1 shown in FIG. 41A, as shown in FIG. 40A, the voltage pulses in the phase ϕ1 are applied to the auxiliary electrodes 61*a* and 61*d*, so that the positively charged colorants existing on the left side of these auxiliary electrodes 61*a* and 61*d* receive the electrostatic repulsive force from the auxiliary electrodes 61*a* and 61*d* which pushes them to the left, and consequently move to the left by means of the electrophoresis.

Then, at a timing t2 at which the colorants that have moved to the left by means of the electrostatic force from the auxiliary electrodes 61*a* and 61*d* are just passing over the left neighbor auxiliary electrodes 61*b* and 61*e*, as shown in FIG. 40B, the voltage pulses in the phase ϕ2 are applied to the auxiliary electrodes 61*b* and 61*e*, so that these colorants receive the electrostatic repulsive force from the auxiliary electrodes 61*b* and 61*e* this time, and consequently move further to the left.

Then, at a timing t3 at which the colorants that have moved to the left by means of the electrostatic force from the auxiliary electrodes 61*b* and 61*e* are just passing over the left neighbor auxiliary electrodes 61*c* and 61*f*, as shown in FIG. 40C, the voltage pulses in the phase ϕ3 are applied to the auxiliary electrodes 61*c* and 61*f*, so that these colorants receive the electrostatic repulsive force from the auxiliary electrodes 61*c* and 61*f* this time, and consequently move further to the left.

In this manner, the colorants 11A which have moved in a vicinity of the auxiliary substrate 60 are continuously moved toward the colorant ejection point 13*a* at the same velocity as the phase velocity of the voltage pulse sequence by means of the electrophoresis resulting from the sequentially received electrostatic repulsive forces from the auxiliary electrodes 61*a* to 61*f* of the auxiliary electrode array 16 driven by the three phase voltage pulse sequence.

Here, if there are colorants on the right side of the auxiliary electrodes 61*a* and 61*d* when the voltage pulses are applied to the auxiliary electrodes 61*a* and 61*d*, these colorants would receive the electrostatic force toward the right, i.e., toward a direction for retreating from the colorant ejection point 13*a* rather than a direction pointing to the colorant ejection point 13*a*. Now, as should be apparent from FIG. 41A, when the auxiliary electrode array 61 is driven by the three phase voltage pulse sequence, a backward phase velocity is twice as fast as a forward phase velocity.

Namely, the colorants which existed on the right side of the auxiliary electrodes 61*a* and 61*d* when the voltage pulses in the phase ϕ1 are applied to the auxiliary electrodes 61*a* and 61*d* at the timing t1 in FIG. 41A receive the electrostatic force to the backward direction and consequently move backward to the right, and then move further backward to the right in response to the voltage pulses in the phase ϕ2 applied to the auxiliary electrodes 16*b* and 16*e* at the next timing t2, so that between the timings t1 and t2, these colorants are going to move backward to the right for a distance twice as much as that for which the other colorants can be moved forward between the timings t1 and t2, which means that the backward phase velocity is twice as fast as the forward phase velocity.

Consequently, by setting the voltage value and the period of the voltage pulse sequence such that this twice faster phase velocity falls outside of a response capable range for the electrophoresis of the colorants which is determined by the electrical mobility of the colorants, it is possible to prevent the colorants 11A from moving in a backward direction.

The kinetic energy produced by the movement of the colorants 11A are transmitted by viscosity resistance of the ink solvent to a liquid portion with little or no colorant forming a layer shaped flow at a region distanced from the auxiliary substrate 60, so that the stationary state in which the entire ink 11 within the ink supply passage 15 flows at a constant rate of flow can be realized eventually.

When the colorants 11A are conveyed to the colorant ejection point 13*a* at the tip end of the principal electrode array 13, the signal voltage is applied in superposition to the bias voltage to the principal electrode array 13 at that timing, such that the colorants are ejected into the air toward a facing electrode 22 as the force exerted by the strong electric field resulting from this signal voltage application on the charged colorants overcome the surface tension of the ink 11, and the picture dots are formed on a recording medium 21 provided over the facing electrode 22.

On the other hand, the residual colorants which are present at the colorant ejection point 13*a* but not ejected or the colorants which are not present at the colorant ejection point 13*a* at a timing of the signal voltage application to the principal electrode array 13 are turned from the colorant ejection point 13*a* to the ink collection passage 17 along with the solvent of the ink 11, and collected through the ink collection passage 17.

According to this twenty-third embodiment, the following effects can be achieved.

Namely, in the previous embodiments in which the ink is to be poured into the thin ink supply passage of about 300 μm by means of a pressure by a mechanical pressurizing mechanism such as a pump, because of the resistance due to the viscosity friction, the local flow speed decrease or pressure lowering can be caused at a portion distanced from the ink supply port or a portion near the wall of the ink supply passage, such that the ink flow becomes inhomogeneous and a difference in the amount of ink supply from one location to another tends to cause the irregularity in the printing concentration.

In contrast, in this twenty-third embodiment, by means of the auxiliary electrode array 61 provided on the auxiliary substrate 60, a kind of electrostatic pump which is uniformly distributed over the entire ink supply passage 15 is formed, and the colorants in the ink 11 are conveyed toward the colorant ejection point 13*a* by maintaining a state of being uniformly distributed from location to another at the colorant ejection point 13*a*, so that the above described problems can be resolved and it becomes possible to obtain a satisfactory printed image without a concentration irregularity even in a case of using an elongated line scanning type printing head.

In addition, even at a portion near the tip end of the ink supply passage 15 functioning as a slit shaped nozzle formed by the head substrate 12 and the principal electrode array 13, a relatively strong electrostatic force is exerted at short distance between the auxiliary electrode array 61 and the ink 11 by the electric field due to the voltage applied to the auxiliary electrode array 61, so that this force functions as a resistive force against the physical impact to prevent the leakage of the ink 11 due to the physical impact.

It is to be noted that the above described twenty-third embodiment can be modified in various manners as follows.

Figure 41B:
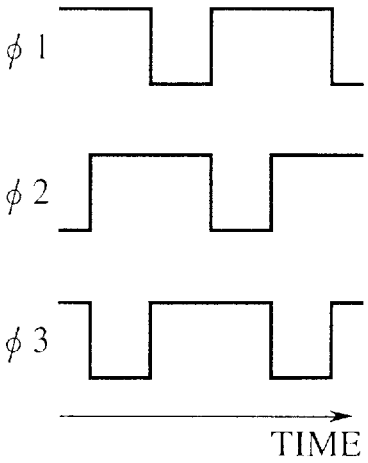

First, in the above description, in the three phase driving of the auxiliary electrode array 61, the voltage pulse in only one phase among the three phases $\phi 1$, $\phi 2$, and $\phi 3$ has been applied to the auxiliary electrode array 61 at one time, but it is also possible to include a period at which the voltage pulses in a plurality of phases are applied to a plurality of auxiliary electrodes simultaneously. For instance, as shown in FIG. 41B, the voltage pulses in two phases among the three phases $\phi 1$, $\phi 2$, and $\phi 3$ can be applied to a plurality of auxiliary electrodes simultaneously in each period.

Figure 41C:
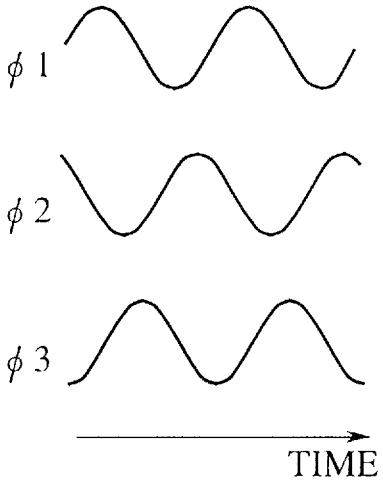

Also, in the above description, the pulse waveform has been used as the voltage waveform to be applied to the auxiliary electrode array 61, but instead of this pulse waveform, the sinusoidal waveforms in different phases as shown in FIG. 41C can be used.

Figure 41D:
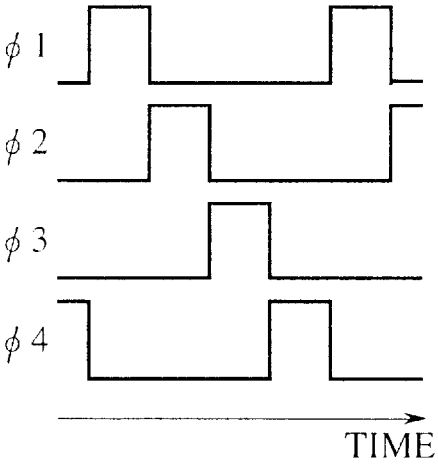

Moreover, in the above description, a number of phases N (a phase division number) in the multi-phase driving of the auxiliary electrode array 61 has been set to be 3, but this number N can be any number greater than or equal to 2. Namely, it suffices for this number N to be an integer $N \geqq 2$. For instance, in a case of N=4, the timings for the voltage application to the auxiliary electrode array 61 appear as shown in FIG. 41D.

In general, a ratio of the phase velocity in the backward direction and the phase velocity in the forward direction is $-(N-1)$, so that when the number N becomes greater, the difference between these two phase velocities also becomes greater. However, in a case of N=2, the phase velocity in the backward direction and the phase velocity in the forward direction become equal to each other while they are directed in opposite directions, so that some special measure have to be taken in order to set the forward direction as the conveying direction of the colorants. In the following, this case of N=2, i.e., a case of the two phase driving of the auxiliary electrode array 61 will be described in detail.

Figure 42A:
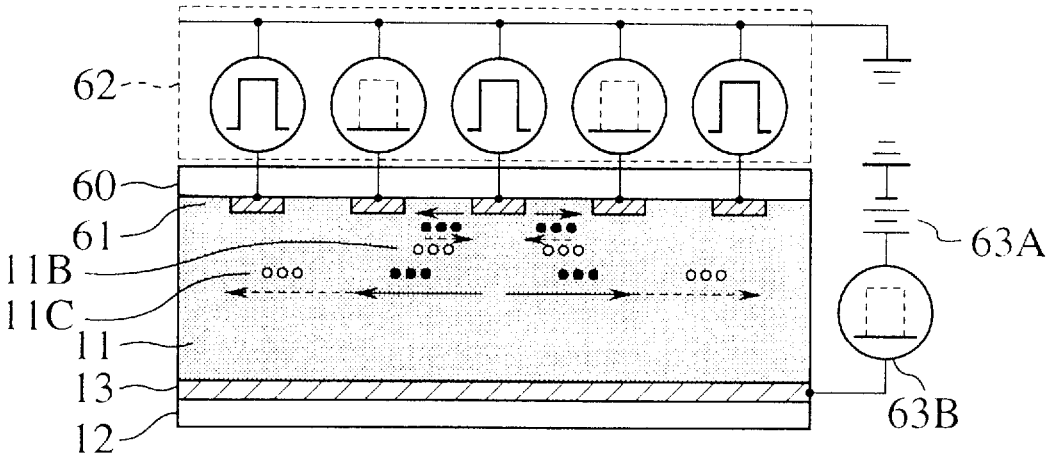
FIGS. 42A and 42B are cross sectional views of a part of the printing head section in one possible modification of the ink jet printing apparatus of FIG. 39 for explaining its operation.
Figure 42B:
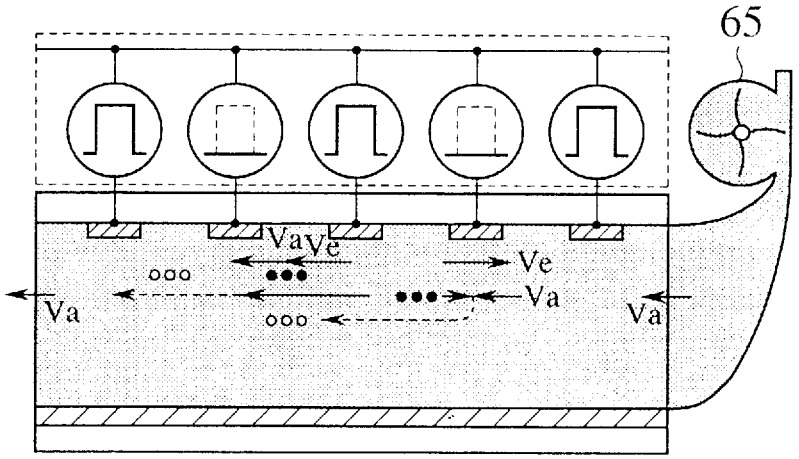

FIGS. 42A and 42B show this case of the two phase driving, where the voltage pulse waveform and the movement of the colorant position in the first phase of the two phase driving are indicated by solid lines, while the voltage pulse waveform and the movement of the colorant position in the second phase of the two phase driving are indicated by dashed lines, and the representative colorant positions in the first phase are indicated by black dots while the representative colorant positions in the second phase are indicated by white dots.

In this case, as shown in FIG. 42A, the colorants 11B having either a slightly slower moving velocity than the phase velocity given to the auxiliary electrode 61 by the auxiliary electrode driving circuit 62 or a small amount of charge are going to be moved back and forth between two auxiliary electrodes, while the colorants 11C having either a slightly faster moving velocity than the phase velocity given to the auxiliary electrode 61 by the auxiliary electrode driving circuit 62 or a large amount of charge are going to be moved continuously, as many in the left direction as in the right direction. Consequently, when the auxiliary electrode array 61 is simply two phase driven, the direction of the flow of the colorants cannot be fixed.

However, when the flow with a velocity Va in the forward direction is produced in the ink 11 forcefully by the external pressurizing means such as a pump 65 as shown in FIG. 42B, the moving velocity of the colorants in the backward direction becomes a difference (Ve−Va) between the moving velocity Ve due to the electrophoresis and the moving velocity due to the external pressure by the pump 65, while the moving velocity in the forward direction becomes a sum (Ve+Va) of these, so that the velocities of the charged colorants in the same applied electric field become asymmetrical in terms of directions.

Consequently, by setting the phase velocity of the voltage pulse actually applied to the auxiliary electrode array 61 to be equal to a sum (Ve+Va) of the moving velocity Ve due to the electrophoresis of the colorants and the moving velocity Va due to the external pressure by the pump 65, it is possible to produce the electrically controlled uniform flow of the ink 11 in a single direction, i.e., the forward direction, efficiently.

In this manner, by combining the two phase driving with the external pressurizing means such as the pump 65 to make the moving velocities of the ink 11 in the forward direction and the backward direction to be asymmetric, it is possible to fix the conveying direction of the colorants in the ink 11 to be the forward direction, i.e., a direction toward the colorant ejection point 13*a*.

Alternatively, it is also possible to realize the two phase driving of the auxiliary electrode array 61 as follows.

Figure 43A:
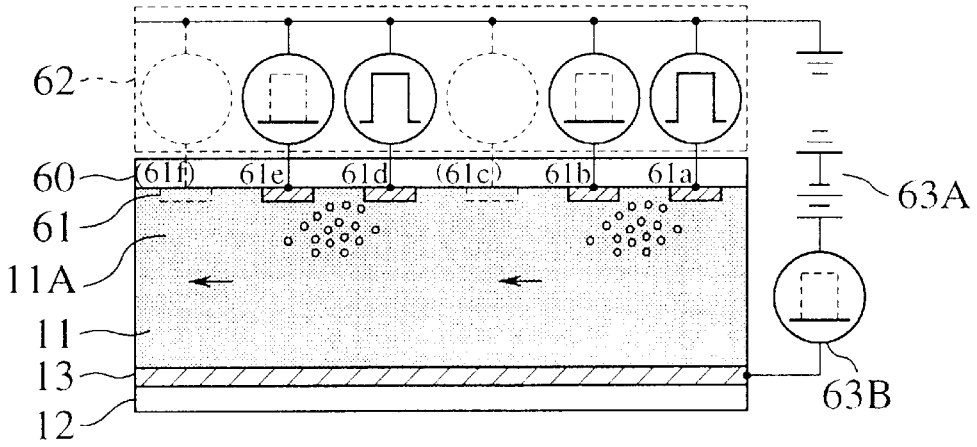
FIGS. 43A, 43B, and 43C are cross sectional views of a part of the printing head section in another possible modification of the ink jet printing apparatus of FIG. 39 for explaining its operation.
Figure 43B:
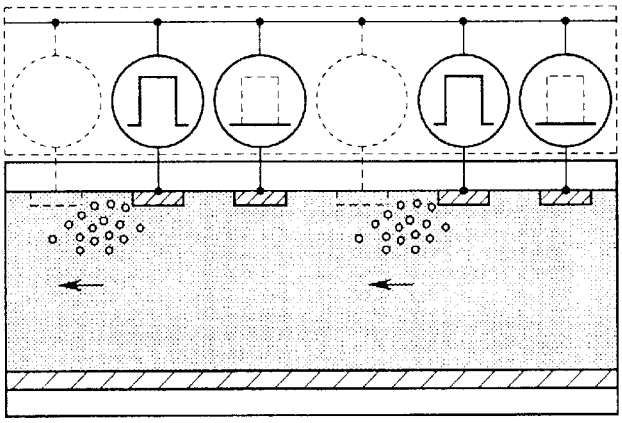
Figure 43C:
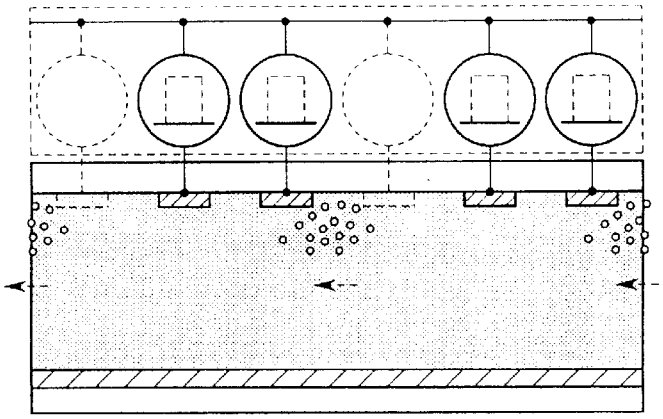

FIGS. 43A, 43B, and 43C show a case in which the auxiliary electrode corresponding to one phase in the three phase driving is omitted, while the voltage pulses to be applied to the other auxiliary electrodes corresponding to the remaining two phases are set to be in the same phase relationship as in a case of the three phase driving, so as to make the forward moving velocity and the backward moving velocity to be asymmetric.

In short, this is a case in which one phase part in the three phase driving is omitted to utilize the movement by the inertial motion of the fluid, so as to realize the two phase driving. Thus, at the timings shown in FIG. 43A and 43B, the electrostatic forces indicated by the solid arrow lines function as the force for moving the colorants, whereas at a timing shown in FIG. 43C, the inertial forces due to the fluid motion including that of the ink solvent indicated by the dashed arrow lines function as the force for moving the colorants.

By realizing the two phase driving in this manner, it is possible to achieve the following advantages.

Namely, in a case of the three phase driving of the auxiliary electrode array 61, the leader wirings for a plurality of auxiliary electrodes which are arranged in stripe shape to constitute the auxiliary electrode array 61 are going to intersect with each other, so that there is a need to adopt a two layer structure for the auxiliary electrode array 61 in which the writing layers are formed on both sides of the insulative layer of the substrate, and this in turn complicates the manufacturing process. In contrast, in a case of using the two phase driving of the auxiliary electrode array 61, there is no need for the leader wirings of the auxiliary electrodes to intersect with each other, so that the auxiliary electrode array 61 can be easily manufactured by the single layer pattern manufacturing process.

In addition, from a point of view of the auxiliary electrode driver circuit 62, a common circuit can be used for more numerous auxiliary electrodes to be driven in the same phase, and it suffices to provide only two driver circuits in correspondence to the two phases altogether, so that it is possible to simplify the configuration of the auxiliary electrode driver circuit 62 in a case of the two phase driving.

Figure 44:
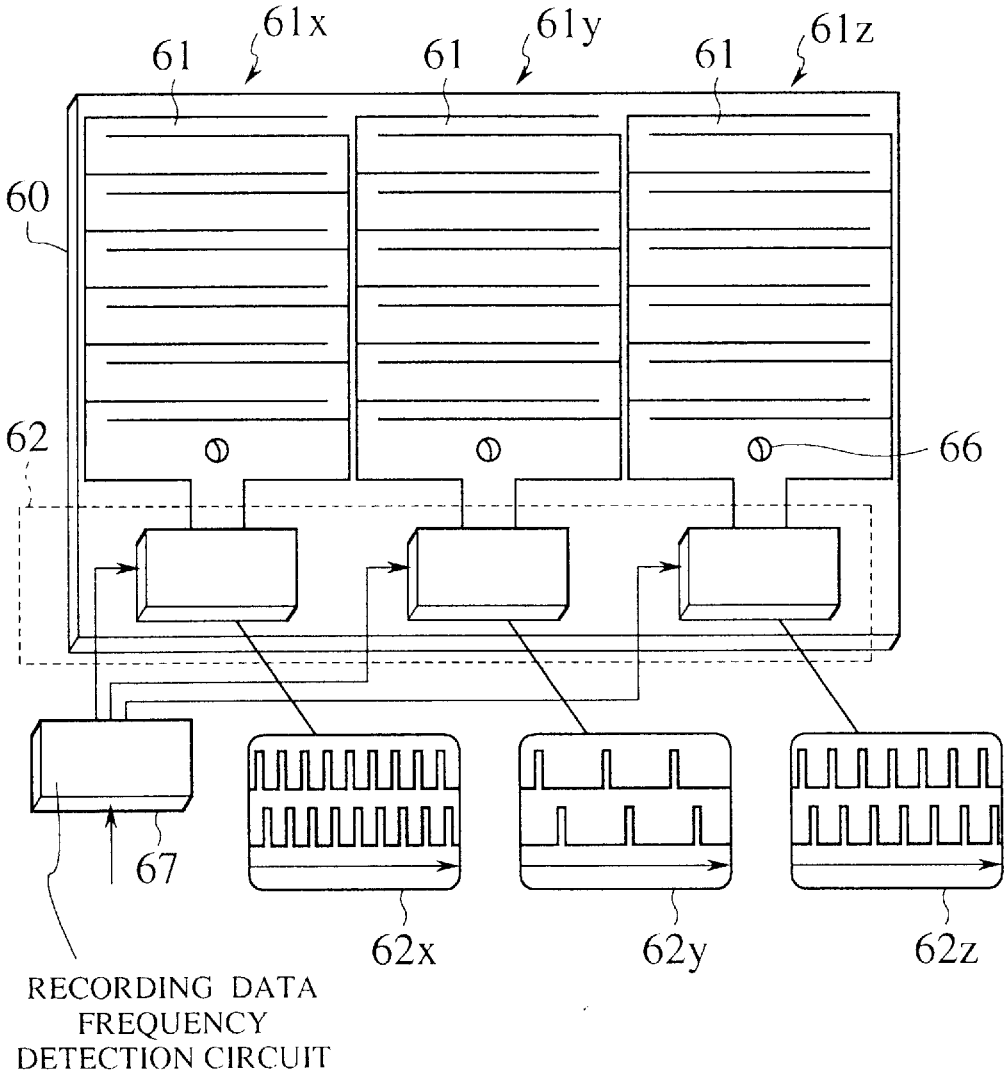
FIG. 44 is an illustration of an auxiliary electrode section in the twenty-fourth embodiment of an ink jet printing apparatus according to the present invention.

Referring now to FIG. 44, the twenty-fourth embodiment of an ink jet printing apparatus according to the present invention will be described in detail.

FIG. 44 shows a configuration of the auxiliary substrate 60, the auxiliary electrode array 61, and the auxiliary electrode driving circuit 62 used in this twenty-fourth embodiment.

In this configuration of FIG. 44, the auxiliary electrode array 61 formed on the inner surface of the auxiliary substrate 60 are divided into a plurality (three in FIG. 44) of auxiliary electrode groups 61*x*, 61*y*, and 61*z*, in correspondence to a plurality (three) of regions dividing the auxiliary substrate 60 in a direction perpendicular to a direction along which the auxiliary electrodes are arranged, and these auxiliary electrode groups 61*x*, 61*y*, and 61*z* are made to be capable of driving or controlling the flow of the ink within the ink supply passage independently from each other. Here, each of the auxiliary electrode groups 61*x*, 61*y*, and 61*z* comprises electrodes arranged at non-uniform intervals, as in a case of the two phase driving described in conjunction with FIGS. 43A to 43C above.

Three sets of the leader wirings from the auxiliary electrode groups 61*x*, 61*y*, and 61*z* are connected with three driver units 62*x*, 62*y*, and 62*z* constituting the auxiliary electrode driver circuit 62, respectively. To this auxiliary electrode driver circuit 62, an output signal from a recording data frequency detection circuit 67 for detecting a frequency of occurrences of significant recording data in each of the three divided regions is entered.

In this configuration of FIG. 44, when the ink is supplied to each divided region through an ink supply hole 66, the phase shift controlled voltage pulses are applied to the auxiliary electrode groups 61*x*, 61*y*, and 61*z*, such that the colorants in the ink are conveyed toward the colorant ejection point which is located on an upper side in FIG. 44, similarly as in the twenty-third embodiment described above.

Here, as indicated in FIG. 44, the driving voltage waveform applied by the driver unit 62*y* to the central auxiliary electrode group 61*y* is set to have a longer period compared with the driving voltage waveforms applied by the driver units 71*x* and 71*z* to the two side auxiliary electrode groups 61*x* and 61*z*. This setting is for adjusting the amount of the ink flow in the central region with the amount of the ink flow in each side region in which the ink flow receives a larger resistance, so as to equalize the amount of conveyed colorants over the entire region of the ink supply passage.

In addition, in FIG. 44, there is also a difference in the periods of the driving voltage waveforms applied by the driver units 62*x* and 62*z* to the side auxiliary electrode groups 61*x* and 61*z*, due to a command from the recording data frequency detection circuit 67. Namely, FIG. 44 shows a case in which the significant recording data occur more frequently in the left side region covered by the auxiliary electrode group 61*x* than the right side region covered by the auxiliary electrode group 61*z*, so that a larger amount of the ink is supplied to the left side region than the right side region by means of the driving voltage waveform setting shown in FIG. 44.

In this manner, by dividing means for conveying the colorants provided by the auxiliary electrode array 61 into a plurality of regions in a direction perpendicular to the direction for conveying the colorants, and making it possible to control the amount of conveyed colorants independently in each region, it becomes possible to compensate not just the difference in the ink flow due to the structure of the ink supply passage, but also the difference in the amount of colorant consumption according to the occurrence frequency of the recording data in each region, so that it becomes possible to realize the satisfactory image printing with even less printing concentration irregularity.

Figure 45:
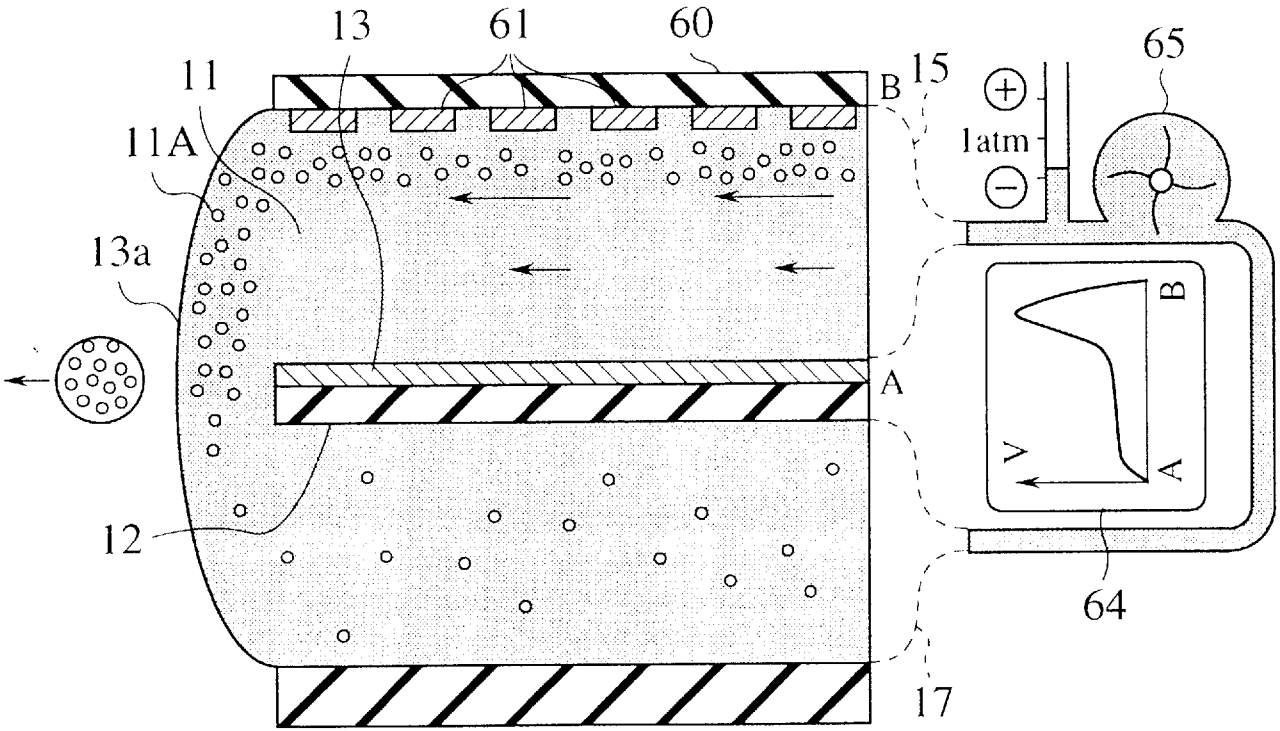
FIG. 45 is a schematic diagram of an ink jet printing apparatus in the twenty-fifth embodiment according to the present invention.

Referring now to FIG. 45, the twenty-fifth embodiment of an ink jet printing apparatus according to the present invention will be described in detail.

FIG. 45 shows a schematic configuration of the ink jet printing apparatus in this twenty-fifth embodiment, where the printing head section with a portion in a vicinity of the colorant ejection point 13*a* shown in enlargement is substantially the same as in the twenty-third embodiment described above. In this twenty-fifth embodiment, there is provided a pump 65 for applying a negative pressure to the ink 11 supplied through the ink supply passage 15. Here, this pump 65 would have been unnecessary if it is only required to convey the colorants 11A in the ink 11 to the colorant ejection point 13*a* at the tip end of the printing head section, because this function is furnished by the auxiliary electrode array 61. However, in this twenty-fifth embodiment, the pump 65 is utilized for a different purpose as follows.

Namely, as indicated by the velocity distribution 64 in FIG. 40C described above, the auxiliary electrode array 61 electrostatically drives only the colorants 11A which are charged particles directly, and the other components of the ink 11 such as the solvent are moved by receiving the force due to the viscosity friction from the moving colorants 11A, so that there is a relative velocity difference between the colorants 11A and the other components of the ink 11. In this twenty-fifth embodiment, this fact is utilized to make this velocity difference even larger by means of the pump 65 which applies the negative pressure for the purpose of slowing down the flow of the ink 11 as a whole, and not for the purpose of conveying the colorants 11A.

Here, even when the ink 11 is slowed down by the negative pressure applied by the pump 65, the velocity of the colorants 11A which are conveyed by means of the auxiliary electrode array 61 is not affected very much, so that the effect of the pump 65 appears in primarily in the slow down of the velocity of a portion of the ink 11 which is distanced from the auxiliary electrode array 61 and which contains little or no colorants, as indicated by the velocity distribution 64 shown in FIG. 45.

Thus, according to this twenty-fifth embodiment, it is possible to reduce an amount of flow of the ink 11 as a whole so as to reduce a possibility for the ink 11 to be exposed to the air directly. Consequently, it is possible to prevent the introduction of the impurities, the evaporation of the ink solvent, and the degeneration of the ink 11, such that it is possible to elongate the life cycle of the ink solvent.

Figure 46:
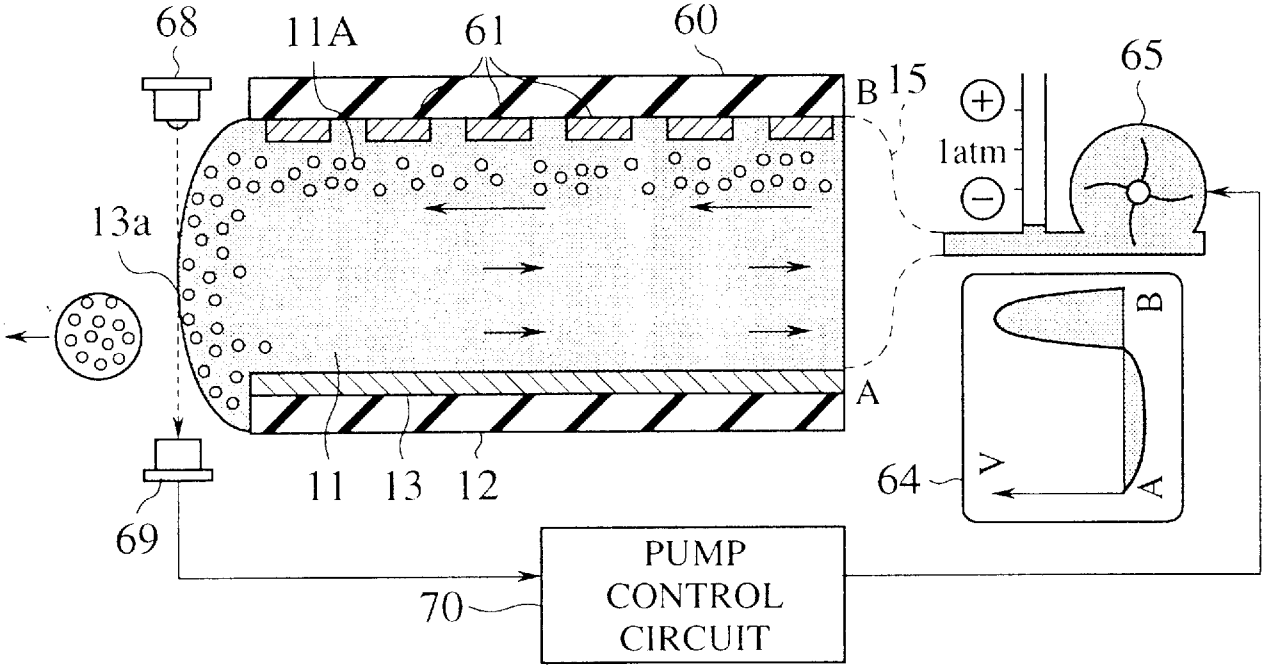
FIG. 46 is a schematic diagram of an ink jet printing apparatus in the twenty-sixth embodiment according to the present invention.

Referring now to FIG. 46, the twenty-sixth embodiment of an ink jet printing apparatus according to the present invention will be described in detail.

FIG. 46 shows a schematic configuration of the ink jet printing apparatus in this twenty-sixth embodiment. In this twenty-sixth embodiment, the negative pressure to be applied to the ink 11 by the pump 65 is made larger than that used in the twenty-fifth embodiment described above, such that the ink 11 is prevented from turning around the colorant ejection point 13*a* at the tip end of the printing head section. Thus, in this twenty-sixth embodiment, the ink collection passage 17 below the head substrate 12 is omitted, and instead, the ink 11 is collected through a lower portion of the ink supply passage 15 while the ink 11 is supplied through an upper portion of the ink supply passage 15.

In order to realize such an operation, it is necessary to provide a closed loop control for realizing a supply of the ink 11 in a manner which prevents the overflow of the ink 11 from the tip end of the printing head section. To this end, this twenty-fifth embodiment incorporates an optical sensor formed by an light emitting element 68 and a photo-detector 69 which are provided in mutually facing positions near the colorant ejection point 13*a* in order to detect an amount of ink protruding from the tip end of the printing head section, and a pump control circuit 70 for controlling the operation of the pump 65 according to the output of the optical sensor.

Namely, when the amount of ink protruding from the tip end of the printing head section becomes too large, the output of the photo-detector 69 decreases, and in response, the pump control circuit 27 controls the pump 65 to increase the negative pressure applied to the ink 11. ALso, when the amount of ink protruding from the tip end of the printing head section becomes too small, the output of the photo-detector 69 increases, and in response, the pump control circuit 27 controls the pump 65 to decrease the negative pressure applied to the ink 11.

By means of this control, the amount of the colorants 11A conveyed toward the colorant ejection point 13*a* and the other ink components such as the solvent which are dragged by the colorants becomes equal to the amount of the other ink components such as the solvent which are pulled back toward the pump 65, such that it becomes possible to maintain the velocity distribution 64 as shown in FIG. 46 stably. In other words, it is possible to set the average moving velocity over the entire ink to be nearly zero, i.e., the ink as a whole in a stationary state, while maintaining the flow of the colorants, so that the ink utilization efficiency can be improved and consequently the ink collection mechanism can be eliminated.

Thus, according to this twenty-sixth embodiment, the collection of the ink 11 becomes unnecessary, so that apart from the elongation of the life cycle of the ink solvent as in the twenty-fifth embodiment described above, it is also possible to simplify or eliminate the ink circulation mechanism, so that the apparatus can be realized at the lower cost and the higher reliability. Moreover, it is possible to realize the ink jet printing apparatus which does not easily cause the ink leakage at a time of the impact application.

It is to be noted that, in the above description, a case of using the closed loop control has been described, but it may also be possible to use an open loop control based on predetermined control setting which maintains a state in which the force exerted by the auxiliary electrode array 61 and the pressure applied by the pump 65 are balanced with each other by utilizing the fact that the surface tension exerted from the protruded ink surface toward the interior of the ink becomes stronger as the size of the ink protrusion becomes larger. In either case, it is necessary to keep a cross sectional schape of the ink protrusion to be flatter than a semi-circular shape.

It is also to be noted that, in the above description, a case of irradiating the optical beams from the light emitting element 68 into a direction perpendicular to an ink meniscus in order to detect the amount of ink protrusion, but it may also be possible to irradiate the optical beams into a horizontal direction instead, if desired.

Figure 47:
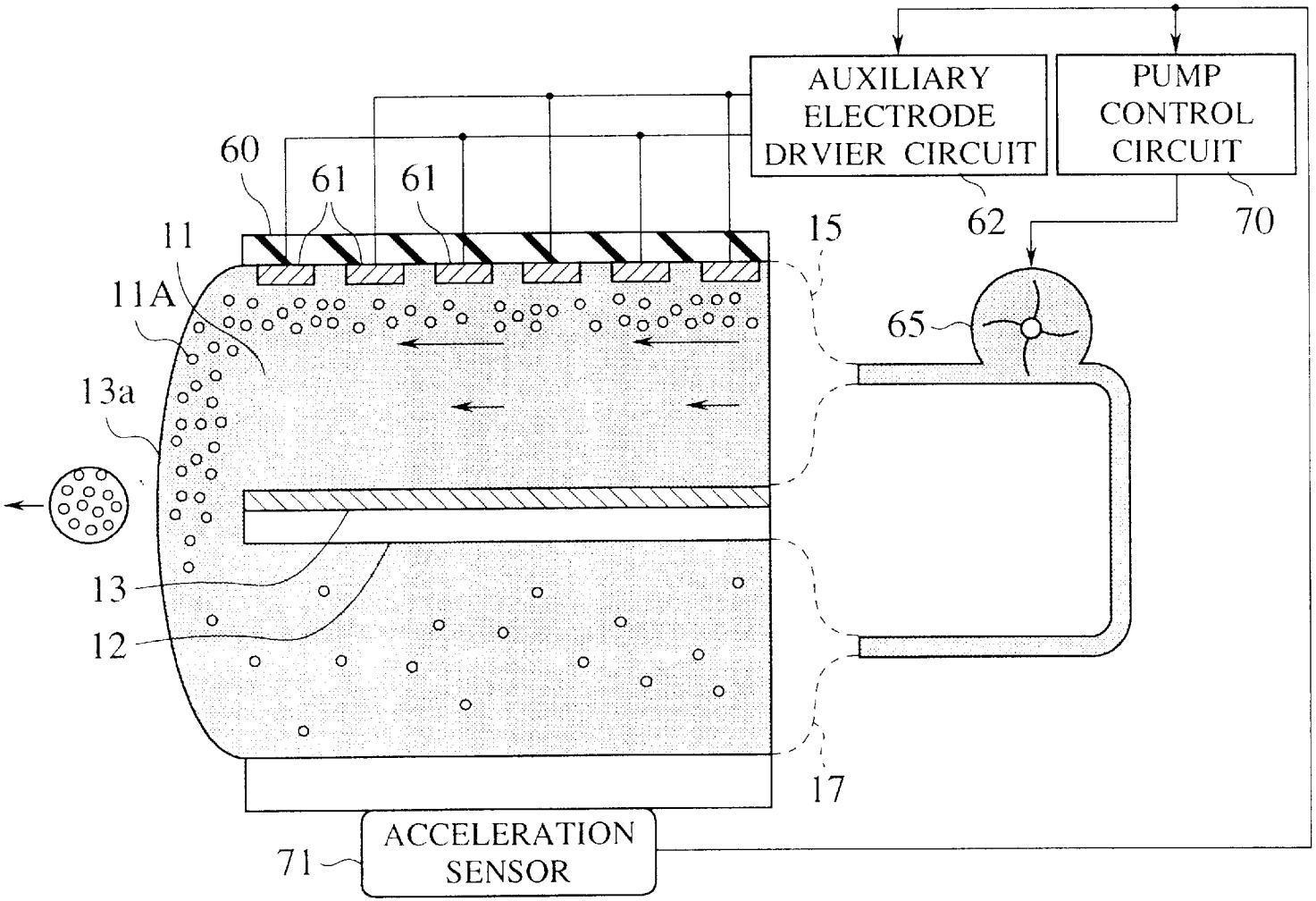
FIG. 47 is a schematic diagram of an ink jet printing apparatus in the twenty-seventh embodiment according to the present invention.

Referring now to FIG. 47, the twenty-seventh embodiment of an ink jet printing apparatus according to the present invention will be described in detail.

FIG. 47 shows a schematic configuration of the ink jet printing apparatus in this twenty-seventh embodiment. In this twenty-seventh embodiment, the twenty-fifth embodiment of FIG. 45 described above is modified to provide an additional measure for preventing the ink leakage due to the impact application. Namely, in this twenty-seventh embodiment, there is provided an acceleration sensor 71 for detecting the application of the impact on the printing head section. When this acceleration sensor 71 detects the application of the impact on the printing head section, its output is notified to the auxiliary electrode driver circuit 62 and the pump control circuit 70. In response, the auxiliary electrode driver circuit 62 and the pump control circuit 70 carry out the control to withdraw the ink 11 at the tip end of the printing head section inside instantaneously.

With this control system which applies the negative pressure to the ink 11 instantaneously by controlling the voltage applied to the auxiliary electrode array 61, the response is very quick so that the ink leakage can be prevented surely.

It is to be noted that, in this twenty-seventh embodiment, a system having the pump 65 and the pump control circuit 70 has been described, but the quick response necessary for the ink leakage prevention is required near the tip end of the printing head section, and this can be most effectively furnished by means of the auxiliary electrode array 61 which does not involve any mechanical action, so that the ink leakage prevention by means of the auxiliary electrode array 61 as described above can also be utilized in a system without any pump effectively.

Finally, an exemplary overall configuration of the ink jet printer utilizing the ink jet printing apparatus according to the present invention will be described with reference to FIGS. 48A and 48B.

Figure 48A:
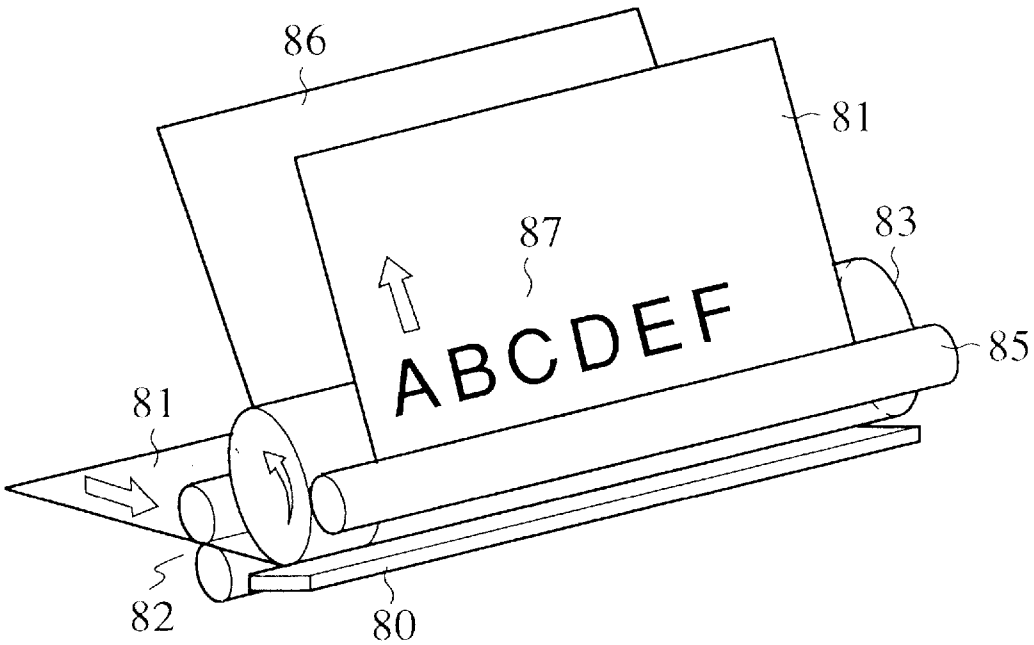
FIGS. 48A and 48B are illustrations of a part of an ink jet printer configuration suitable for the ink jet printing apparatus according to the present invention.
Figure 48B:
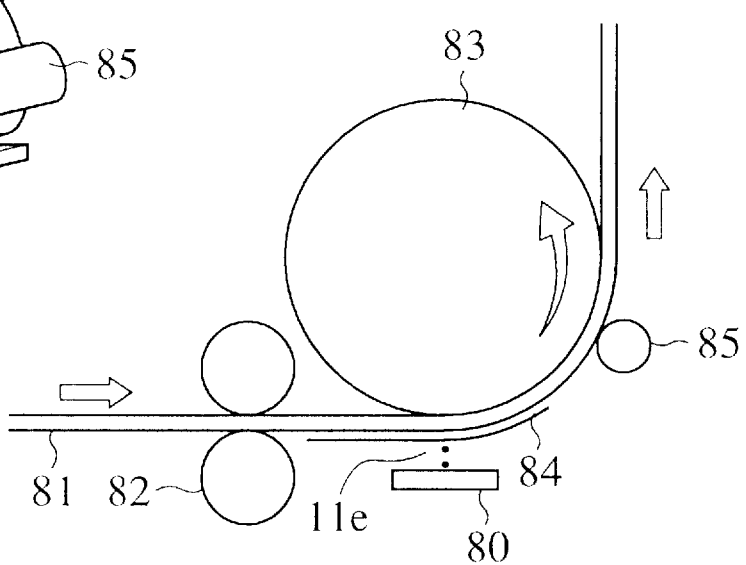

In a configuration shown in FIGS. 48A and 48B, a recording paper 81 supplied from a paper cassette (not shown) is supplied around a recording drum 83 by means of a paper supply roller 82, and then pushed against the recording drum 83 by means of a paper guide 84 and a paper hold roller 85. In a state in which the recording paper 81 is tightly held against the recording drum 83, the ink drops 11*e* containing the colorants are ejected from an ink jet printing head 80 according to the image signal, such that characters 87 can be printed on the recording paper 81 to realize the recording. Then, after this recording is finished, the recording paper 81 is ejected to a paper eject tray 86.

The ink jet printing head 80 used here is a line scanning type head capable of printing over an entire length in a width direction of the recording paper 81, which can be realized according to the various embodiments of the present invention described above.

It is to be noted that, although the twenty-third to twenty-seventh embodiments are described above for an overall configuration similar to that of the first to fifth embodiments described above, it is equally possible to apply these twenty-third to twenty-seventh embodiments to the ink jet printing apparatus with the planar printing head section as in the sixth to nineteenth embodiments described above.

It is also to be noted that, besides those already mentioned above, many modifications and variations of the above embodiments may be made without departing from the novel and advantageous features of the present invention. Accordingly, all such modifications and variations are intended to be included within the scope of the appended claims.

What is claimed is:

1. An ink jet printing apparatus, comprising:

a head substrate;

an electrode array formed on a surface of the head substrate;

ink supply means for supplying ink in which colorants are distributed in a solvent, over the electrode array on the surface of the head substrate;

voltage application means for applying voltages to the electrode array to produce an electric field for exerting an electrostatic force on the colorants in the ink supplied over the electrode array by the ink supply means such that the colorants are compressed and ejected toward a recording medium.

2. The apparatus of claim 1, wherein the voltage application means applies a prescribed bias voltage to the electrode array.

3. The apparatus of claim 1, wherein the electrode array is formed by a plurality of individual electrodes arranged in parallel to each other which are provided in correspondence to picture dots to be formed on the recording medium.

4. The apparatus of claim 3, wherein the voltage application means applies signal voltages to selected ones of the individual electrodes according to the picture dots constituting an image to be formed on the recording medium.

5. The apparatus of claim 3, wherein the colorants are compressed and ejected at tip end portions of the individual electrodes.

6. The apparatus of claim 3, wherein each individual electrode has a pointed edge with a circular tip end portion.

7. The apparatus of claim 6, wherein the circular tip end portion has a radius in a range of 15 $\mu$m to 100 $\mu$m.

8. The apparatus of claim 1, wherein the colorants in the ink are charged in a prescribed polarity, while the solvent of the ink is insulative.

9. The apparatus of claim 8, wherein the voltage application means applies the voltages in an identical polarity as that in which the colorants in the ink are charged.

10. The apparatus of claim 1, wherein the ink supply means supplies the ink such that the electrode array is completely covered by the ink supplied over the electrode array by the ink supply means.

11. The apparatus of claim 1, further comprising ink collection means for collecting the ink which passed over the electrode array through an ink collection passage provided on a side of the head substrate opposite to a side on which the electrode array is provided.

12. The apparatus of claim 1, wherein the recording medium is provided over a facing electrode which is set at a ground potential level.

13. The apparatus of claim 1, wherein the electrode array is formed on the surface of the head substrate with tip end portions of individual electrodes constituting the electrode array located at positions retreated from an edge of the head substrate facing toward the recording medium.

14. The apparatus of claim 1, wherein the electrostatic force exerted on the colorants is such that the colorants are ejected with an initial velocity component perpendicular to the surface of the head substrate on which the electrode array is formed.

15. The apparatus of claim 1, wherein the recording medium is positioned such that an angle between a plane tangent to points on the recording medium for receiving ejected colorants and a plane extended from the surface of the head substrate is less than or equal to 90°.

16. The apparatus of claim 1, further comprising additional electrode means to which a prescribed bias voltage is applied.

17. The apparatus of claim 16, wherein the additional electrode means produces an electric field for exerting an electrostatic force on the colorants in the ink supplied over the electrode array by the ink supply means such that the colorants are compressed at a tip end portion of the electrode array.

18. The apparatus of claim 16, wherein the electrode array is formed by a plurality of individual electrodes provided in correspondence to picture dots to be formed on the recording medium, while the additional electrode means is formed by a single common electrode.

19. The apparatus of claim 16, wherein the additional electrode means is formed on another surface of the head substrate opposite to the surface on which the electrode array is formed.

20. The apparatus of claim 16, wherein the additional electrode means is formed on the surface of the head substrate on which the electrode array is formed.

21. The apparatus of claim 20, wherein the additional electrode means is provided around a tip end portion of the electrode array.

22. The apparatus of claim 16, wherein the electrode array is formed by a plurality of individual electrodes arranged in parallel to each other, and the additional electrode means is formed in a shape which engages with the individual electrodes.

23. The apparatus of claim 1, wherein the electrostatic force exerted on the colorants is such that the colorants are ejected in a direction perpendicular to the surface of the head substrate on which the electrode array is formed.

24. The apparatus of claim 1, wherein the electrode array is formed by a plurality of individual electrodes, each individual electrode having a tip end portion projecting from the surface of the head substrate.

25. The apparatus of claim 24, wherein the individual electrodes are arranged in more than one rows arranged along a sub scanning direction, each row having a number of individual electrodes arranged along a main scanning direction such that the individual electrodes arranged on different rows are positioned at different positions along the main scanning direction.

26. The apparatus of claim 24, further comprising a cover member provided over the surface of the head substrate to define an ink supply passage through which the ink supply means supplied the ink between the surface of the head substrate and the cover member, the cover member having at least one slit provided over the individual electrodes arranged along a main scanning direction such that the tip end portion of each individual electrode sticks out through the slit.

27. The apparatus of claim 24, further comprising a cover member provided over the surface of the head substrate to define an ink supply passage through which the ink supply means supplied the ink between the surface of the head substrate and the cover member, the cover member having a plurality of holes provided in correspondence to the individual electrodes arranged along the main scanning direction such that the tip end portion of each individual electrode sticks out through a corresponding one of the holes.

28. The apparatus of claim 24, wherein the tip end portion of each individual electrode has a shape tapering in a direction perpendicular to the surface of the head substrate.

29. The apparatus of claim 24, wherein the tip end portion of each individual electrode has a non-pointed top.

30. The apparatus of claim 24, wherein the tip end portion of each individual electrode includes a plurality of projecting electrode members projecting from the surface of the head substrate.

31. The apparatus of claim 24, wherein the tip end portion of each individual electrode is formed by a projecting electrode covering a projection provided on the surface of the head substrate.

32. The apparatus of claim 24, wherein the tip end portion of each individual electrode is formed by a projecting electrode in a shape of a projection attached on the surface of the head substrate.

33. The apparatus of claim 24, wherein the tip end portions of the individual electrodes are formed on a continuous projection provided on the surface of the head substrate.

34. The apparatus of claim 24, wherein the tip end portion of each individual electrode is covered by an insulative layer.

35. The apparatus of claim 24, further comprising a cover member provided over the surface of the head substrate to define an ink supply passage through which the ink supply means supplied the ink between the surface of the head substrate and the cover member, and an additional electrode means provided between the electrode array and the surface of the head substrate, where a prescribed bias voltage is applied between the cover member and the additional electrode means.

36. The apparatus of claim 35, wherein the additional electrode means produces an electric field for exerting an electrostatic force on the colorants in the ink supplied over the electrode array by the ink supply means such that the colorants are compressed in a vicinity of the cover member.

37. The apparatus of claim 35, wherein the plurality of individual electrodes forming the electrode array are provided in correspondence to picture dots to be formed on the recording medium, while the additional electrode means is formed by a single common electrode.

38. The apparatus of claim 24, wherein the voltage application means also applies a prescribed bias voltage to each individual electrode of the electrode array.

39. The apparatus of claim 38, wherein the bias voltage applied to each individual electrode produces an electric field for exerting an electrostatic force on the colorants in the ink supplied over the electrode array by the ink supply means such that the colorants are compressed at the tip end portion of each individual electrode.

40. The apparatus of claim 38, wherein the bias voltage applied to each individual electrode produces an electric field for exerting an electrostatic force on the colorants in the ink supplied over the electrode array by the ink supply means such that the tip end portion of each individual electrode is completely covered by the ink supplied over the electrode array by the ink supply means.

41. An ink jet printing apparatus, comprising:

compression means for compressing colorants distributed in a solvent of an ink; and ejection means, separately provided from the compression means, for ejecting the colorants compressed by the compression means toward a recording medium.

42. The apparatus of claim 41, wherein the ejection means ejects the colorants by exerting an electrostatic force on the colorants in a direction toward a recording medium.

43. The apparatus of claim 42, wherein the ejection means injects charged into the colorants while exerting the electrostatic force.

44. The apparatus of claim 41, wherein the ejection means includes an electrode array formed by a plurality of individual electrodes which are provided in correspondence to picture dots to be formed on the recording medium, and signal voltage application means for applying signal voltages to selected ones of the individual electrodes according to the picture dots constituting an image to be formed on the recording medium.

45. The apparatus of claim 44, wherein the signal voltage application means applies pulsed signal voltages with at least one of a voltage value and a pulse width of each pulsed signal voltage adjusted according to the image to be formed on the recording medium.

46. The apparatus of claim 41, wherein the ejection means includes an electrode array with a prescribed colorant ejection region over which the ink is supplied, and the compression means is provided in a vicinity of the colorant ejection region of the electrode array, within an ink supply passage through which the ink is supplied over the electrode array.

47. The apparatus of claim 41, wherein the ejection means includes an electrode array formed by a plurality of individual electrodes which are arranged in parallel to each other, and the compression means includes a pair of compression electrodes which are arranged in a direction perpendicular to the individual electrodes.

48. The apparatus of claim 41, wherein the colorants are charged, and the compression means compresses the colorants by exerting an electrostatic force to regulate the colorants against a flow of the ink.

49. The apparatus of claim 41, wherein the colorants are charged in a prescribed polarity while the solvent is insulative, and the compression means includes a pair of compression electrodes which are arranged with a prescribed gap therebetween along a direction of an ink flow, and compression voltage application means for applying a prescribed compression voltage in a polarity identical to the prescribed polarity to one of the compression electrodes which is positioned at a downstream side of the ink flow with respect to another one of the compression electrodes which is positioned at an upstream side of the ink flow.

50. The apparatus of claim 49, wherein the compression voltage application means stops applying the compression voltage when the ejection means ejects the colorants.

51. The apparatus of claim 49, wherein the compression means further includes removal voltage application means for applying a prescribed removal voltage in a polarity identical to the prescribed polarity to said another one of the compression electrodes which is positioned at the upstream side of the ink flow with respect to said one of the compression electrodes which is positioned at the downstream side of the ink flow, after the colorants are ejected by the ejection means.

52. The apparatus of claim 41, wherein the colorants are magnetic, and the compression means compresses the colorants by exerting a magnetic force to regulate the colorants against a flow of the ink.

53. The apparatus of claim 41, wherein the colorants are magnetic while the solvent is non-magnetic, and the compression means includes a pair of induction electrodes which are arranged with a prescribed gap therebetween along a direction of an ink flow, and magnetic field application means for applying a prescribed magnetic field to the gap between the induction electrodes.

54. The apparatus of claim 41, wherein the colorants are charged, and the compression means compresses the colorants by exerting an electrostatic force to move the colorants toward the ejection means.

55. The apparatus of claim 41, wherein the colorants are charged in a prescribed polarity while the solvent is insulative, and the compression means includes at least one compression electrode provided in an ink chamber to which the ink is supplied, and compression voltage application means for applying a prescribed compression voltage in a polarity identical to the prescribed polarity to the compression electrode.

56. The apparatus of claim 55, wherein the ejection means is provided on one side of the ink chamber, and the compression electrode is provided on another side of the ink chamber opposite to said one side.

57. The apparatus of claim 55, wherein the compression electrode is formed around ink collection ports through which the ink in the ink chamber is withdrawn from the ink chamber.

58. The apparatus of claim 57, wherein the compression electrode includes an electrode member formed concentrically around each ink collection port.

59. The apparatus of claim 55, wherein the ejection means is provided on one side of the ink chamber, and the compression electrode includes a plurality of electrode members arranged along a direction toward said one side.

60. The apparatus of claim 59, wherein the compression voltage application means applies a series of compression voltages with at least one of timings and voltage values sequentially displaced from each other to the plurality of electrode members, such that the electrode members exert an electrostatic force to move the colorants toward the ejection means.

61. An ink jet printing apparatus, comprising:

a head substrate having an electrode array formed on a surface of the head substrate over which ink having colorants distributed in a solvent is supplied;

voltage application means for applying voltages to the electrode array to produce an electric field for exerting an electrostatic force on the colorants in the ink supplied over the electrode array such that the colorants are compressed and ejected from a colorant ejection point on the electrode array toward a recording medium;

an auxiliary substrate provided over the head substrate defining an ink supply passage through which the ink is supplied over the electrode array; and colorant convey means, provided on a surface of the auxiliary substrate facing toward the electrode array, for conveying colorants in the ink through the ink supply passage toward the colorant ejection point on the electrode array.

62. The apparatus of claim 61, wherein the voltage application means applies signal voltages for ejecting the colorants according to the picture dots constituting an image to be formed on the recording medium, and a prescribed bias voltage for compressing the colorants in a vicinity of the colorant convey means.

63. The apparatus of claim 61, wherein the colorant convey means includes an auxiliary electrode array formed on the surface of the auxiliary substrate facing toward the electrode array, and driving means for applying driving voltages to the auxiliary electrode array to produce an electric field for exerting an electrostatic force on the colorants such that the colorants are conveyed toward the colorant ejection point on the electrode array.

64. The apparatus of claim 63 wherein the electrode array is formed by a plurality of individual electrodes arranged in parallel to each other, and the auxiliary electrode array is formed by a plurality of auxiliary electrodes arranged in a direction perpendicular to the individual electrodes.

65. The apparatus of claim 63, wherein the auxiliary electrode array is formed by a plurality of auxiliary electrodes arranged along the ink supply passage, and the driving means applies the driving voltages in phase shift controlled multi-phase voltage sequences in which selected ones of the auxiliary electrodes to which the driving voltages are applied in each phase are sequentially shifted.

66. The apparatus of claim 65, wherein the phase shift controlled multi-phase voltage sequences includes two phases, and the apparatus further comprises pressurizing means for applying a positive pressure to the ink in a direction of a flow of the ink.

67. The apparatus of claim 65 wherein the plurality of auxiliary electrodes are arranged along the ink supply passage at non-uniform interval such that the electrode array includes intervals at which the auxiliary electrodes are not provided and through which the colorants are conveyed toward the colorant ejection point on the electrode array by inertial motions of the colorants.

68. The apparatus of claim 61, wherein the colorant covey means is divided into a plurality of sections along a direction perpendicular to a direction of a flow of the ink through the ink supply passage, and a colorant conveying rate in each section is controlled separately.

69. The apparatus of claim 68, wherein the colorant conveying rate in each section is controlled according to a recording data occurrence frequency in each section.

70. The apparatus of claim 68, wherein the colorant conveying rate in a section containing a side wall of the ink supply passage is controlled to be greater than the colorant conveying rate in a section not containing a side wall of the ink supply passage.

71. The apparatus of claim 61, further comprising pressurizing means for applying a negative pressure to the ink in a direction opposite to a direction to which the colorants are covered by the colorant convey means.

72. The apparatus of claim 71, further comprising sensor means for detecting an amount of the ink protruding from the colorant ejection point, and control means for controlling the negative pressure applied by the pressurizing means according to the amount of the ink detected by the sensor means.

73. The apparatus of claim 71, further comprising sensor means for detecting an impact applied to the apparatus, and control means for controlling the negative pressure applied by the pressurizing means according to the impact detected by the sensor means.

74. The apparatus of claim 71, wherein the pressurizing means applies the negative pressure to move the solvent of the ink in a direction opposite to a direction to which the colorants are conveyed by the colorant convey means.

75. The apparatus of claim 61, wherein the colorant convey means includes an auxiliary electrode array formed on the surface of the auxiliary substrate facing toward the electrode array, and driving means for applying driving voltages to the auxiliary electrode array to convey the colorants toward the colorant ejection point on the electrode array, while the apparatus further comprises sensor means for detecting an impact applied to the apparatus such that the driving means stops applying the driving voltages to the auxiliary electrode array when the sensor means detects the impact.

76. An ink jet printing apparatus, comprising:

a head substrate;

at least one electrode formed on a surface of the head substrate;

an ink supply unit configured to supply ink in which colorants are distributed in a solvent, the ink being provided over a top surface of the at least one electrode by positive pressure applied to the ink by the ink supply unit, and the ink being provided over a tip portion and a bottom surface of the at least one electrode by negative pressure applied to the ink by the ink supply unit; and a voltage application unit connected to the at least one electrode and configured to provide an apply voltage to the at least one electrode to produce an electric field for exerting an electrostatic force on the colorants in the ink provided over the at least one electrode by the ink supply unit such that the colorants are compressed and ejected toward a recording medium.

77. The apparatus of claim 76, wherein the voltage application unit provides a bias voltage to the at least one electrode at all time when the ink jet printing apparatus is in an operative state.

78. The apparatus of claim 77, wherein the bottom surface of the at least one electrode is rigidly connected to the head substrate, and wherein the tip portion of the at least one electrode is constantly and entirely covered with ink provided by the ink supply unit when the ink jet printing apparatus is in the operative state.

79. The apparatus of claim 76, wherein the bottom surface of the at least one electrode is rigidly connected to the head substrate, and wherein the tip portion of the at least one electrode is constantly and entirely covered with ink provided by the ink supply unit when the ink jet printing apparatus is in an operative state.

80. An ink jet printing apparatus, comprising:

a compression unit configured to compress colorants distributed in a solvent of an ink; and an ejection unit, separately provided from the compression unit, for ejecting the colorants compressed by the compression unit toward a recording medium.

* * * * *